US011944879B2

(12) United States Patent
Woodward et al.

(10) Patent No.: US 11,944,879 B2
(45) Date of Patent: Apr. 2, 2024

(54) GOLF CLUB HEAD WITH L-SHAPED FACEPLATE AND DYNAMIC LOFTING FEATURES

(71) Applicant: KARSTEN MANUFACTURING CORPORATION, Phoenix, AZ (US)

(72) Inventors: Alex G. Woodward, Phoenix, AZ (US); Ryan M. Stokke, Anthem, AZ (US); Xiaojian Chen, Phoenix, AZ (US); Suraj Megharaja, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/583,103

(22) Filed: Jan. 24, 2022

(65) Prior Publication Data

US 2022/0233924 A1 Jul. 28, 2022

Related U.S. Application Data

(60) Provisional application No. 63/282,577, filed on Nov. 23, 2021, provisional application No. 63/263,936, (Continued)

(51) Int. Cl.
*A63B 53/04* (2015.01)

(52) U.S. Cl.
CPC ..... *A63B 53/0475* (2013.01); *A63B 53/0408* (2020.08); *A63B 53/0416* (2020.08); *A63B 53/0433* (2020.08)

(58) Field of Classification Search
CPC ..... A63B 53/0475; A63B 53/0416; A63B 53/0433; A63B 53/0408; A63B 53/042
See application file for complete search history.

(56) References Cited

U.S. PATENT DOCUMENTS 4,883,275 A 11/1989 Boone
6,875,124 B2 4/2005 Gilbert et al.
(Continued)

FOREIGN PATENT DOCUMENTS

JP 2004215724 8/2004
JP 2008080095 4/2008
(Continued)

OTHER PUBLICATIONS

"Pxg Launch 0211 Irons to the Mass Market" (https://worldwide.golf/equipment/pxg_0211_irons/ ).
(Continued)

*Primary Examiner* — William M Pierce

(57) ABSTRACT

Embodiments of an iron-type golf club head comprising an L-shaped faceplate configured for flexibility are described herein. The L-shaped faceplate comprises a strike face portion and a sole return that wraps around a leading edge of the golf club head. In some embodiments, the L-shaped faceplate further comprises a top rail extension and a toe extension that extend to the peripheries of the golf club head. The golf club head comprises a rear body configured to receive the L-shaped faceplate to form a hollow interior cavity. The rear body comprises a sole ledge configured to receive the sole return. In some embodiments, the golf club head further comprises a weight pad that overhangs a portion of the sole return. In some embodiments, the golf club head further comprises dynamic lofting features that increase the bending in the rear body.

20 Claims, 16 Drawing Sheets

Related U.S. Application Data filed on Nov. 11, 2021, provisional application No. 63/140,741, filed on Jan. 22, 2021.

(56) References Cited

U.S. PATENT DOCUMENTS

| | | | | |
|---|---|---|---|---|
| 7,083,531 | B2 | 8/2006 | Aguinaldo et al. | |
| 7,121,958 | B2 | 10/2006 | Cheng et al. | |
| 7,169,057 | B2 | 1/2007 | Wood et al. | |
| 7,247,811 | B2 | 7/2007 | Chen et al. | |
| 7,371,188 | B2 | 5/2008 | Chen | |
| 7,662,051 | B2 | 2/2010 | Chen | |
| 7,731,604 | B2 | 6/2010 | Wahl et al. | |
| 8,012,040 | B2 | 9/2011 | Takechi | |
| 8,257,195 | B1 * | 9/2012 | Erickson | A63B 60/02 473/335 |
| 8,475,293 | B2 * | 7/2013 | Morin | A63B 53/047 473/349 |
| 8,900,070 | B1 * | 12/2014 | Dawson | A63B 60/02 473/335 |
| 8,920,259 | B2 | 12/2014 | Takechi | |
| 8,932,150 | B2 | 1/2015 | Ines et al. | |
| 9,044,653 | B2 | 6/2015 | Wahl et al. | |
| 9,211,451 | B1 * | 12/2015 | Westrum | A63B 60/42 |
| 9,522,311 | B2 | 12/2016 | Doi et al. | |
| 9,586,105 | B1 * | 3/2017 | Westrum | A63B 60/42 |
| 9,764,208 | B1 | 9/2017 | Parsons et al. | |
| 9,802,089 | B2 | 10/2017 | Honea et al. | |
| 9,802,091 | B2 | 10/2017 | Taylor et al. | |
| 10,039,965 | B1 * | 8/2018 | Seluga | A63B 60/54 |
| 10,071,291 | B2 | 9/2018 | Daraskavich et al. | |
| 10,220,272 | B2 | 3/2019 | Gonzalez et al. | |
| 10,293,223 | B2 * | 5/2019 | Kii | A63B 53/047 |
| 10,300,352 | B2 | 5/2019 | Daraskavich et al. | |
| 10,322,323 | B2 | 6/2019 | Kii | |
| RE47,653 | E | 10/2019 | Wahl et al. | |
| 10,543,409 | B2 * | 1/2020 | Demkowski | A63B 60/52 |
| 10,596,425 | B2 | 3/2020 | Parsons et al. | |
| 10,625,126 | B2 * | 4/2020 | Demkowski | A63B 60/00 |
| 10,688,350 | B2 | 6/2020 | Jertson et al. | |
| 10,744,377 | B1 | 8/2020 | Chuang et al. | |
| 10,792,543 | B2 | 10/2020 | Taylor et al. | |
| 10,799,777 | B2 | 10/2020 | Finn et al. | |
| 10,821,338 | B2 | 11/2020 | Hebreo et al. | |
| 10,870,042 | B2 | 12/2020 | Wahl et al. | |
| 10,874,921 | B2 | 12/2020 | Parsons et al. | |
| 10,881,925 | B2 | 1/2021 | Demkowski et al. | |
| 10,953,293 | B2 | 3/2021 | Demkowski et al. | |
| 11,033,788 | B1 | 6/2021 | Hobbs et al. | |
| 11,135,486 | B2 | 10/2021 | Higdon | |
| 11,185,747 | B2 | 11/2021 | Wang et al. | |
| 11,202,946 | B2 | 12/2021 | Golden et al. | |
| 11,235,208 | B2 * | 2/2022 | Yamamoto | A63B 60/02 |
| 11,235,211 | B2 | 2/2022 | Parsons et al. | |
| 11,260,276 | B2 | 3/2022 | Motokawa | |
| 11,298,596 | B2 | 4/2022 | Morales et al. | |
| 11,331,549 | B2 | 5/2022 | Henrikson et al. | |
| 11,406,882 | B2 * | 8/2022 | Taylor | A63B 53/042 |
| 11,458,373 | B2 * | 10/2022 | Wang | A63B 53/0408 |
| 2009/0023513 | A1 | 1/2009 | Shibata et al. | |
| 2016/0045792 | A1 | 2/2016 | Ines et al. | |
| 2016/0158607 | A1 | 6/2016 | Parsons et al. | |
| 2017/0246517 | A1 | 8/2017 | Ueda et al. | |
| 2017/0282027 | A1 | 10/2017 | Parsons et al. | |
| 2017/0340928 | A1 | 11/2017 | Parsons et al. | |
| 2018/0185715 | A1 * | 7/2018 | Demkowski | A63B 60/52 |
| 2018/0185717 | A1 * | 7/2018 | Demkowski | A63B 53/047 |
| 2018/0236325 | A1 | 8/2018 | Parsons et al. | |
| 2018/0296884 | A1 * | 10/2018 | Kii | A63B 53/047 |
| 2019/0217167 | A1 * | 7/2019 | Seluga | A63B 53/06 |
| 2019/0374822 | A1 | 12/2019 | Barker et al. | |
| 2020/0030673 | A1 | 1/2020 | Sasamoto | |
| 2020/0353325 | A1 * | 11/2020 | Taylor | A63B 53/042 |
| 2020/0398121 | A1 | 12/2020 | Ban | |
| 2021/0322839 | A1 * | 10/2021 | Wang | A63B 53/0412 |
| 2021/0331045 | A1 | 10/2021 | Halberg et al. | |

FOREIGN PATENT DOCUMENTS

| | | |
|---|---|---|
| JP | 2008246086 | 10/2008 |
| JP | 4494927 | 6/2010 |
| JP | 4958625 | 6/2012 |
| JP | 5063163 | 10/2012 |
| JP | 5416737 | 2/2014 |
| JP | 6188759 | 8/2017 |
| JP | 2018093959 | 6/2018 |
| JP | 6661962 | 3/2020 |
| WO | 2016133827 | 8/2016 |

OTHER PUBLICATIONS

"Callaway's Epic Forged Irons Offer More Ball Speed and a Softer Feel", David Dusek (Year: 2019) (https://golfweek.usatoday.com/2019/07/16/callaway-epic-forged-irons/).

International Search Report and Written Opinion for PCT Application No. PCT/US2022/013571, 14 pages, dated Apr. 5, 2022.

* cited by examiner

GOLF CLUB HEAD WITH L-SHAPED FACEPLATE AND DYNAMIC LOFTING FEATURES

CROSS REFERENCE PRIORITIES

This claims the benefit of U.S. Provisional Application No. 63/282,577, filed Nov. 23, 2021; U.S. Provisional Application No. 63/263,936, filed Nov. 11, 2021; and U.S. Provisional Application No. 63/140,741, filed Jan. 22, 2021.

TECHNICAL FIELD

This disclosure relates generally to golf clubs and, more particularly, relates to golf club heads having features for increased energy transfer and golf clubs having laser welded faces.

BACKGROUND

In golf, the way a club head flexes and bends at the point of impact affects the launch characteristics of the golf ball being struck. The overall amount of flexure of the faceplate and/or other portions of the club head influences the amount of energy transferred from the club head to the ball and influences the ball speed at impact. The amount of a club's rearward bend at the point of impact with a golf ball (hereafter "dynamic lofting") further influences ball speed as well as the launch angle of the ball at impact. The dynamic loft of a golf club is measured as the amount of loft on the face of the club at the point of impact relative to a ground plane. Additional bending, or dynamic lofting, of a club head can increase the amount of spring energy stored by the golf club. The increased transfer of spring energy back to the golf ball can increase the ball speed off the face for improved club performance. Thus, there is a need in the art for a golf club with improved flexure and dynamic lofting characteristics.

BRIEF DESCRIPTION OF THE DRAWINGS

To facilitate further description of the embodiments, the following drawings are provided in which.

DEFINITIONS

Figure 1:
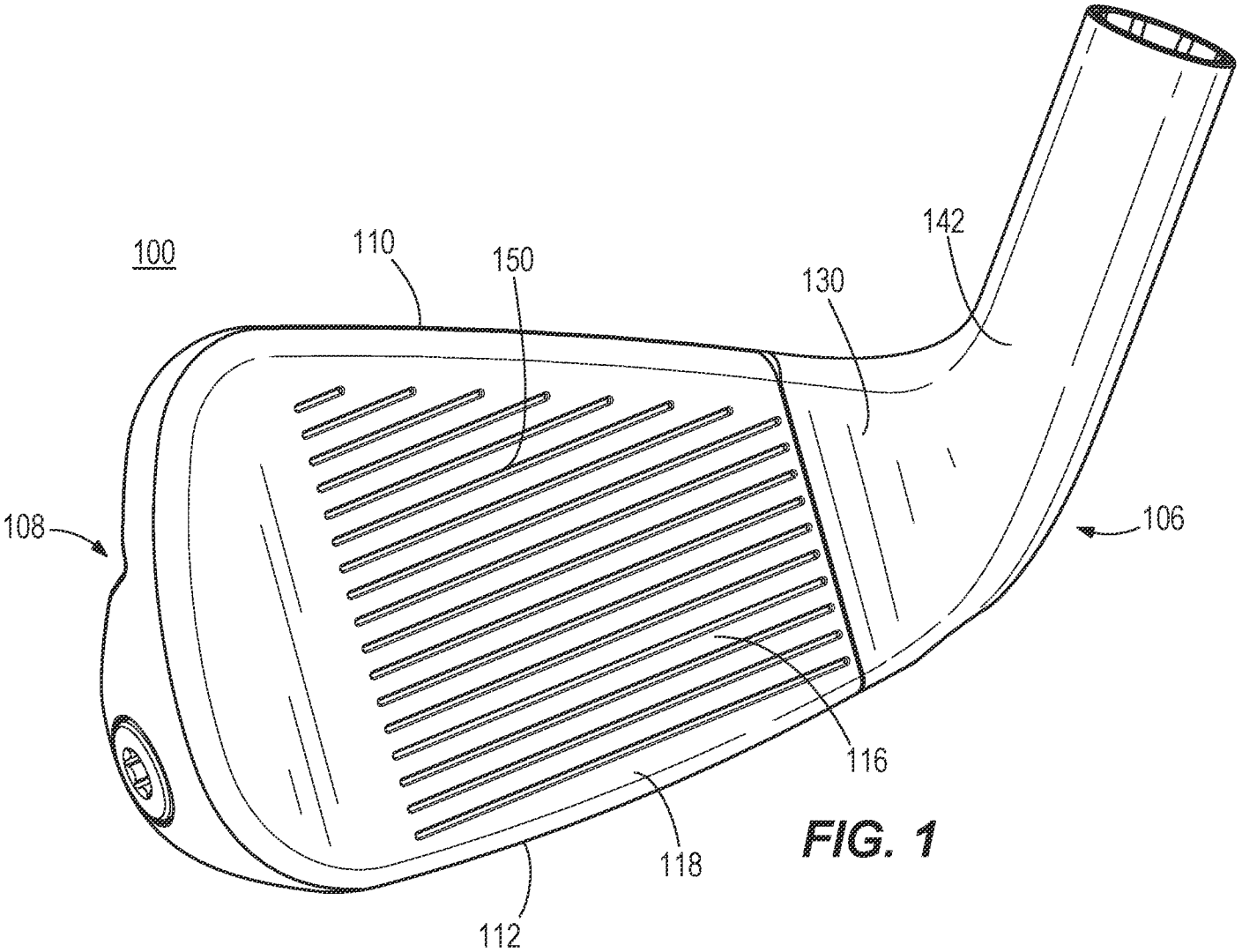
FIG. 1 illustrates a toe-side perspective view of a golf club head comprising an L-shaped faceplate according to a first embodiment.

The various embodiments of the golf club head described herein can be iron-type golf clubs or crossover-type golf clubs comprising an L-shaped faceplate, sole ledge, and undercut to achieve maximum faceplate flexure, resulting in high ball speeds. The golf club head comprises a rear body and an L-shaped faceplate coupled together to enclose a hollow interior cavity and can further include a rear portion configured for dynamic loft at impact. The L-shaped faceplate comprises a high-strength material that replaces areas of the club head that would otherwise be formed of lower-strength rear body material, allowing said areas to be thinned without losing structural integrity. The thinning provides a club head with an increased ability to flex, leading to higher ball speeds. An internal weight pad allows mass to be positioned lower in the golf club head. The internal weight pad overhangs the sole return and forms an undercut that prevents the faceplate from contacting the internal weight pad. The sole ledge provides a buffer region between the L-shaped faceplate and the rear body and prevents the internal weight pad from interfering in the flexure of the L-shaped faceplate.

The club head can further comprise various features that contribute to dynamic lofting at impact. For example, an internal surface of the rear portion can have a bending notch, or cut-out portion located near the toe end of the club head. Likewise, a rear wall of the rear body can have a flexure hinge, which is a recessed groove on the rear wall.

which extends from a heel end of the club head to a toe end of the club head. The increased dynamic lofting of the club head achieved through said dynamic lofting features leads to increased launch angle and ball speeds at impact.

The various L-shaped faceplate geometries described herein including a sole return, a toe extension, a top rail extension, or any combination thereof can be combined with any of the various rear body features or geometries described herein including a sole ledge, an angled weight pad, a weight pad comprising an extension, a heel mass and/or toes mass, a lower interior undercut, an upper interior undercut, a rear exterior cavity, an external flexure hinge, an internal bending notch, an internal welding rib, or any combination thereof.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The term "strike face," as used herein, refers to a club head front surface that is configured to strike a golf ball. The term strike face can be used interchangeably with the "face."

The term "strike face perimeter," as used herein, can refer to an edge of the strike face. The strike face perimeter can be located along an outer edge of the strike face where the curvature deviates from a bulge and/or roll of the strike face.

The term "geometric centerpoint," as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA). For example, the geometric centerpoint of the strike face can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The term "ground plane," as used herein, can refer to a reference plane associated with the surface on which a golf ball is placed. The ground plane can be a horizontal plane tangent to the sole at an address position.

The term "loft plane," as used herein, can refer to a reference plane that is tangent to the geometric centerpoint of the strike face.

The term "loft angle," as used herein, can refer to an angle measured between the ground plane and the loft plane.

The term "effective depth" as used herein, can refer to the depth of the sole return that does not contact a portion of the rear body. In some embodiments, the effective depth is the depth of the sole return that is unhindered by the weight pad.

DESCRIPTION

Referring to FIG. 1, the hollow body club head 100 comprising an L-shaped faceplate 150 and dynamic lofting features comprises a front end 102, a rear end 104, a heel end 106, a toe end 108, a top rail 110, and a sole 112. The L-shaped faceplate 150 comprises a strike face 116 at the front end 102, with a loft plane 101 extending along the strike face 116.

Figure 2A:
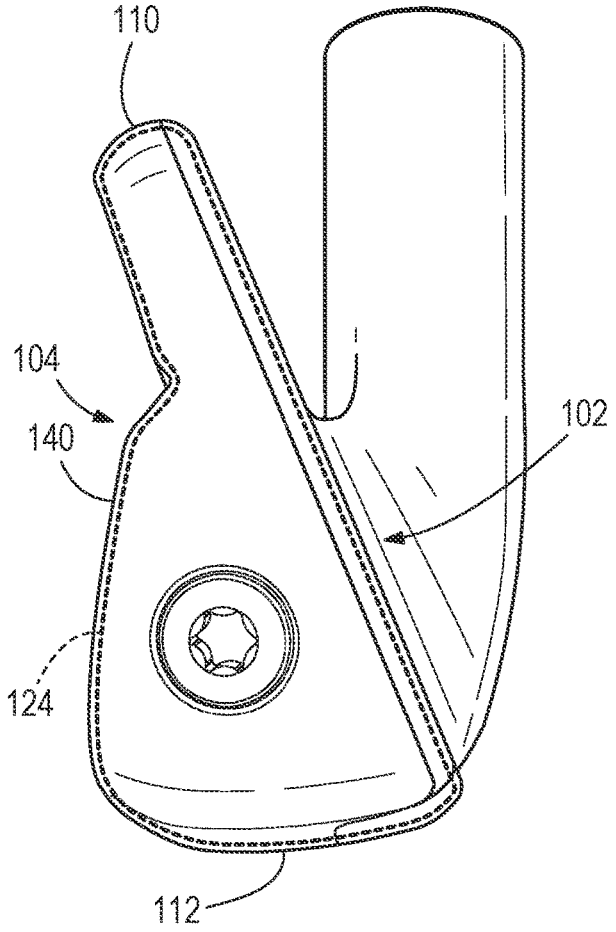
FIG. 2A illustrates a toe-side view of the golf club head of FIG. 1.
Figure 2B:
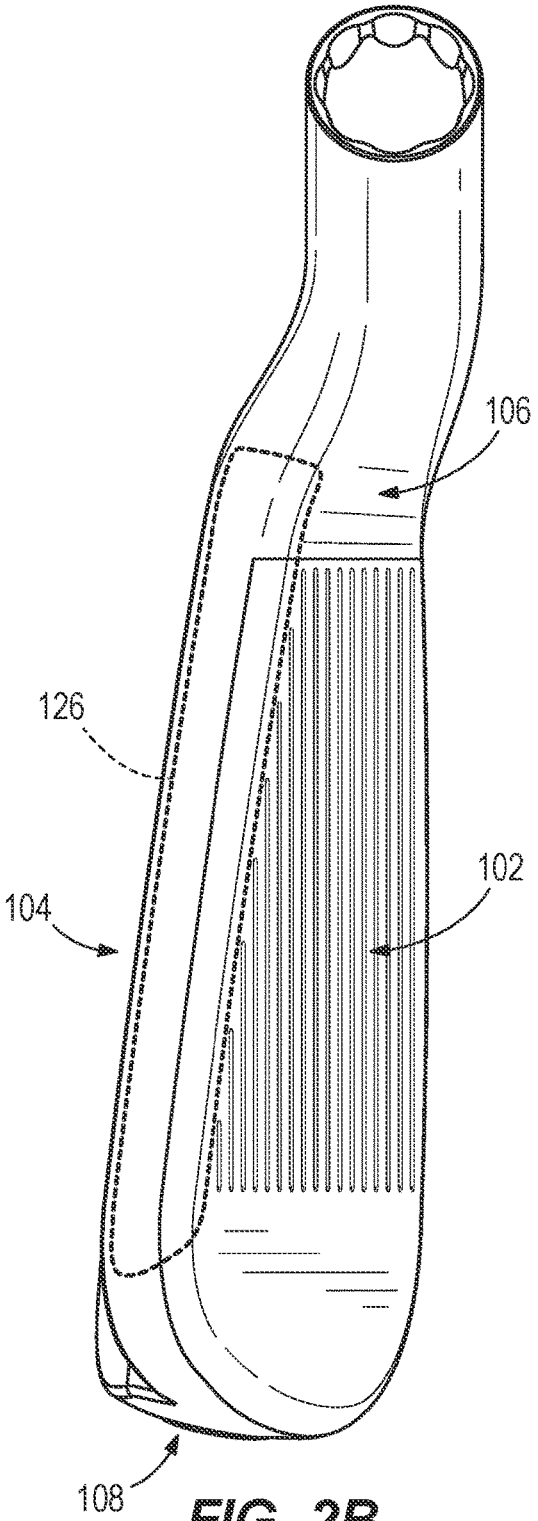
FIG. 2B illustrates a top view of the golf club head of FIG. 1.
Figure 2C:
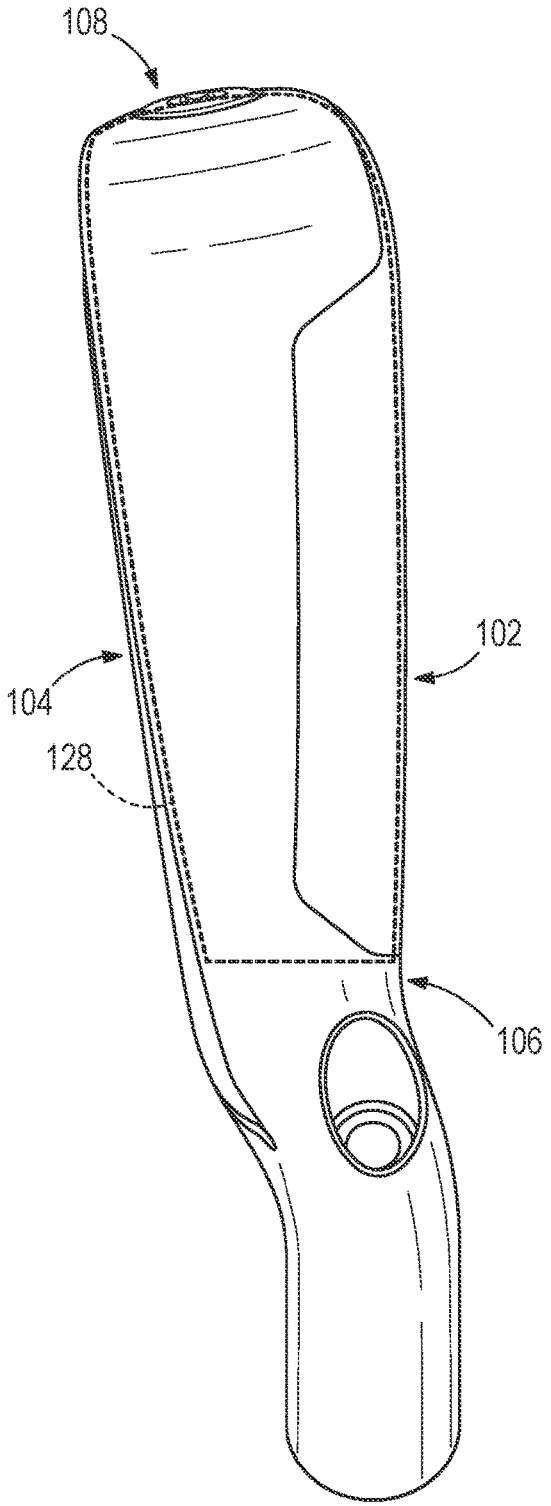
FIG. 2C illustrates a sole view of the golf club head of FIG. 1.
Figure 2D:
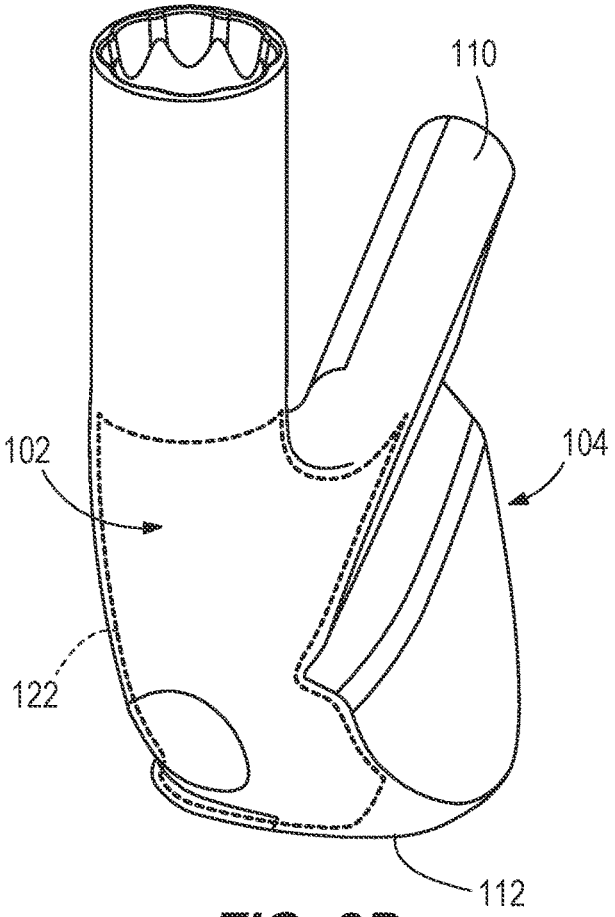
FIG. 2D illustrates a heel-side view of the golf club head of FIG. 1.

The top rail 110, heel end 106, toe end 108, and sole 112 extend rearward from the strike face perimeter 163 and form the periphery of the club head 100. Referring to FIGS. 2A-2D, the club head peripheries are defined by the surfaces of the club head 100 that are located off of the strike face 116, between the front end 102 and the rear end 104. The boundary between the periphery and the club head 100 occurs at the point along the strike face perimeter 163 where the strike face 116 deviates from being substantially flat. Referring to FIG. 2A, the club head 100 defines a toe side periphery 124 extending along the toe end 108 between the front end 102 and the rear end 104 and between the sole 112 and the top rail 110. Referring to FIG. 2B, the club head 100 further defines a top rail periphery 126 extending along the top rail 110 between the front end 102 and the rear end 104 and between the heel end 106 and the toe end 108. Referring to FIG. 2C, the club head 100 further defines a sole periphery 128 extending along the sole 112 between the front end 102 and the rear end 104 and between the heel end 106 and the toe end 108. Referring to FIG. 2D, the club head 100 further defines a heel side periphery 122 extending along the heel end 106 between the front end 102 and the rear end 104 and between the sole 112 and the top rail 110.

I. L-shaped Faceplate

Figure 4:
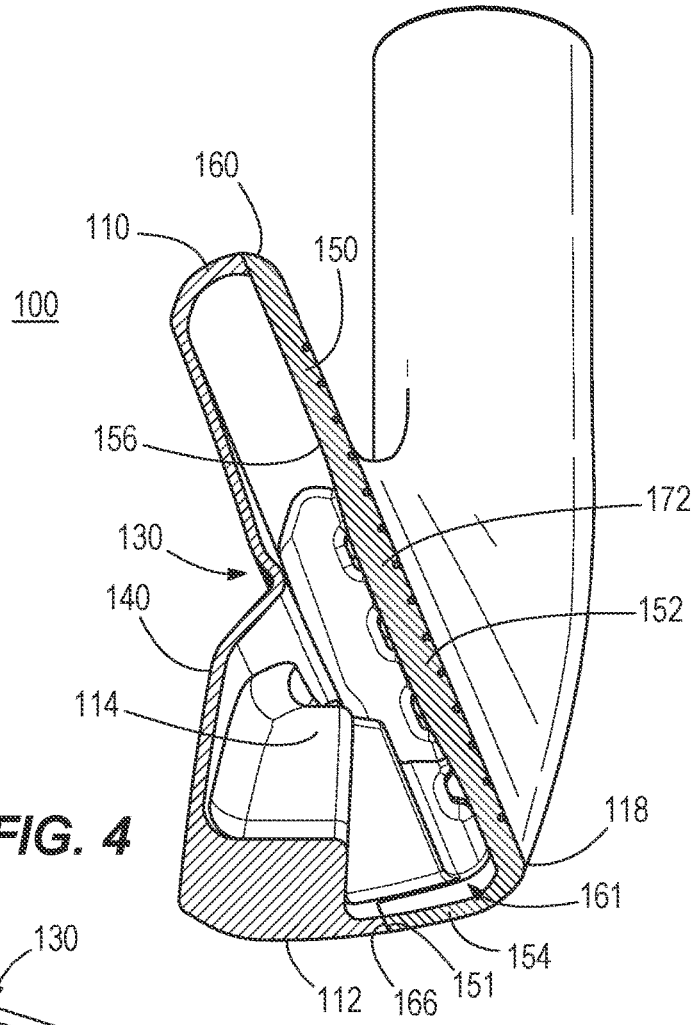
FIG. 4 illustrates a toe-side cross-sectional view of the golf club head of FIG. 1.
Figure 6:
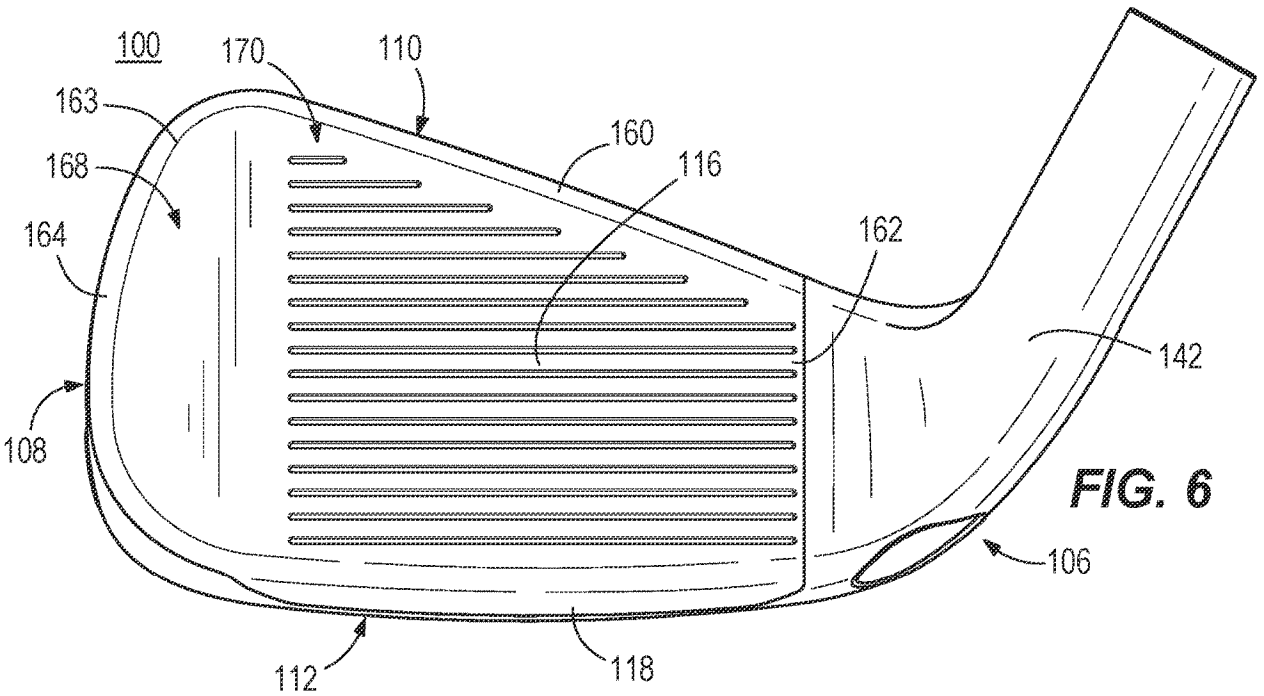
FIG. 6 illustrates a front view of the golf club head of FIG. 1.

As illustrated in FIG. 1, the club head 100 comprises a faceplate 150 coupled to a rear body 130 at the front end 102 of the club head 100. Referring to FIG. 4, the faceplate 150 forms an "L-shape" comprising a strike face portion 152 extending along the loft plane 101. In many embodiments, the L-shaped faceplate 150 further comprises a strike face perimeter 163 extending to the club head peripheries 122, 124, 126, 128, and a sole return 154 extending rearward from the strike face portion 152 and forming a portion of the sole 112, as illustrated in FIG. 6. The geometry and arrangement of the faceplate 150 allows the faceplate 150 and portions of the rear body 130 to be thinned without sacrificing structural integrity, such that the faceplate 150 provides a club head 100 with increased faceplate flexure and ball speed.

Figure 3:
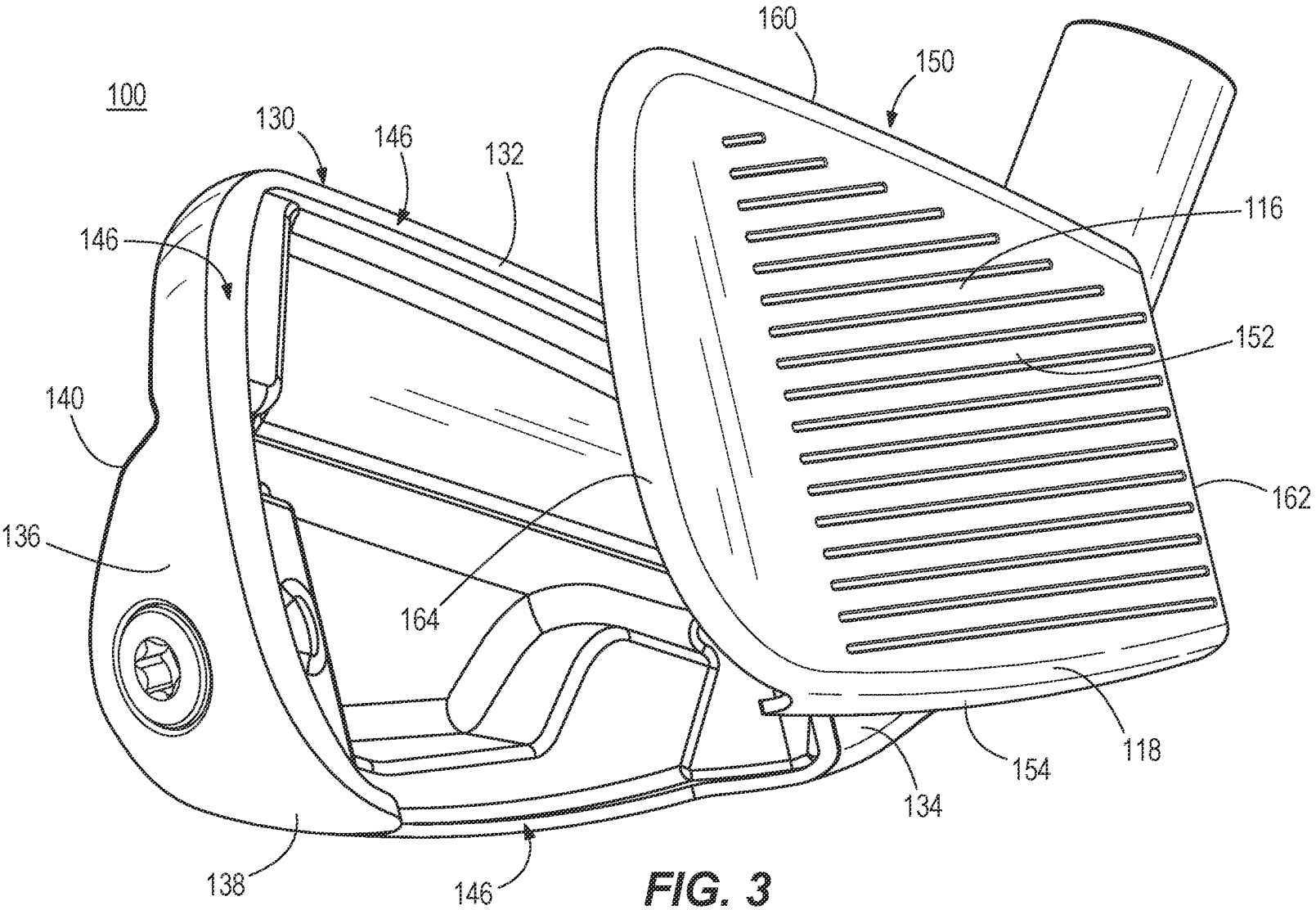
FIG. 3 illustrates an exploded view of the faceplate and rear body of the golf club head of FIG. 1.
Figure 5:
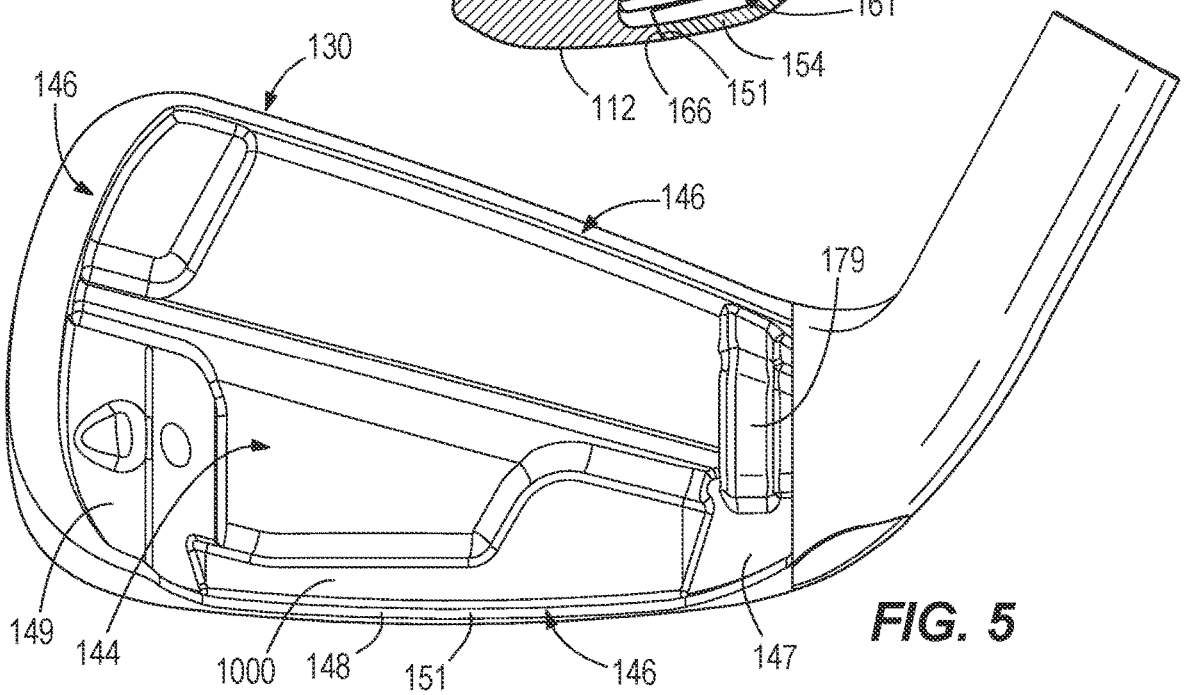
FIG. 5 illustrates a front view of the golf club of FIG. 1 with the faceplate removed.

As illustrated in FIG. 3, the club head 100 comprises a hollow body construction formed by an L-shaped faceplate 150 coupled to a rear body 130, enclosing a hollow interior cavity 114. The rear body 130 comprises a top rail portion 132, a sole portion 138, a heel portion 134, a toe portion 136, a hosel structure 142, and a rear wall 140. The rear wall 140 extends upward from the sole portion 138 to the top rail portion 132 and encloses the rear end 104 of the club head 100. The rear body 130 further defines a rear body opening 144 proximate the front end 102 of the club head 100. The rear body opening 144 is defined between the top rail portion 132, the heel portion 134, the toe portion 136, and the sole portion 138 of the rear body 130. Referring to FIG. 5, a plurality of welding surfaces 146 extend around a perimeter of the rear body opening 144. The welding surfaces 146 are formed by forwardmost edges of the rear body top rail portion 132, heel portion 134, toe portion 136, and sole portion 138. The welding surfaces 146 provide an interface for the faceplate 150 and the rear body 130 to be coupled together. In many embodiments the welding surfaces 146 can be a substantially flat surface configured to receive the faceplate 150 thereon.

Figure 10:
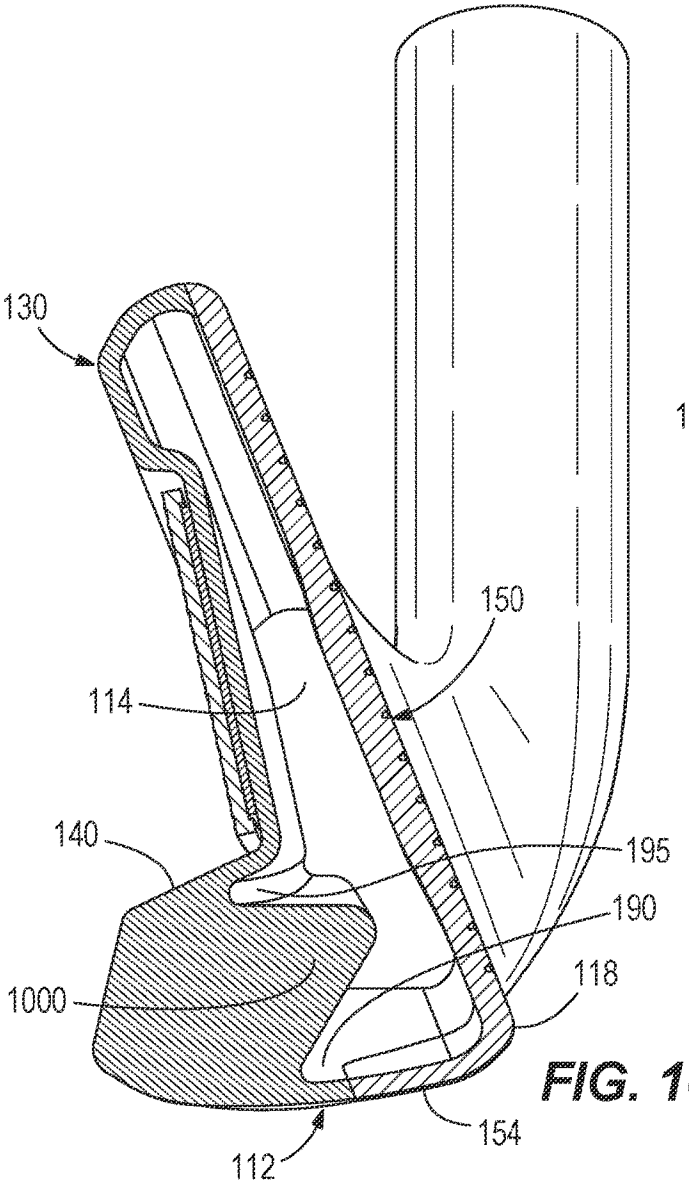
FIG. 10 illustrates a toe-side cross sectional view of a golf club head with an L-shaped faceplate and an angled weight pad.

The rear body 130 further comprises a plurality of weighting features designed to lower the center of gravity (CG) of the club head 100. Referring to FIG. 10, the rear body 130 can comprise a weight pad 1000 located in a low and rearward position of the interior cavity 114. The weight pad 1000 is integrally formed with both the rear body sole portion 138 and the rear wall 140. The weight pad 1000 can have a low profile and can concentrate a large amount of mass low in the club head 100. The weight pad 1000 extends a majority of the distance between the heel portion 134 and the toe portion 136 of the rear body 130.

Referring to FIG. 5, the rear body 130 can further comprise a heel mass 147 and a toe mass 149 located within the lower heel and lower toe areas of the interior cavity 114, respectively. The heel mass 147 and the toe mass 149 serve to increase the perimeter weight of the club head 100, thereby increasing the club head moment of inertia in the heel-to-toe direction. The heel mass 147 can be integrally formed with the rear body sole portion 138, the heel portion 134, and the rear wall 140. The toe mass 149 can be integrally formed with the rear body sole portion 138, the toe portion 136, and the rear wall 140. In many embodiments, the heel and toe mass 149 can each be integral with the weight pad 1000, as illustrated in FIG. 5. The placement of the heel mass 147 and the toe mass 149 in the low, rearward heel and toe portions of the interior cavity 114 provides a lower CG position and increased heel-to-toe moment of inertia, in comparison to a club head devoid of a heel mass and/or toe mass. The placement of the heel mass 147 and the toe mass 149 improves these club head characteristics without interfering with the flexure of the L-shaped faceplate 150

Referring again to FIG. 5, the rear body 130 further defines a sole ledge 148 on the sole portion 138. The sole ledge 148 can be combined with any faceplate geometry described above or below including the sole return 154, a top rail extension 170, a toe extension 168, or any combination thereof. The sole ledge 148 is formed integrally with the rear body 130 and is located immediately forward of the weight pad 1000. The sole ledge 148 protrudes forward from the weight pad 1000 and extends from near the heel end 106 to near the toe end 108, along the extent of the weight pad 1000. The sole ledge 148 comprises a sole ledge front surface 151, which is the forwardmost surface of the sole ledge 148. The sole ledge front surface 151 forms the welding surfaces 146 along the sole 112 and provides a surface to easily attach the sole return 154 to the rear body sole portion 138. Specifically, the sole ledge front surface 151 contacts a sole perimeter edge 166 of the faceplate 150, as discussed in further detail below. In many embodiments, the sole perimeter edge 166 is the only portion of the sole return 154 that contacts the rear body 130. The sole ledge 148 forms a section of the sole 112 and separates the sole return 154 from the weight pad 1000.

Figure 11:
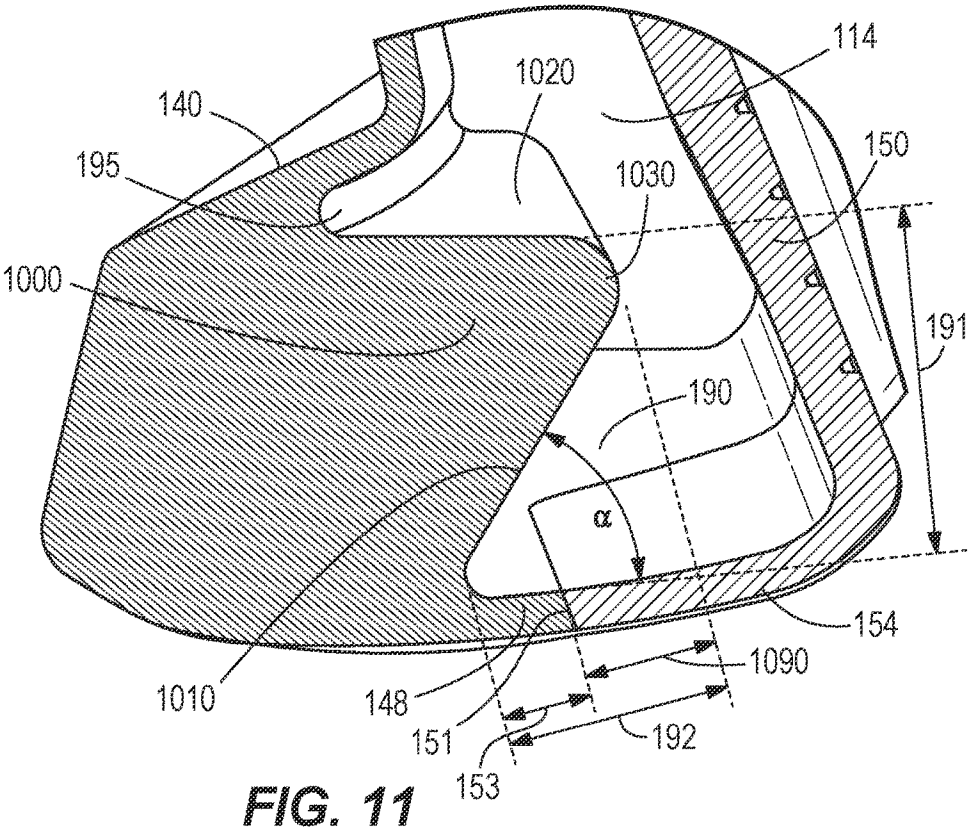
FIG. 11 illustrates a zoomed-in view of FIG. 10, focusing on the sole return and the angled weight pad.

The sole ledge 148 forms a relatively small section of the sole 112. Referring to FIG. 11, the sole ledge 148 defines a sole ledge depth 153 measured from the weight pad front wall 1010 to the faceplate sole perimeter edge 166. In some embodiments, the sole ledge depth 153 varies in a heel to toe direction. In other embodiments, the sole ledge depth 153 is constant in a heel to toe direction. The sole ledge depth 153 can be between 0.01 inch to 0.20 inch. In some embodiments, the sole ledge depth 153 is between 0.01 inch to 0.05 inch, 0.03 inch to 0.07 inch, 0.05 inch to 0.10 inch, 0.07 inch to 0.10 inch, 0.09 inch to 0.12 inch, 0.10 inch to 0.15 inch, 0.13 inch to 0.17 inch, 0.15 inch to 0.20 inch, or 0.17 inch to 0.20 inch. In some embodiments, the sole ledge depth 153 is approximately 0.01 inch, 0.02 inch, 0.03 inch, 0.04 inch, 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, or 0.20 inch. In one exemplary embodiment, the sole ledge depth 153 is 0.09 inch. The sole ledge depth 153 is large enough to move the faceplate 150 away from the weight pad 1000, while maximizing the sole return depth 158. The sole ledge depth 153 is selected to maximize the flexure of the faceplate 150. As discussed above, maximizing the flexure of the faceplate 150 transfers more energy to the golf ball, producing faster ball speeds. Therefore, the sole ledge depth 153 is selected to maximize the flexure of the faceplate 150.

As discussed in further detail below, to maximize flexure, the sole return depth 158 is maximized. Therefore, the sole ledge depth 153 is selected to maximize the sole return depth 158 while providing sufficient distance between the sole return 154 and the weight pad 1000. In this way, the weight pad 1000 does not contact the sole return 154. If the club head 100 were devoid of a sole ledge 148, the weight pad 1000 would contact the sole return 154, and the sole return depth 158 would effectively be shortened, reducing the flexure of the faceplate 150. To further maximize the flexure of the faceplate 150, the sole ledge 148 comprises a thickness that is identical or substantially similar to the thickness of the sole return 154, as discussed in greater detail below.

The club head 100 comprising the sole ledge 148 further provides manufacturing advantages over a club head devoid of a sole ledge. The sole ledge 148 requires only a single surface (the sole perimeter edge 166) of the sole return 154 to contact the rear body 130. Some golf club heads devoid of a sole ledge require that multiple surfaces of the sole return contact the rear body. For example, some golf club heads require that the sole perimeter edge and a portion of the interior surface both contact the rear body. Each surface of the sole return 154 that contacts the rear body 130 must be prepared, and preparing additional surfaces increases the cost of manufacturing. Therefore, the sole ledge 148 reduces manufacturing costs by requiring only a single surface of the sole return 154 to be prepared.

Further, the sole ledge 148 provides a simple receiving geometry for the sole return 154. More specifically, the sole return 154 requires only a single surface of the sole return 154 to be aligned with a single surface of the rear body 130. Some golf club heads devoid of a sole ledge provide a more complicated receiving geometry where multiple surfaces of the sole return must align with multiple surfaces of the rear body. Each additional surface lowers the margin of error allowed when aligning the sole return 154 with the rear body 130. The lower margin of error requires that the sole ledge 148 is formed within tighter tolerances, which can increase cost and the difficulty in manufacturing the faceplate 150. Therefore, the club head 100 comprising the sole ledge 148 is easier and cheaper to manufacture than a golf club devoid of a sole ledge. The sole ledge 148 provides further advantages to the club head 100.

The sole ledge 148 defines a buffer region between the sole return 154 and the weight pad 1000. As discussed above, the sole return 154 only contacts the rear body 130 at the sole ledge front surface 151. In some golf club heads devoid of a sole ledge, the rear body overlaps the sole return such that multiple surfaces of the sole return contact the rear body. For example, in some golf club heads devoid of a sole ledge, the sole return extends into a weight pad such that the weight pad overlapped the rearmost portion of the sole return. Each additional surface that contacts or covers the sole return 154 can inhibit bending as the effective depth of the sole return 154 is decreased. In such embodiments, less energy is stored in the collision and released back into the golf ball, leading to decreased ball speed in comparison to a club head comprising a sole ledge 148.

In the embodiments described herein, the sole ledge 148 projects from the weight pad front wall 1010 such that the sole ledge 148 blocks the sole return 154 from contacting the weight pad 1000. The sole ledge front surface 151 is the only portion of the rear body 130 that contacts the faceplate sole perimeter edge 166. The sole return interior surface 161 does not contact any portion of the weight pad 1000, and even more specifically, the sole return interior surface 161 does not contact the weight pad front wall 1010. Instead, a smooth transition is defined from the sole ledge 148 to the sole return 154.

Referring to FIG. 1, the club head 100 comprises an L-shaped faceplate 150 configured for maximum flexure that increases ball speed. The L-shaped faceplate 150 is coupled to the rear body 130 at the welding surfaces 146, covering the rear body opening 144 and enclosing the hollow interior cavity 114. The faceplate 150 can be formed from a different material than the material of the rear body 130. The faceplate 150 can comprise a material with a greater strength than the rear body material.

In many embodiments, the rear body material is a material that can easily be cast into the complex geometries necessary for forming the rear body 130. In many embodiments, the rear body material is a stainless steel, such as 17-4 stainless steel. In other embodiments, the rear body material can be a steel or stainless steel alloy such as 15-5 stainless steel, 431 stainless steel, 4140 steel, 4340 steel, or any other material suitable of being cast into the complex geometries of the rear body 130.

In many embodiments, the yield strength of the rear body material can range between approximately 60 ksi and approximately 140 ksi. In some embodiments, the yield strength of the rear body material can be between 60 ksi and 70 ksi, 70 ksi and 80 ksi, 80 ksi and 90 ksi, 90 ksi and 100 ksi, 100 ksi and 110 ksi, 110 ksi and 120 ksi, 120 ksi and 130 ksi, or 130 ksi and 140 ksi. In some embodiments, the yield strength of the rear body material can be greater than 60 ksi, greater than 70 ksi, greater than 80 ksi, greater than 90 ksi, greater than 100 ksi, greater than 110 ksi, greater than 120 ksi, or greater than 130 ksi.

The faceplate material can be a higher strength material than the rear body material. In many embodiments, the faceplate material can be a maraging steel such as C300. In other embodiments, the faceplate material can be a high-strength steel or steel alloy, C250, C350, AerMet® 100, AerMet® 310, AerMet® 340, HSR300, K300 or any other high-strength material suitable of being formed into an L-shaped faceplate.

In many embodiments, the yield strength of the faceplate material can range between approximately 220 ksi and approximately 300 ksi. In some embodiments, the yield strength of the faceplate material can be between 220 ksi and 230 ksi, 230 ksi and 240 ksi, 240 ksi and 250 ksi, 250 ksi and 260 ksi, 260 ksi and 270 ksi, 270 ksi and 280 ksi, 280 ksi and 290 ksi, or 290 ksi and 300 ksi. In some embodiments, the yield strength of the rear body material can be greater than 220 ksi, greater than 230 ksi, greater than 240 ksi, greater than 250 ksi, greater than 260 ksi, greater than 270 ksi, greater than 280 ksi, or greater than 290 ksi.

In many embodiments, elastic modulus of the faceplate material can be substantially the same as the elastic modulus of the rear body material. This means that while the faceplate material is stronger than the rear body material, the faceplate material and the rear body material comprise similar flexibility. Increased flexure in the club head 100 can be achieved by replacing the low-strength rear body material with the higher strength faceplate material having a similar elastic modulus. This allows the portions of the rear body 130 replaced by the faceplate material to be thinned without sacrificing the flexibility of the material or the structural integrity in said portions.

In many embodiments, the elastic modulus of the faceplate material can range between 170 GPa to 220 GPa. In some embodiments, the elastic modulus of the faceplate material can be between 170 GPa and 180 GPa, between 180 GPa and 190 GPa, between 180 GPa and 190 GPa, between 190 GPa and 200 GPa, between 200 GPa and 210 GPa, or between GPa 210 and 220 GPa. In many embodiments, the elastic modulus of the faceplate material can be greater than 170 GPa, greater than 175 GPa, greater than 180 GPa, greater than 185 GPa, greater than 190 GPa, greater than 195 GPa, greater than 200 GPa, greater than 205 GPa, greater than 210 GPa, greater than 215 GPa, or greater than 220 GPa, The combination of a high yield strength and a high modulus of elasticity provides the faceplate material with the ability to thin portions of the club head 100 and increase flexibility without sacrificing structural integrity.

As mentioned above, the L-shaped faceplate 150 comprises a strike face portion 152 extending along the loft plane 101 from the sole 112 to the top rail 110 and a sole return 154 forming a portion of the sole 112. The L-shaped faceplate 150 forming a sole return 154 can be combined with any rear body 130 geometry or feature described either above or below, including a sole ledge 156, an angled weight pad 1000, a weight pad 2000 comprising an extension 2050, a heel mass 147 and/or toes mass 149, a lower interior undercut 190, an upper interior undercut 195, a rear exterior cavity 198, an external flexure hinge 3000, an internal bending notch 3100, an internal welding rib 179, or any combination thereof.

The sole return 154 extends rearward from the leading edge 118. As illustrated in FIG. 4, the faceplate 150 forms an "L" shape when viewed from a side cross-section, wherein the L-shaped faceplate 150 wraps over the leading edge 118 to the sole 112. The leading edge 118 forms an "elbow" of the L shape. The leading edge 118 serves as a junction or transition between the strike face portion 152 and the sole return 154 of the L-shaped faceplate 150.

The sole return 154 allows the L-shaped faceplate 150 to flex greater than a similar faceplate devoid of a sole return 154. The inclusion of the sole return 154 replaces portions of the sole 112 that would otherwise be formed by the rear body 130 with faceplate material. In many embodiments, the faceplate 150 material comprises a higher yield strength than the rear body material, while retaining a similar elastic modulus as the rear body material. Portions of the rear body sole portion 138 that are replaced by the sole return 154 can be thinned without sacrificing structural integrity. This allows for more flexure than if the sole 112 were constructed entirely from the rear body material. The additional flexure associated with the inclusion of the sole return maximizes energy transfer between the strike face 116 and the golf ball at impact, resulting in a club head 100 with increased ball speed.

The inclusion of the sole return 154 further allows for increased flexure in the club head 100 by allowing the sole 112 and the faceplate 150 to be thinned without sacrificing structural integrity. In some golf clubs, structural failure commonly occurs along high stress areas located at the leading edge or portions of the sole proximate the strike face. In some golf clubs, the sole is constructed of a relatively low-strength cast material, so the thickness of portions of the sole and/or the strike face must be increased to provide the necessary structural integrity in the high stress areas. The sole return 154 replaces lower-strength rear body material with higher-strength faceplate material at high stress areas. Placing high strength faceplate material in peak stress regions (such as on the sole proximate the leading edge 118) allows the strike face 116 and the sole 112 each to be thinned without sacrificing durability. The additional thinning of the strike face 116 and the sole 112 produces additional flexure of the club head 100 at impact, leading to increased ball speeds over a similar club head comprising a sole with a faceplate devoid of the sole return.

In many embodiments, the inclusion of the sole return 154 allows the strike face 116 to be thinned, increasing the amount the strike face 116 can flex. In many embodiments, the strike face 116 comprises a face thickness that varies in different areas of the strike face 116. In many embodiments, the strike face 116 comprises a thickened region 172 near the center of the strike face 116, as illustrated in FIG. 4. The thickened region 172 comprises a maximum thickness of the strike face 116. Areas of the strike face 116 located away from the thickened region 172 and closer to the perimeter of the strike face 116 can comprise a minimum thickness of the strike face 116. In many embodiments, the maximum thickness of the strike face 116 can range from approximately 0.085 inch to approximately 0.100 inch. In some embodiments, the maximum thickness of the strike face 116 can be between 0.085 inch and 0.0875 inch, between 0.085 inch and 0.090 inch, between 0.085 inch and 0.0925 inch, or between 0.085 inch and 0.095 inch. In many embodiments, the minimum thickness of the strike face 116 can range from approximately 0.060 inch to approximately 0.075 inch. In some embodiments, the minimum thickness of the strike face 116 can be between 0.060 inch and 0.0625 inch, between 0.060 inch and 0.065 inch, between 0.060 inch and 0.0675 inch, between 0.060 inch and 0.070 inch, or between 0.060 inch and 0.0725 inch. The thickness of the different portions of the strike face 116 can be selected to maximize the flexure of the faceplate 150.

The inclusion of the sole return 154 allows the strike face 116 to be uniformly thinned without sacrificing durability. The inclusion of the sole return 154 can allow the strike face 116 to be thinned (with respect to a similar club head devoid of a sole return by greater than 0.001 inch, greater than 0.0025 inch, greater than 0.005 inch, greater than 0.0075 inch, greater than 0.010 inch, greater than 0.0125 inch, greater than 0.0150 inch, greater than 0.0175 inch, or greater than 0.020 inch. As discussed above, thinning the strike face 116 can increase the flexure of the faceplate 150.

Similarly, in many embodiments, the inclusion of the sole return 154 allows portions of the sole 112 near the leading edge 118 to be thinned, increasing the amount the faceplate 150 and sole 112 can flex. In many embodiments, the thickness of the sole return 154 can range from approximately 0.035 inch to approximately 0.060 inch. In some embodiments, the thickness of the sole return 154 can be between 0.035 inch and 0.045 inch, between 0.040 inch and 0.050 inch, between 0.045 inch and 0.055 inch, or between 0.050 inch and 0.060 inch. In some embodiments, the thickness of the sole return 154 can be between 0.035 inch and 0.040 inch, between 0.035 inch and 0.045 inch, between 0.035 inch and 0.050 inch, between 0.035 inch and 0.055 inch, or between 0.035 inch and 0.060 inch. The thickness of the sole return 154 is selected to maximize the flexure of the faceplate 150, while providing structural integrity to the leading edge 118.

The inclusion of the sole return 154 allows the portion of the sole 112 proximate the leading edge 118 (i.e., where the sole return is located) to be thinner than that of a similar club head devoid of a sole return by greater than approximately 0.001 inch, greater than 0.0025 inch, greater than 0.005 inch, greater than 0.0075 inch, greater than 0.010 inch, greater than 0.0125 inch, greater than 0.0150 inch, greater than 0.0175 inch, or greater than 0.020 inch. The thin construction of the leading edge 118 promotes bending to increase the flexure of the faceplate 150.

The inclusion of the sole return 154 further allows the sole ledge 148, which is rearward of the sole return 154 and forward of the weight pad 1000 to be thinned without sacrificing structural integrity. In many embodiments, the sole ledge 148 comprises a thickness that is identical or substantially similar to the thickness of the sole return 154, as illustrated in FIG. 11. The sole ledge thickness is similar to the sole return thickness to increase the flexibility of the sole return 154. By providing a substantially thin sole ledge 148, the sole return 154 and the sole ledge 148 combine to form a continuous, thin sole portion of a substantially constant thickness. Although the sole ledge 148 is formed of the lower-strength rear body material, the sole ledge 148 can be equally as thin as the higher-strength sole return 154, because the sole ledge 148 is located further rearward of the peak stresses occurring at the leading edge 118. Further, the similarity in the elastic moduli of the rear body material forming the sole ledge 148 and the faceplate material forming the sole return 154 allows the thin sole portion to bend without breaking.

In many embodiments, similar to the thickness of the sole return 154, the thickness of the sole ledge 148 can range from approximately 0.035 inch to approximately 0.060 inch. In some embodiments, the thickness of the sole ledge 148 can be between 0.035 inch and 0.045 inch, between 0.040 inch and 0.050 inch, between 0.045 inch and 0.055 inch, or between 0.050 inch and 0.060 inch. In some embodiments, the thickness of the sole ledge 148 can be between 0.035 inch and 0.040 inch, between 0.035 inch and 0.045 inch, between 0.035 inch and 0.050 inch, between 0.035 inch and 0.055 inch, or between 0.035 inch and 0.060 inch. The similar thickness of the sole ledge 148 and the sole return 154 creates a smooth transition from the rear body 130 to the faceplate 150.

A. L-Shaped Faceplate with Top Rail Extension and Toe Extension

In many embodiments, as illustrated by FIG. 6, the L-shaped faceplate 150 extends beyond the strike face perimeter 163. The faceplate 150 can comprise a toe extension 168 and a top rail extension 170, wherein the edges of the faceplate 150 extend all the way to the club head peripheries 122, 124, 126, 128. The L-shaped faceplate 150 comprising a toe extension 168 and a top rail extension 170 can be combined with any rear body 130 geometry or feature described either above or below, including a sole ledge 156, an angled weight pad 1000, a weight pad 2000 comprising an extension 2050, a heel mass 147 and/or toes mass 149, a lower interior undercut 190, an upper interior undercut 195, a rear exterior cavity 198, an external flexure hinge 3000, an internal bending notch 3100, an internal welding rib 179, or any combination thereof.

The L-shaped faceplate 150 comprising a toe extension 168 and a top rail extension 170 forms at least a portion of the top rail 110 and a portion of the toe end 108. The geometry of the L-shaped faceplate 150 can be defined by a plurality of edges forming a faceplate perimeter. The L-shaped faceplate 150 can comprise a top perimeter edge 160, a heel side perimeter edge 162, a toe side perimeter edge 164, and a sole perimeter edge 166, as illustrated in FIGS. 3 and 4.

Referring to FIGS. 2A, 2B, and 4, via the top rail extension 170, the faceplate 150 extends to the top rail periphery 126, and the top perimeter edge 160 is located on the top rail 110. Similarly, via the toe extension 168, the faceplate 150 extends to the toe side periphery 124, and the toe side perimeter edge 164 is located on the toe end 108. Via the sole return 154, the faceplate 150 extends all the way to the sole periphery 128, and the sole perimeter edge 166 is located on the sole 112. The faceplate 150 forms at least a portion of the top rail 110, at least a portion of the toe end 108, and at least a portion of the sole 112. As such, the top perimeter edge 160, the toe side perimeter edge 164, and the sole perimeter edge 166 are all located on the club head peripheries 122, 124, 128 and are located away the strike face 116. The heel side perimeter edge 162 is located on the front end 102 of the club head 100 and serves as a boundary of the strike face 116 on the heel end 106. The heel side perimeter edge 162 separates the hosel structure 142 from the strike face 116.

The perimeter edges of the faceplate 150 provide an interface between the faceplate 150 and the rear body 130. Referring to FIG. 4, the perimeter edges of the faceplate 150 are welded to the welding surfaces 146 of the rear body 130, coupling the faceplate 150 to the rear body 130. A plurality of weld lines are defined between the faceplate 150 and the rear body 130 at the interface between the faceplate perimeter edges and the rear body welding surfaces 146. In many embodiments, the faceplate 150 and the rear body 130 are welded together via a laser welding process.

In many embodiments, the perimeter edges of the faceplate 150, specifically the top perimeter edge 160, the toe side perimeter edge 164, the top rail extension 170 and the toe extension 168, and the sole perimeter edge 166, can each comprise a bevel or chamfer, as illustrated in FIG. 4. The bevels and/or chamfers of the toe extension 168 and top rail extension 170 provides a smooth transition from the strike face 116 to the toe side periphery 124, and the top rail periphery 126, respectively. For example, the toe extension 168 forms a bevel at the transition between the strike face 116 and the toe end 108, while the top rail extension 170 forms a bevel at the transition between the strike face 116 and the top rail 110.

The geometry of the faceplate 150 and the placement of the faceplate perimeter edges on the club head periphery creates increased flexure in the faceplate 150 by moving the weld line off the strike face 116. Many prior art hollow body irons comprise a non L-shaped face insert attached to the front surface of the club head to form the hollow interior cavity. In such prior art club heads, the insert is situated internally with respect to the club head peripheries, and every weld line between the face insert and the body is located on the strike face. The weld lines of the prior art clubs contribute to the thickness of the strike face and reduce the flexibility of the faceplate. The additional thickness created by the weld lines reduces the ability of the faceplate to flex. In contrast, the L-shaped faceplate 150 comprising a sole return 154, a toe extension 168, and a top rail extension 170 does not form any weld lines on the strike face 116. Instead, the weld lines are located on the club head peripheries 122, 124, 128. This configuration increases the ability of the faceplate 150 to flex.

Referring to FIG. 4, in many embodiments, the L-shaped faceplate 150 does not form a return portion on the top rail 110 or the toe end 108. The strike face comprises a strike face back surface 156 that is substantially flat proximate the top rail 110 and along the heel end 106. No portion of the faceplate 150 near the toe end 108 or the top rail 110 extends rearward from the strike face back surface 156 or forms a return. In this way, the faceplate 150 is L-shaped with a straight strike face portion 152 and a sole return 154 near the sole 112, as opposed to a cup-shaped faceplate comprising return portions on the top and/or toe end of the strike face portion. The various embodiments of the L-shaped faceplate 150 described herein are designed to increase the flexure of the faceplate 150.

The faceplate 150 comprises a faceplate surface area measured across the faceplate 150 and bounded by the top perimeter edge 160, the toe side perimeter edge 164, the heel side perimeter edge 162, and the leading edge 118. The faceplate surface area correlates to the spring-like effect of the faceplate 150. As the faceplate surface area increases, the spring-like effect of the faceplate 150 increases, which increases the flexure of the faceplate 150. The increased flexing allows the faceplate 150 to transfer more energy to the golf ball, which produces faster ball speeds.

In some embodiments, the faceplate surface area is between approximately 3.50 $in^2$ to approximately 5.00 $in^2$. In some embodiments, the faceplate surface area is between 3.50 $in^2$ to 3.75 $in^2$, 3.65 $in^2$ to 3.90 $in^2$, 3.80 $in^2$ to 4.20 $in^2$, 4.00 $in^2$ to 4.25 $in^2$, 4.25 $in^2$ to 4.50 $in^2$, 4.50 $in^2$ to 4.75 $in^2$, or 4.70 $in^2$ to 5.00 $in^2$. In some embodiments, the faceplate surface area is approximately 3.50 $in^2$, 3.55 $in^2$, 3.60 $in^2$, 3.65 $in^2$, 3.70 $in^2$, 3.75 $in^2$, 3.80 $in^2$, 3.85 $in^2$, 3.90 $in^2$, 3.95 $in^2$, 4.00 $in^2$, 4.05 $in^2$, 4.10 $in^2$, 4.15 $in^2$, 4.20 $in^2$, 4.25 $in^2$, 4.30 $in^2$, 4.35 $in^2$, 4.30 $in^2$, 4.35 $in^2$, 4.40 $in^2$, 4.45 $in^2$, 4.50 $in^2$, 4.55 $in^2$, 4.60 $in^2$, 4.65 $in^2$, 4.70 $in^2$, 4.75 $in^2$, 4.80 $in^2$, 4.85 $in^2$, 4.90 $in^2$, 4.95 $in^2$, or 5.00 $in^2$. The faceplate surface area is selected to promote the flexure of the faceplate 150.

In some embodiments, the faceplate 150 comprising a top rail extension 170 and a toe extension 168 comprises a larger faceplate surface area than a faceplate devoid of these features. In some embodiments, the faceplate surface area is between approximately 5.00 $in^2$ to approximately 6.00 $in^2$. In some embodiments, the faceplate surface area is between 5.00 $in^2$ to 5.30 $in^2$, 5.15 $in^2$ to 5.25 $in^2$, 5.20 $in^2$ to 5.40 $in^2$, 5.35 $in^2$ to 5.60 $in^2$, 5.50 $in^2$ to 5.70 $in^2$, or 5.60 $in^2$ to 6.00 $in^2$. In some embodiments, the faceplate surface area is approximately 5.00 $in^2$, 5.05 $in^2$, 5.10 $in^2$, 5.15 $in^2$, 5.20 $in^2$, 5.25 $in^2$, 5.30 $in^2$, 5.35 $in^2$, 5.30 $in^2$, 5.35 $in^2$, 5.40 $in^2$, 5.45 $in^2$, 5.50 $in^2$, 5.55 $in^2$, 5.60 $in^2$, 5.65 $in^2$, 5.70 $in^2$, 5.75 $in^2$, 5.80 $in^2$, 5.85 $in^2$, 5.90 $in^2$, 5.95 $in^2$, or 6.00 $in^2$. The surface area of the faceplate 150 is selected to promote the flexure of the faceplate 150.

In some embodiments, the surface area of the faceplate 150 comprising a top rail extension 170 and a toe extension 168 is between approximately 1.00 $in^2$ to approximately 3.00 $in^2$ larger than a faceplate devoid of these features. In some embodiments, the surface area of the faceplate 150 is between 1.00 $in^2$ to 1.25 $in^2$, 1.20 $in^2$ to 1.50 $in^2$, 1.40 $in^2$ to 1.75 $in^2$, 1.50 $in^2$ to 2.00 $in^2$, 1.75 $in^2$ to 2.25 $in^2$, 2.20 $in^2$ to 2.50 $in^2$, 2.40 $in^2$ to 2.75 $in^2$, or 2.50 $in^2$ to 3.00 $in^2$ larger than the surface area of the faceplate devoid of a top rail extension and a toe extension. The increased surface area of the faceplate 150 comprising a toe extension 168 and a top rail extension 170 promotes increased flexure in the faceplate 150.

Referring to FIG. 4, the contour of the sole perimeter edge 166 determines the shape of the sole return 154. At the sole return 154, the sole perimeter edge 166 extends rearward along the sole 112 and serves as a boundary between the L-shaped faceplate 150 and the rear body sole portion 138. The sole return 154 can be complementarily shaped to sit flush against the sole ledge 148. The contour of the welding surfaces 146 at the rear body sole portion 138 can correspondingly match the contour of the sole perimeter edge 166 on the sole return 154. The complementary geometry of the sole return 154 and the rear body sole portion 138 creates a continuous sole surface formed without any gaps or slots in between the rear body 130 and the faceplate 150.

Figure 7:
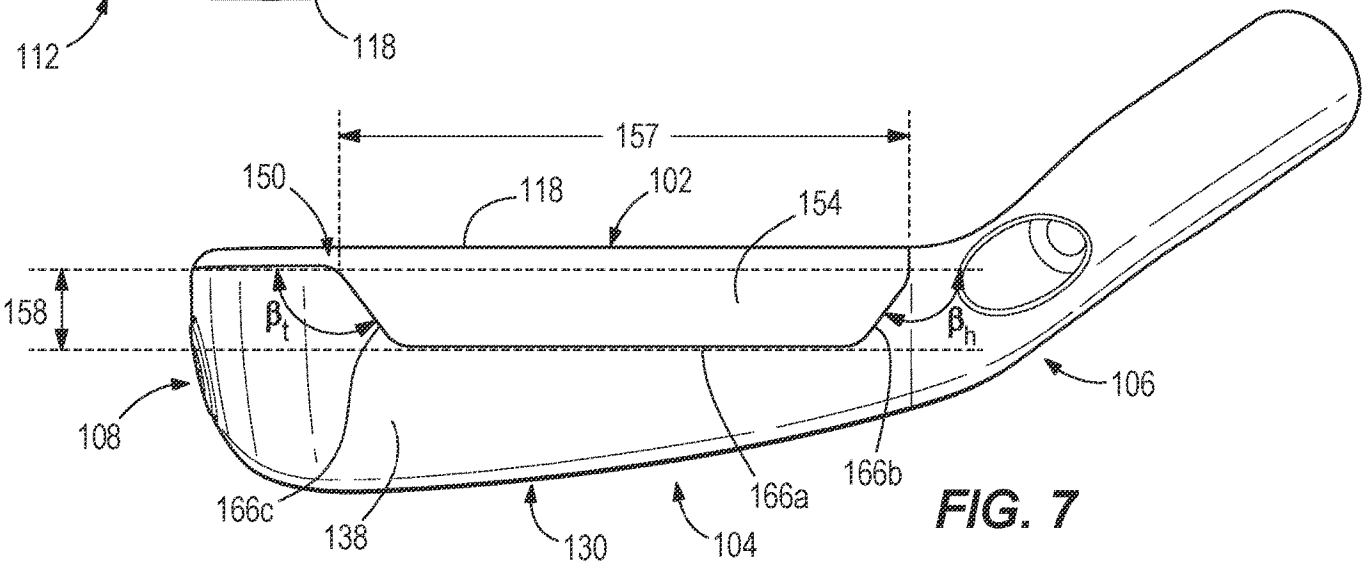
FIG. 7 illustrates a sole view of the golf club head of FIG. 1.

Referring to FIGS. 3 and 4, in many embodiments, the sole perimeter edge 166 can comprise a rear sole perimeter edge 166*a*, a heel-side sole perimeter edge 166*b*, and a toe-side sole perimeter edge 166*c*. In the embodiment of FIG. 7, the heel-side sole perimeter edge 166*b* and the toe-side sole perimeter edge 166*c* can extend rearwardly from the leading edge 118 at an angle, and the rear sole perimeter edge 166*a* can extend between the heel-side sole perimeter edge 166*b* and the toe-side sole perimeter edge 166*c* in a heel-to-toe direction, substantially parallel to the leading edge 118.

In many embodiments, the sole return 154 does not extend rearward from the entire length of the leading edge 118. Referring to FIG. 7, the sole return 154 defines a sole return width 157 measured in a heel-to-toe direction. In many embodiments, the sole return width 157 can be less than the length of the leading edge 118, such that the sole return 154 does not span the entire leading edge 118 or the entire sole 112 in a heel-to-toe direction from the heel-side sole perimeter edge 166*b* to the toe-side sole perimeter edge 166*c*. In some embodiments, the sole return width 157 can be tapered such that the width decreases from proximate the leading edge 118 toward the rear sole perimeter edge 166*a*. In such embodiments, the sole return 154 can comprise a maximum width proximate the leading edge 118 and a minimum width at the rear sole perimeter edge 166*a*. In some embodiments, the sole return 154 may not be tapered and the sole return width 157 can be constant in a front-to-rear direction.

In embodiments wherein the sole return 154 is tapered, the rate at which the sole return width 157 tapers can be characterized by a plurality of taper angles $\beta_t$, $\beta_h$. Referring to FIG. 7, the plurality of taper angles $\beta_t$, $\beta_h$ can be measured as exterior angles between the sole perimeter edge 166 and the leading edge 118. The sole return 154 can comprise a heel-side taper angle $\beta_h$ measured between the heel-side sole perimeter edge 166*b* and the leading edge 118 and a toe-side taper angle $\beta_t$ measured between the toe-side sole perimeter edge 166*c* and the leading edge 118. In many embodiments, the heel-side taper angle $\beta_h$ and the toe-side taper angle $\beta_t$ can be the same or substantially similar. In other embodiments, the heel-side taper angle $\beta_h$ and the toe-side taper angle $\beta_t$ can be different.

In many embodiments, the heel-side taper angle $\beta_h$ can range between approximately 100 degrees and approximately 160 degrees. In many embodiments, the heel-side taper angle $\beta_h$ can be between 100 degrees and 110 degrees, between 110 degrees and 120 degrees, between 120 degrees and 130 degrees, between 130 degrees and 140 degrees, between 140 degrees and 150 degrees, or between 150 degrees and 160 degrees. In many embodiments, the heel-side taper angle $\beta_h$ can be between 110 degrees and 130 degrees, between 115 degrees and 135 degrees, between 120 degrees and 140 degrees, between 125 degrees and 145 degrees, between 130 degrees and 150 degrees, or between 140 degrees to 160 degrees. In some embodiments, the heel-side taper angle $\beta_h$ can be approximately 120 degrees, 121 degrees, 122 degrees, 123 degrees, 124 degrees, 125 degrees, 126 degrees, 127 degrees, 128 degrees, 129 degrees, 130 degrees, 131 degrees, 132 degrees, 133 degrees, 134 degrees, 135 degrees, 136 degrees, 137 degrees, 138 degrees, 139 degrees, or 140 degrees. In many embodiments, the heel-side taper angle $\beta_h$ can be similar to the toe-side taper angle $\beta_t$.

In many embodiments, the toe-side taper angle $\beta_t$ can range between approximately 100 degrees and approximately 160 degrees. In many embodiments, the toe-side taper angle $\beta_t$ can be between 100 degrees and 110 degrees, between 110 degrees and 120 degrees, between 120 degrees and 130 degrees, between 130 degrees and 140 degrees, between 140 degrees and 150 degrees, or between 150 degrees and 160 degrees. In many embodiments, the toe-side taper angle $\beta_t$ can be between 110 degrees and 130 degrees, between 115 degrees and 135 degrees, between 120 degrees and 140 degrees, between 125 degrees and 145 degrees, or between 130 degrees and 150 degrees. In some embodiments, the toe-side taper angle can be approximately 120 degrees, 121 degrees, 122 degrees, 123 degrees, 124 degrees, 125 degrees, 126 degrees, 127 degrees, 128 degrees, 129 degrees, 130 degrees, 131 degrees, 132 degrees, 133 degrees, 134 degrees, 135 degrees, 136 degrees, 137 degrees, 138 degrees, 139 degrees, or 140 degrees.

The tapered shape of the sole return 154 provides space where the heel mass 147 and the toe mass 149 can concentrate mass within the lower heel areas and lower toe areas without contacting the sole return 154. The tapering of the sole return 154 provides space for a greater amount of mass to be allocated in the heel mass 147 and the toe mass 149 without contacting the sole return 154. This configuration allows for maximization of the perimeter weighting of the club head 100 without interfering with the flexure of the faceplate 150.

In many embodiments, the sole return 154 can comprise a maximum sole return width 157 ranging between approximately 1.5 inches and approximately 3.0 inches. In some embodiments, the maximum sole return width 157 can be between 1.5 inches and 2.5 inches, between 1.75 inches and 2.75 inches, or between 2.0 inches and 3.0 inches. In some embodiments, the maximum sole return width 157 can be between 1.5 inches and 2.0 inches, between 1.5 inches and 2.25 inches, between 1.5 inches and 2.5 inches, between 1.5 inches and 2.75 inches, between 2.0 inches and 2.25 inches, between 2.0 inches and 2.5 inches, between 2.0 inches and 2.75 inches, or between 2.0 inches and 3.0 inches.

As discussed above, the sole return 154 further defines a sole return depth 158 measured in a front-to-rear direction from the leading edge 118 to the rear sole perimeter edge 166*c* of the sole return 154. In many embodiments, as shown in FIG. 7, the sole return depth 158 can be substantially constant in a heel-to-toe direction. In other embodiments, the sole return depth 158 can vary from the heel end 106 to the toe end 108. In some embodiments, the sole return 154 can comprise a maximum sole return depth 158 near a center of the sole return 154 (with respect to a heel-to-toe direction) and a minimum sole return depth 158 near the heel end 106 and/or the toe end 108.

In many embodiments, the sole return 154 can comprise a maximum sole return depth 158 ranging between approximately 0.2 inch and approximately 0.4 inch. In some embodiments, the maximum sole return depth 158 can be between 0.2 inch and 0.4 inch or between 0.3 inch and 0.4 inch. In some embodiments, the maximum sole return depth 158 can be between 0.2 inch and 0.25 inch, between 0.25 inch and 0.275 inch, between 0.275 inch and 0.3 inch, between 0.3 inch and 0.325 inch, between 0.325 inch and 0.35 inch, between 0.35 inch and 0.375 inch, or between 0.375 inch and 0.4 inch. In many embodiments, the maximum sole return depth 158 can be greater than 0.2 inches. In some embodiments, the maximum sole return depth 158 can be greater than 0.2 inch, 0.225 inch, 0.25 inch, 0.275 inch, 0.3 inch, 0.325 inch, 0.35 inch, or 0.375 inch.

In many embodiments, the sole return depth 158 can be maximized to the greatest extend of manufacturing capabilities. In many embodiments, the sole return depth 158 must be less than approximately 0.400 inch. In many embodiments, the faceplate 150 is formed by a machining and forming process. In such a process, the sole return length 158 is limited by the forming tool. In many embodiments, the sole return depth 158 is as close to possible to the maximum depth allowed by the forming tool. Maximizing the sole return depth 158 produces the greatest amount of flexure in the club head 100 and provides the greatest increase in ball speed.

The flexure of the sole return 154 can depend on the amount of the sole return 154 that is unhindered by other surfaces. For example, the depth 158 along which the sole return 154 is unhindered can be considered an "effective" sole return depth, as the sole return 154 is free to flex along the unhindered effective sole return depth. In some embodiments, where the golf club head 100 comprises a sole ledge 148, the sole return 154 is unhindered by the weight pad 1000 or any other surface. In these embodiments, the effective sole return depth, and the sole return depth 158 are the same. For example, the club head 100 illustrated in FIG. 6, and the club head 200 illustrated in FIG. 8 each comprise a sole ledge 148, 248 making the effective sole return depth equal to the sole return depth 158. In general, the greater the effective sole return depth, the greater the sole return 154 is able to flex.

The sole perimeter edge 166 of the embodiment of FIG. 7 creates a substantially trapezoidal shape for the sole return 154. In some embodiments, the sole return 154 can be formed in a variety of different shapes. In many embodiments, the sole return 154 can be substantially rectangular. In other embodiments, from a sole view, the sole return 154 can resemble a parallelogram, a polygon, a semicircle, a semi-ellipse, a triangle, or any other suitable shape.

It should be noted that in the configuration of FIGS. 6 and 7, the sole return 154 has a significant impact on increasing energy transfer at impact. The sole return 154 replaces a large amount of rear body material with faceplate material and the weld line on the sole 112 is moved a significant distance from the strike face 116 in comparison to a club head devoid of a sole return. This increased flexure has an especially significant effect on maximizing energy transfer on low mis-hits (i.e., shots that are struck below the center of the face, closer to the sole). While similar prior art hollow body irons devoid of sole returns experience a significant loss in ball speed on low mis-hits, the club head 100 comprising the sole return 154 retains a maximum amount of ball speed on low mis-hits, due to the increased energy transfer on low shots.

As mentioned above, the L-shaped faceplate 150 can be joined to the rear body 130 via welding the faceplate perimeter edges to the welding surfaces 146 of the rear body 130. As illustrated in FIG. 4, the faceplate perimeter edges can be welded flat to the rear body 130 at the welding surfaces 146, without any overlap between the rear body 130 and the faceplate 150 and without any additional mechanical attachment or retention features. A plurality of weld lines can be formed between the L-shaped faceplate 150 and the rear body 130 at the interface between the faceplate perimeter edges and the rear body welding surfaces 146. The plurality of weld lines can be formed at an outermost point of the interface between the welding surfaces 146 and the perimeter edge (i.e., on an external surface of the toe, the top rail, and/or the sole). In many embodiments, the plurality of weld lines are located at the club head peripheries 122, 124, 128 and are located away from the strike face 116, to promote flexure in the strike face 116. In many embodiments, the faceplate 150 and the rear body 130 can be welded together via a laser welding process. In alternative embodiments, the faceplate 150 and the rear body 130 can be welded together via plasma welding, electron beam welding, metal inert gas welding, or other welding processes.

In alternative embodiments (not shown), the faceplate 150 can optionally form any combination of a top rail return, a toe return, and a sole return. In such embodiments, the top rail return and the toe return can each extend rearward from the strike face back surface 156 and form a significant portion of the top rail 110 or toe end 108, respectively. In such embodiments, a greater amount of rear body material, particularly that of the top rail portion 132 and the toe portion 136 of the rear body 130, can be replaced by faceplate material and the weld line along the top rail 110 and the toe end 108 can be moved further from the strike face 116. Providing a top rail return and/or a toe return can further serve to increase flexure in the club head 100 and provide higher ball speeds.

B. L-Shaped Faceplate without Top Rail Extension and Toe Extension

Figure 8:
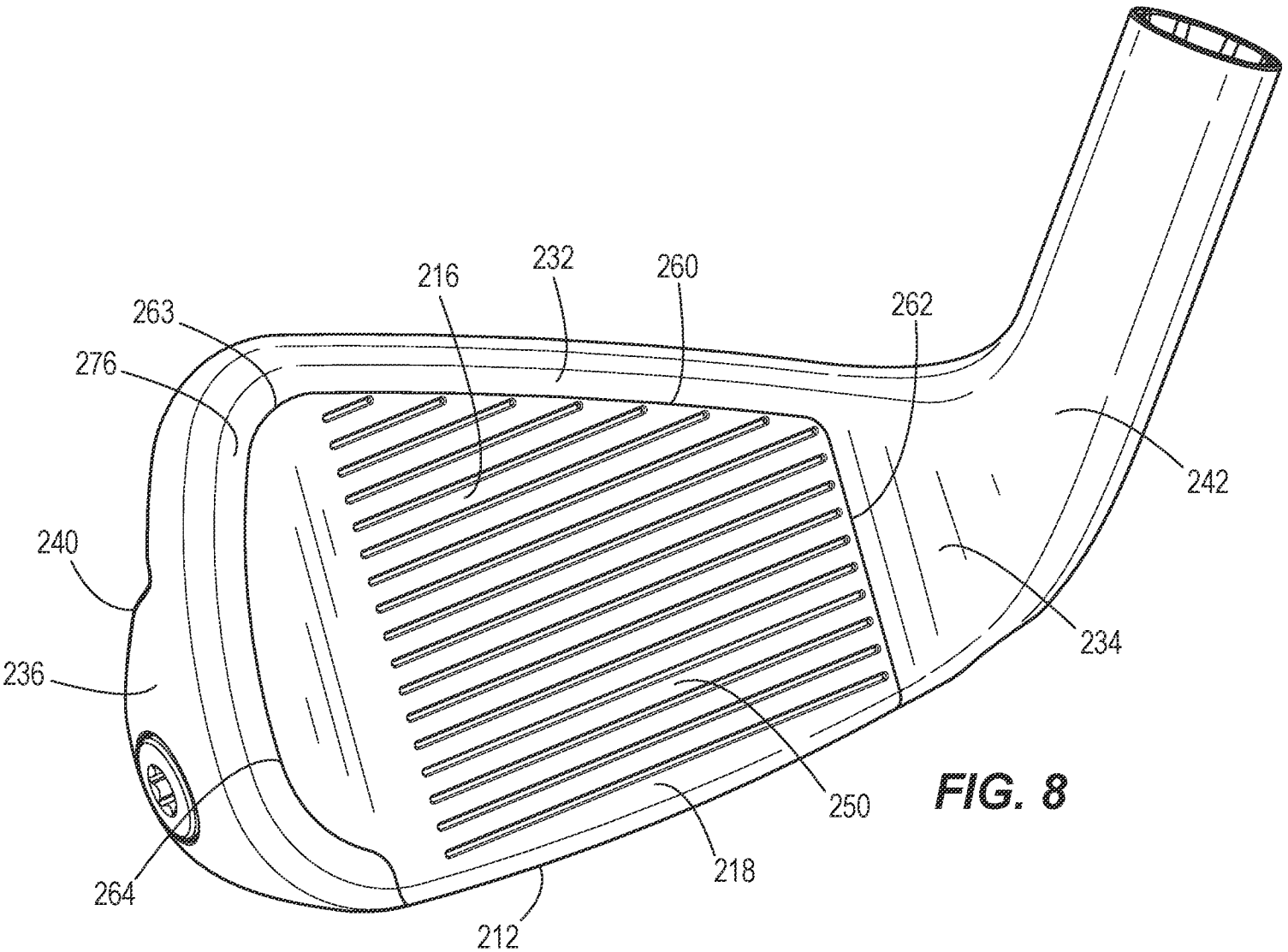
FIG. 8 illustrates a toe-side perspective view of a golf club head comprising an L-shaped faceplate according to a second embodiment.
Figure 9:
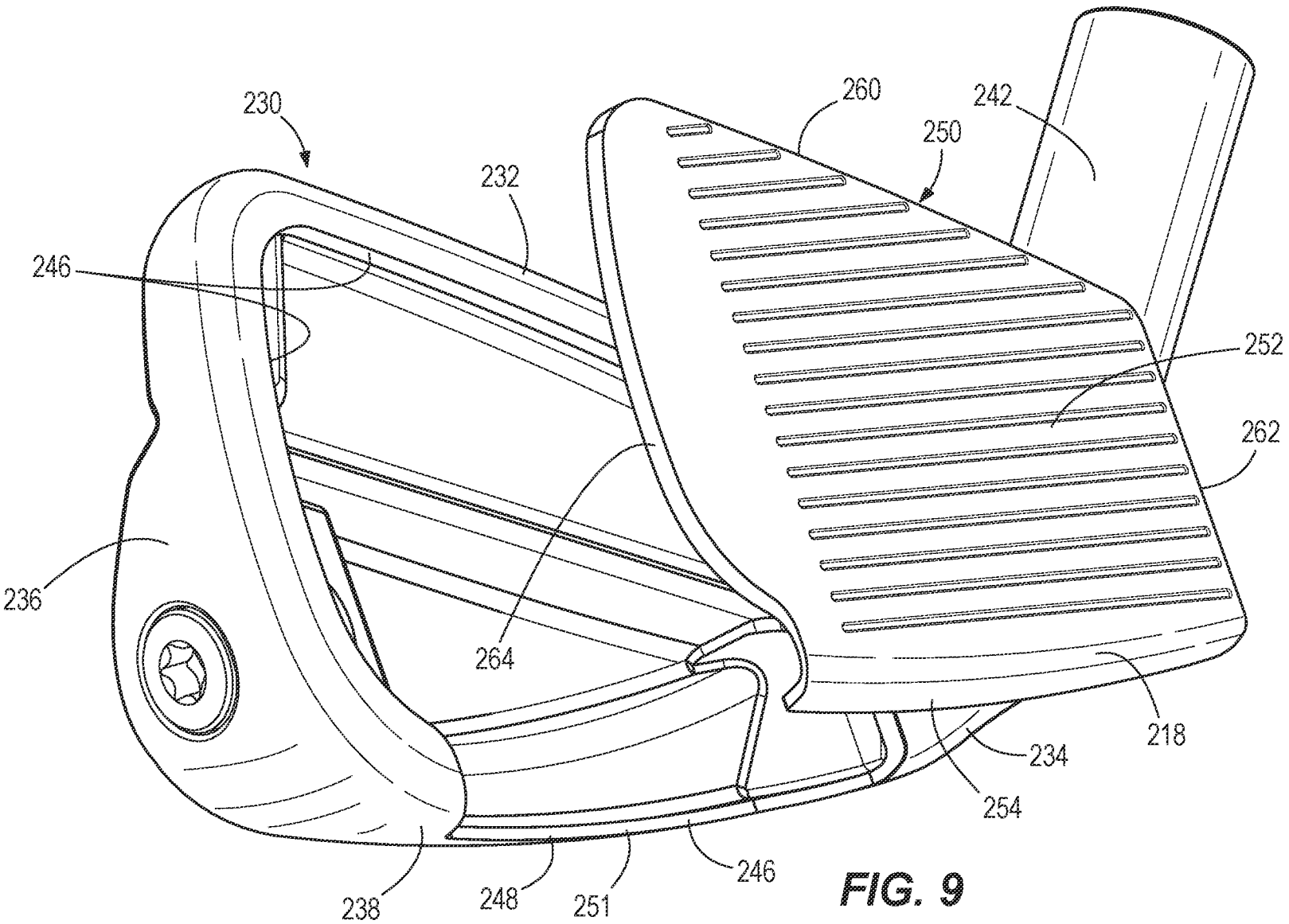
FIG. 9 illustrates an exploded view of the faceplate and rear body of the golf club head of FIG. 8.

In some embodiments, the perimeter of the L-shaped faceplate may be devoid of a toe extension and/or heel extension and may not extend all the way to the club head periphery on the toe end and/or the top rail. FIGS. 8 and 9 illustrate a second embodiment of a hollow-body iron-type club head 200 comprising an L-shaped faceplate 250 without a toe extension or a top rail extension. The second embodiment of the club head 200 is substantially similar to club head 100, but for the difference in faceplate shape. Club head 200 can comprise similar features to club head 100, labeled with a 200 numbering scheme (i.e., club head 200 comprises a rear body 230, a faceplate 250, etc.).

The L-shaped faceplate 250 of club head 200 is devoid of toe extension and a top rail extension and thus comprises perimeter edges 260, 262, 264, 266 that do not extend to the club head peripheries 222, 224, 226. The L-shaped faceplate 250 devoid of a toe extension and a top rail extension can be combined with any rear body 230 geometry or feature described either above or below, including a sole ledge 256, an angled weight pad 1000, a weight pad 2000 comprising an extension 2050, a heel mass 247 and/or toes mass 249, a lower interior undercut 290, an upper interior undercut 295, a rear exterior cavity 298, an external flexure hinge 3000, an internal bending notch 3100, an internal welding rib 279, or any combination thereof.

As shown in FIG. 8, the toe side perimeter edge 264 is located proximate the toe end 208, but on the strike face 216. As such, the faceplate 250 does not form a toe extension. Near the toe end 208, the faceplate 250 is confined to the strike face 216. The faceplate does not form any portion of the toe end 208, and the toe side perimeter edge 264 is not located on the toe side periphery 224. Similarly, the top perimeter edge 260 is located proximate the top rail 210, but on the strike face 216. As such, the faceplate 250 does not form a top rail extension. Near the top rail 210, the faceplate 250 is confined to the strike face 216. The faceplate 250 does not form any portion of the top rail 210, and the top perimeter edge 260 is not located on the top rail periphery 226.

Due to the lack of the top rail extension and the toe extension, the rear body 230 of club head 200 forms the entirety of the club head peripheries 222, 224, 226, apart from the sole periphery 228, which comprises the faceplate sole return 254. Referring to FIG. 9, the rear body 230 forms the entire top rail 210, the entire toe end 208, and the entire heel end 206 (including the hosel structure). The L-shaped faceplate 250 of club head 200 is confined to the strike face 216, with the exception of the sole return 254, which wraps over the leading edge 218 and forms a portion of the sole 212.

Similar to club head 100, the L-shaped faceplate 250 increases the amount of flexure occurring in the club head 200 at impact, resulting in a higher ball speeds. The sole return 254 replaces portions of the sole 212 that would otherwise be formed by the rear body 230 with high-strength faceplate material. The sole return 254 allows the strike face 216 and the sole 212 to be thinned without sacrificing durability by increasing the strength at high stress regions (i.e., the portion of the sole 212 proximate the leading edge 118). The sole return 254 also increases the flexibility of the faceplate 250 by moving the bottom weld line to the sole 212 and off the strike face 216. The L-shaped faceplate 250 increases energy transfer between the strike face 216 and the golf ball at impact by increasing the flexibility of the faceplate 250. The club head comprising an L-shaped faceplate 250 produces higher ball speeds in comparison to a similar club head devoid of a similar faceplate.

II. Overhanging Weight Pad

In many embodiments, the rear body 130 can comprise a weight pad 1000 formed in the interior cavity 114 that overhangs a portion of the sole 112 and/or a portion of the sole return 154, as illustrated in FIGS. 10 and 11. A portion of the weight pad 1000 can overhang the sole 112, without contacting the faceplate 150, in order to provide a club head 100 with a low CG without sacrificing the flexibility of the L-shaped faceplate 150. The weight pad 1000 comprises a mass of rear body 130 material extending upward from the sole 112 into the interior cavity 114 and located proximate the rear wall 140. The weight pad 1000 can be formed integrally with both the rear body sole portion 138 and the rear wall 140. The weight pad 1000 can serve to locate a greater portion of mass towards the sole 112, driving the CG position of the club head 100 lower, while allowing space for the faceplate 150 to deflect. The weight pad 1000 can extend from the heel end 106 of the interior cavity 114 to the toe end 108. The weight pad 1000 can comprise a front wall 1010 facing the front end 102 of the club head 100, a top wall 1020 facing the top rail 110, and a transition region 1030 between the front wall 1010 and the top wall 1020. In many embodiments, the transition region 1030 can be rounded off to provide a smooth transition between the top wall 1020 and the front wall 1010, as illustrated in FIG. 11.

The front wall 1010 of the weight pad 1000 forms a juncture with the sole ledge 148 near the sole 112. The weight pad 1000 is located rearward of the faceplate 150 and is separated from the faceplate 150 by the sole ledge 148. The sole ledge depth 153 is selected to provide a buffer region between the weight pad 1000 and the faceplate 150, while still allowing the weight pad 1000 to overhang the faceplate 150.

As discussed in further detail below, the weight pad 1000 forms a lower interior undercut 190 between a lower and/or forward surface of the weight pad 1000 and the sole 112. The lower interior undercut 190 allows additional mass to be added to the weight pad 1000 to lower the club head CG position without interfering with the flexure of the faceplate 150. The lower interior undercut 190 further serves to provide stress relief within thin portions of the sole 112 (i.e., the sole ledge 148 and sole return 154), by effectively lengthening said thin portions.

In some embodiments, referring to FIGS. 10 and 11, the weight pad front wall 1010 can be angled with respect to the sole 112. In many embodiments, the weight pad front wall 1010 forms an acute angle $\alpha$ with the sole return interior surface 161 such that a portion of the weight pad 1000 overhangs a portion of the sole return 154, as illustrated in FIG. 11. Due to the angled nature of the weight pad 1000, the front wall 1010 extends upward from the sole 112 and toward the faceplate 150. In many embodiments, the transition region 1030 can form a forwardmost portion of the weight pad 1000, as the transition region 1030 is located at the top of the front wall 1010.

In some embodiments, the angle $\alpha$ between the weight pad front wall 1010 and the sole return interior surface 161 can be between approximately 30 degrees and approximately 80 degrees. In some embodiments, the angle $\alpha$ can be between 30 and 35 degrees, 35 and 40 degrees, 40 and 45 degrees, 45 and 50 degrees, 50 and 55 degrees, 55 and 60 degrees, 60 and 65 degrees, 65 and 70 degrees, 70 and 75 degrees, or 75 and 80 degrees. The angle $\alpha$ can be selected to allow the weight pad 1000 to project substantially forward toward the faceplate 150. The steeper the angle $\alpha$, the more forward and lower the weight pad 1000 can protrude, which lowers the CG of the club head 100.

The angled weight pad 1000 provides multiple performance benefits over a weight pad devoid of an angled front wall 1010. Angling the front wall 1010 allows a portion of the weight pad 1000 to overhang a portion of the sole return 154. By overhanging the sole return 154, the weight pad 1000 concentrates a large amount of mass low in the club head 100 without contacting the sole return 154. This arrangement lowers the club head CG without interfering with the flexure of the faceplate 150. The combination of a low CG and high flexibility in the club head 100 create performance improvements such as increased ball speed and increased launch angle.

Referring to FIG. 11, the amount the angled weight pad 1000 overhangs the sole return 154 can be characterized by an overhang distance 1090. The overhang distance 1090 can be measured as the horizontal distance between the weight pad transition region 1030 and the sole perimeter edge 166. The greater the overhang distance 1090, the greater the amount of mass that can be placed low in the club head 100 without contacting the sole return 154, thus lowering the CG without prohibiting flexure. The overhang distance 1090 can be greater than approximately 0.025 inch, greater than approximately 0.05 inch, greater than approximately 0.075 inch, greater than approximately 0.100 inch, greater than approximately 0.125 inch, greater than approximately 0.150 inch, greater than approximately 0.175 inch, or greater than approximately 0.200 inch. In some embodiments, the overhang distance 1090 can be between 0.025 inch to 0.075 inch, 0.040 inch to 0.060 inch, 0.075 inch to 0.100 inch, 0.090 inch to 0.125 inch, 0.120 inch to 0.175 inch, 0.150 inch to 0.200 inch, or 0.175 inch to 0.300 inch. In one exemplary embodiment, the overhang distance 1090 is approximately 0.05 inch. The overhang distance 1090 is selected to allow the faceplate 150 to flex without contacting the weight pad 2000.

The weight pad front wall 1010 is angled forward such that a lower interior undercut 190 can be formed between the angled weight pad front wall 1010 and the sole 112. FIG. 11, the lower interior undercut 190 is defined as the volume underneath the weight pad front wall 1010 and above the sole return 154 and the sole ledge 148. The lower interior undercut 190 separates the thin sole portion from the weight pad 2000. Referring to FIG. 11, the lower interior undercut 190 can define a lower interior undercut depth 192 and a lower interior undercut height 191. The lower interior undercut depth 192 is measured as a front-to-rear distance between the weight pad transition region 1030 and the juncture between the front wall 1010 and the sole ledge 148 (which defines a rearmost point of the lower interior undercut). The lower interior undercut height 191 is defined as the vertical distance between the weight pad front wall 1010 and the sole return interior surface 161.

Referring to FIG. 11, the lower interior undercut depth 192, measured between the weight pad transition region 1030 and the juncture between the front wall 1010 and the sole ledge 148, has a range of 0.010 inch to 0.300 inch. For example, the lower interior undercut depth 192 can range from 0.010 inch to 0.030 inch, 0.030 inch to 0.050 inch, 0.050 inch to 0.070 inch, 0.070 inch to 0.090 inch, 0.090 inch to 0.110 inch, 0.110 inch to 0.130 inch, 0.130 inch to 0.150 inch, 0.150 inch to 0.170 inch, 0.170 inch to 0.190 inch, 0.190 inch to 0.210 inch, 0.210 inch to 0.230 inch, 0.230 inch to 0.250 inch, 0.250 inch to 0.270 inch, 0.270 inch to 0.290 inch, or 0.290 inch to 0.300 inch. The lower interior undercut depth 192 can be greater than approximately 0.010 inch, greater than approximately 0.015 inch, greater than approximately 0.020 inch, greater than approximately 0.025 inch greater than approximately 0.05 inch, greater than approximately 0.075 inch, greater than approximately 0.100 inch, greater than approximately 0.125 inch, greater than approximately 0.150 inch, greater than approximately 0.175 inch, or greater than approximately 0.200 inch. In one exemplary embodiment, the lower interior undercut depth 192 is approximately 0.140 inch.

Referring again to FIG. 11, the lower interior undercut height 191, measured between the front wall 1010 and the sole return interior surface 161, can range from approximately 0.030 inch to approximately 0.400 inch. For example, the lower interior undercut height 191 can range from 0.030 inch to 0.050 inch, 0.050 inch to 0.070 inch, 0.070 inch to 0.090 inch, 0.090 inch to 0.110 inch, 0.110 to 0.130 inch, 0.130 inch to 0.150 inch, 0.150 inch to 0.170 inch, 0.170 inch to 0.190 inch, 0.190 inch to 0.210 inch, 0.210 to 0.230 inch, 0.230 inch to 0.250 inch, 0.250 inch to 0.270 inch, 0.270 inch to 0.290 inch, 0.290 inch to 0.310 inch, 0.310 to 0.330 inch, 0.330 inch to 0.350 inch, 0.350 inch to 0.370 inch, 0.370 inch to 0.390 inch, or 0.390 inch to 0.400 inch. The lower interior undercut height 191 can be greater than approximately 0.010 inch, greater than approximately 0.015 inch, greater than approximately 0.020 inch, greater than approximately 0.025 inch, greater than approximately 0.05 inch, greater than approximately 0.075 inch, greater than approximately 0.100 inch, greater than approximately 0.125 inch, greater than approximately 0.150 inch, greater than approximately 0.175 inch, greater than approximately 0.200 inch, greater than approximately 0.225 inch, greater than approximately 0.250 inch, greater than approximately 0.275 inch, greater than approximately 0.300 inch, greater than approximately 0.325 inch, greater than approximately 0.350 inch, or greater than approximately 0.375 inch. In one exemplary embodiment, the lower interior undercut height 191 is approximately 0.340 inch.

The lower interior undercut 190 can be considered as a region of the weight pad 1000 that has been removed, when compared to iron-type golf club heads lacking an undercut. The lower interior undercut 190 allows thin portions of the sole 112 to be extended. The lower interior undercut 190 can allow for a decrease in the peak stress experienced within the thin portions of the sole 112 and an increase in the flexibility of the sole 112. Rather than behaving as a rigid connection, the lower interior undercut 190 generates stress relief at the face-sole transition by allowing the sole return 154 and the sole ledge 148 to deflect to a greater extent under impact loads. The lower interior undercut's 190 effective increase in the length of the sole return 154 and/or the sole ledge 148 increases the total surface area over which impact load is distributed, creating a reduction in peak stress within the sole ledge 148 and sole return. The lower interior undercut 190 dually reduces stress concentrations within the sole ledge 148 and the sole return 154 and increases the bending/spring effect of the sole 112.

Figure 12:
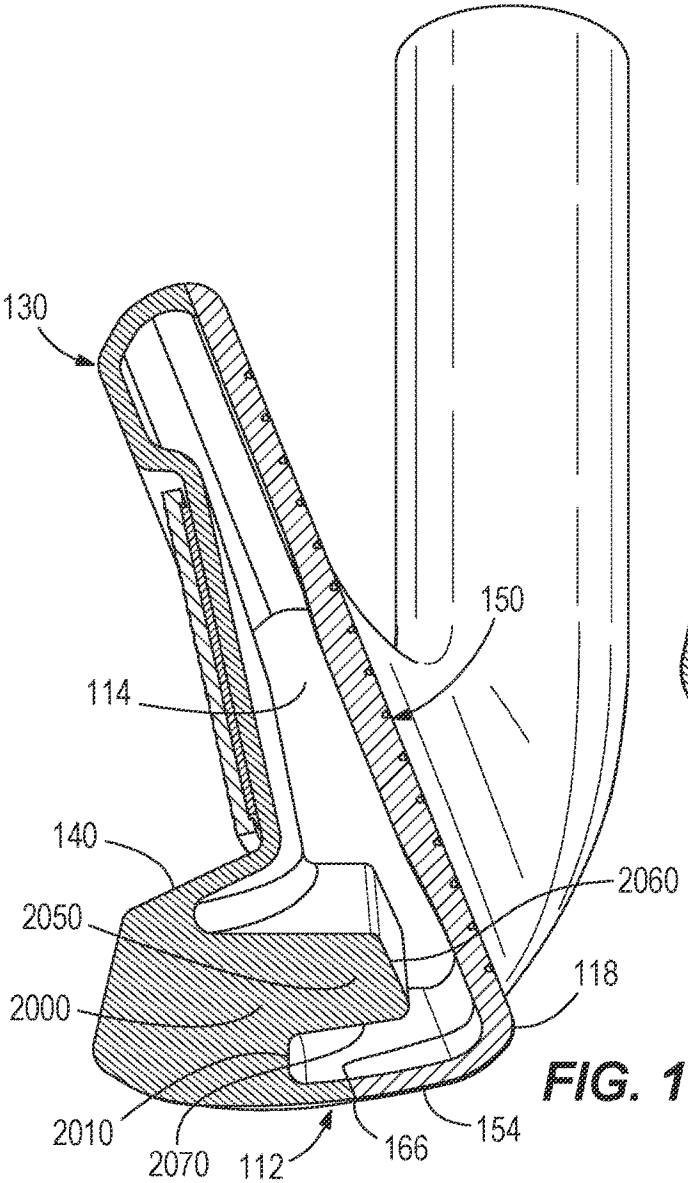
FIG. 12 illustrates a toe-side cross sectional view of a golf club head with an L-shaped faceplate and a weight pad with an extension.

In another embodiment, as illustrated in FIG. 12, rather than being angled with respect to the sole 112, the weight pad 2000 forms a weight pad extension 2050 protruding forward from the weight pad 2000 toward the faceplate 150 and overhanging the sole return 154 and the sole ledge 148. The overhang of the weight pad 2000 over the sole return 154 and sole ledge 148 forms a lower interior undercut 190, as discussed in further detail below. The weight pad 2000 comprising a weight pad extension 2050 and a lower interior undercut 190 allows a large amount of mass to be positioned low in the club head 100 without interfering with the flexure of the faceplate 150.

Figure 13:
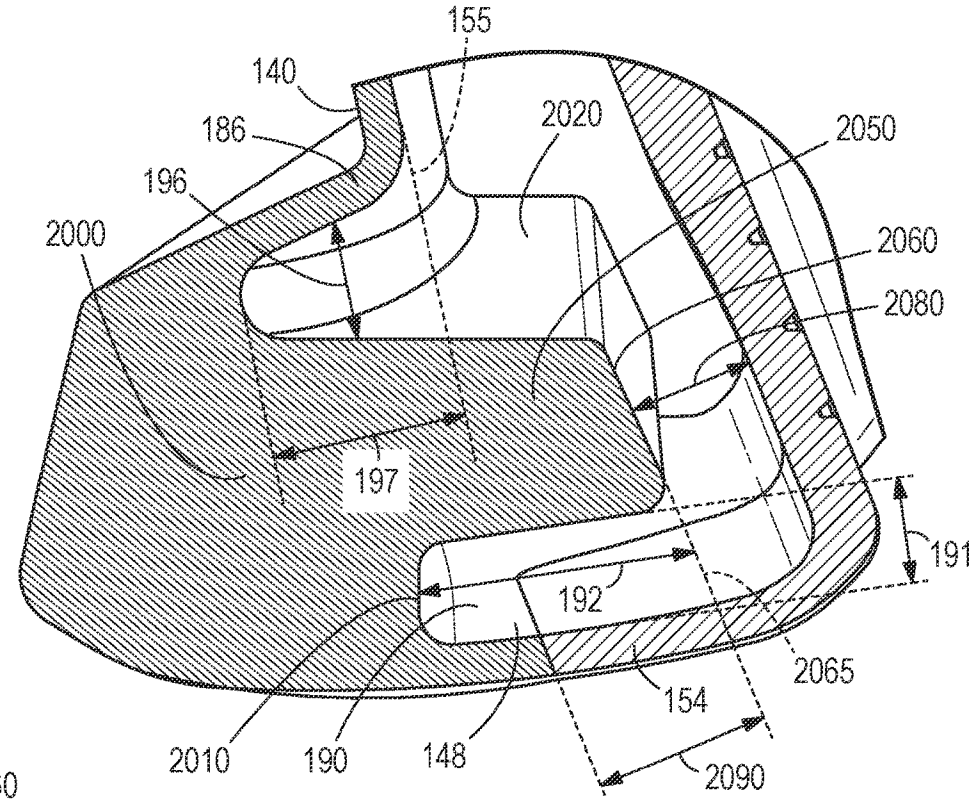
FIG. 13 illustrates a zoomed-in view of FIG. 12, focusing on the sole return and the weight pad with an extension.

Referring to FIG. 13, the weight pad extension 2050 can protrude from the front wall 2010 of the weight pad 2000 and extend approximately parallel to the sole 112. The weight pad extension 2050 protrudes forward through the interior cavity 114 toward the strike face back surface 156. The weight pad extension 2050 comprises a forward edge 2060 defining the forwardmost extent of the weight pad extension 2050. The weight pad extension 2050 does not make contact with the strike face back surface 156. The forward edge 2060 of the weight pad extension 2050 is spaced away from the strike face back surface 156 so as not to interfere with the flexure of the faceplate 150 at impact.

The spacing between the weight pad extension 2050 and the faceplate 150 can be characterized by a horizontal offset distance 2080 measured between the strike face back surface 156 and the forward edge 2060 of the weight pad extension 2050. The horizontal offset distance 2080 can be as small as possible while still allowing sufficient space for the strike face 116 to flex at impact. It is desirable for the weight pad extension 2050 to extend as near to the strike face back surface 156 as possible without interfering with the flexure of the faceplate 150. The smaller the horizontal offset distance 2080 between the strike face back surface 156 and the forward edge 2060 of the weight pad extension 2050, the greater the amount of mass that can be allocated low in the club head 100.

In many embodiments, the horizontal offset distance 2080 between strike face back surface 156 and the forward edge 2060 of the weight pad extension 2050 can be less than approximately 0.30 inch. In some embodiments, the horizontal offset distance 2080 can be less than approximately 0.275 inch, less than approximately 0.25 inch, less than approximately 0.225 inch, less than approximately 0.20 inch, less than approximately 0.175 inch, less than approximately 0.15 inch, less than approximately 0.125 inch, less than approximately 0.10 inch, less than approximately 0.075 inch, or less than approximately 0.05 inch. The horizontal offset distance 2080 is selected to allow the faceplate 150 to deflect without contacting the weight pad 2000.

As mentioned above, the weight pad extension 2050 overhangs both the sole ledge 148 and the sole return 154. The overhang of the weight pad extension 2050 creates a lower interior undercut 190 that allows the mass of the weight pad 2000 to be placed low and forward without contacting the sole return 154 or interfering with the flexure of the faceplate 150.

The weight pad extension 2050 overhangs the sole return 154, allowing the weight pad 2000 to lower the club head CG position without contacting the sole return 154 and prohibiting the faceplate 150 from flexing. The amount of overhang can be characterized by an overhang distance 2090 measured between the weight pad extension forward edge 2060 and the sole perimeter edge 166. The greater the overhang distance 2090, the shorter the weight pad 2000 can be without contacting the sole return 154, thus lowering the CG without prohibiting flexure. The overhang distance 2090 greater than approximately 0.050 inch, greater than approximately 0.075 inch, greater than approximately 0.100 inch, greater than approximately 0.125 inch, greater than approximately 0.150 inch, greater than approximately 0.175 inch, or greater than approximately 0.200 inch. In some embodiments, the overhang distance 2090 can be between 0.050 inch to 0.075 inch, 0.020 inch to 0.060 inch, 0.075 inch to 0.100 inch, 0.090 inch to 0.125 inch, 0.120 inch to 0.175 inch, 0.150 inch to 0.200 inch, or 0.175 inch to 0.300 inch. In one exemplary embodiment, the overhang distance 2090 is approximately 0.250 inch. The overhang distance 2090 is selected to allow the faceplate 150 to deflect without contacting the weight pad 2000.

In many embodiments, as illustrated by FIG. 13, the weight pad extension 2050 comprises a lower surface 2070 disposed toward the sole 112. The weight pad extension lower surface 2070 can be offset vertically from the sole return interior surface 161 such that the weight pad extension 2050 does not contact the sole return 154. The vertical offset between the weight pad extension lower surface 2070 and the sole return interior surface 161 forms a lower interior undercut 190. The lower interior undercut 190 is defined as the volume underneath the weight pad extension 2050 and above the sole 112. The lower interior undercut 190 is bounded by the front wall 2010 of the weight pad 2000, the lower surface 2070 of the weight pad extension 2050, the sole return 148, and the sole return interior surface 161. The lower interior undercut 190 extends laterally in a heel to toe direction over a heel to toe length of the weight pad 2000. The weight pad extension 2050 can define a first plane 2065 extending along the forward edge 2060 of the weight pad extension 2050 and intersecting the sole 112. A lower interior undercut opening can be defined between the weight pad extension 2050 and the sole at the first plane 2065. The lower interior undercut 190 can define a lower interior undercut depth 192 and a lower interior undercut height 191. The lower interior undercut depth 192 is measured as a perpendicular distance between the first plane 2065 and the front wall of the weight pad (which defines a rearmost point of the lower interior undercut 190). The lower interior undercut height 191 is defined as the vertical distance between the weight pad extension lower surface 2070 and the sole return interior surface 161.

Referring to FIG. 13, the lower interior undercut depth 192, between the first plane 2065 and the sole return interior surface 161 can be between approximately 0.010 inch to approximately 0.300 inch. For example, the lower interior undercut depth 192 can range from 0.010 inch to 0.030 inch, 0.030 inch to 0.050 inch, 0.050 inch to 0.070 inch, 0.070 inch to 0.090 inch, 0.090 inch to 0.110 inch, 0.110 inch to 0.130 inch, 0.130 inch to 0.150 inch, 0.150 inch to 0.170 inch, 0.170 inch to 0.190 inch, 0.190 inch to 0.210 inch, 0.210 inch to 0.230 inch, 0.230 inch to 0.250 inch, 0.250 inch to 0.270 inch, 0.270 inch to 0.290 inch, or 0.290 inch to 0.300 inch. The lower interior undercut depth 192 can be greater than approximately 0.010 inch, greater than approximately 0.015 inch, greater than approximately 0.020 inch, greater than approximately 0.025 inch greater than approximately 0.05 inch, greater than approximately 0.075 inch, greater than approximately 0.100 inch, greater than approximately 0.125 inch, greater than approximately 0.150 inch, greater than approximately 0.175 inch, greater than approximately 0.200 inch, greater than approximately 0.225 inch, greater than approximately 0.250 inch, or greater than approximately 0.275 inch. In one exemplary embodiment, the lower interior undercut depth 192 is approximately 0.140 inch.

Referring again to FIG. 13, the lower interior undercut height 191, measured between the weight pad extension lower surface 2070 and the sole return interior surface 161, can range from approximately 0.030 inch to approximately 0.200 inch. For example, the lower interior undercut height 191 can range from 0.030 inch to 0.040 inch, 0.040 inch to 0.050 inch, 0.050 inch to 0.060 inch, 0.060 inch to 0.070 inch, 0.070 inch to 0.080 inch, 0.080 inch to 0.090 inch, 0.090 inch to 0.100 inch, 0.100 inch to 0.110 inch, 0.110 to 0.120 inch, 0.120 inch to 0.130 inch, 0.130 inch to 0.140 inch, 0.140 inch to 0.150 inch, 0.150 inch to 0.160 inch, 0.160 inch to 0.170 inch, 0.170 inch to 0.180 inch, 0.180 inch to 0.190 inch, or 0.190 inch to 0.200 inch. The lower interior undercut height 191 can be greater than approximately 0.010 inch, greater than approximately 0.015 inch, greater than approximately 0.020 inch, greater than approximately 0.025 inch, greater than approximately 0.05 inch, greater than approximately 0.075 inch, greater than approximately 0.100 inch, greater than approximately 0.125 inch, greater than approximately 0.150 inch, or greater than approximately 0.175 inch.

The overhanging weight pads 1000, 2000 described above can be combined with any of the various L-shaped faceplate 150 geometries described above including a sole return 154, a toe extension 168, a top rail extension 170, or any combination thereof. The overhanging weight pads 1000, 2000 described above can also be combined with rear body 130 geometry or feature described either above or below, including a sole ledge 156, a heel mass 147 and/or toe mass 149, a lower interior undercut 190, an upper interior undercut 195, a rear exterior cavity 198, an external flexure hinge 3000, an internal bending notch 3100, an internal welding rib 179, or any combination thereof. Similarly, the lower interior undercut 190 can be combined with any faceplate 150 geometry described above, any rear body 130 geometry or feature described above or below, or any combination thereof.

III. Rear Wall with Rear Exterior Cavity

In many embodiments, the rear wall 140 of the club head 100 comprises a geometry that forms a rear exterior cavity 198. In some embodiments, the rear exterior cavity 198 can be configured to receive a badge 199 that damps vibrations and/or provides an aesthetically pleasing appearance. The geometry of the rear wall 140 can also increase the flexibility of the club head 100, leading to increased ball speeds.

Figure 14:
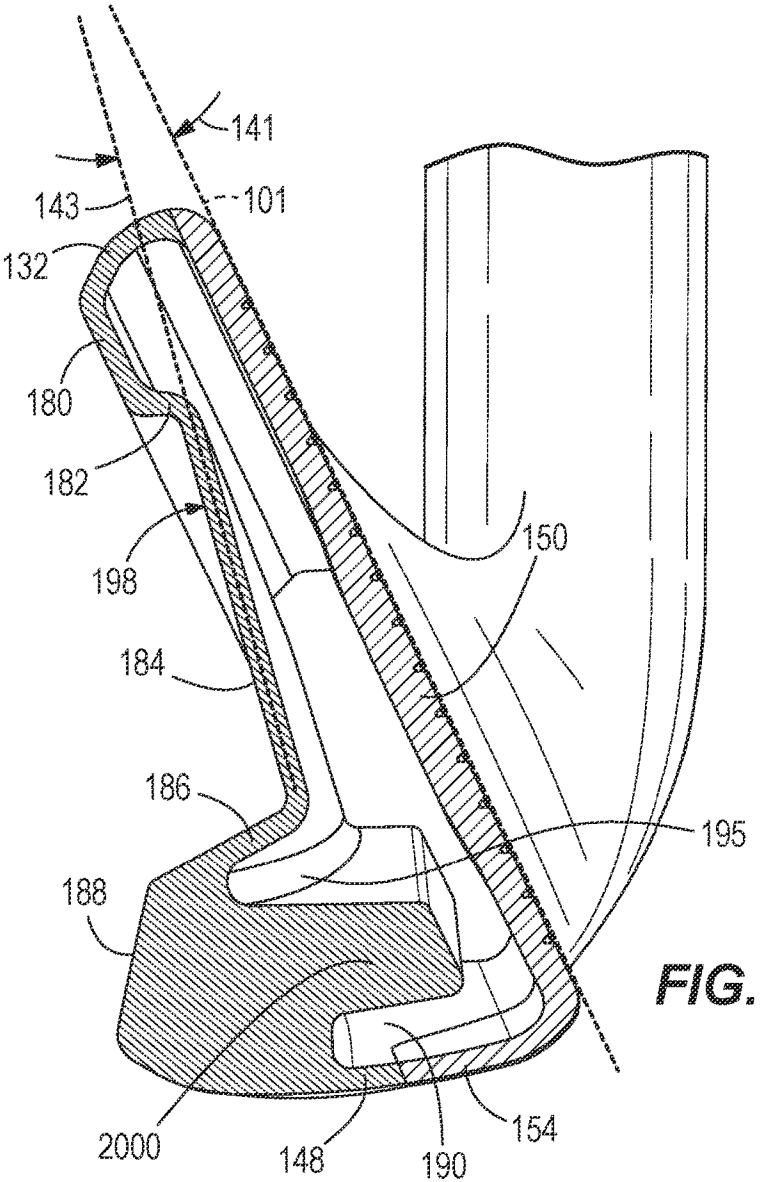
FIG. 14 illustrates a toe-side cross-sectional view of the golf club head of FIG. 12, highlighting the rear wall angle.

Referring to FIG. 12, the rear wall 140 extends upward from the rear body sole portion 138 to the rear body top rail portion 132 and encloses the rear end 104 of the club head 100. The rear wall 140 comprises a rear wall upper portion 180, a rear wall upper transition 182, a rear wall middle portion 184, a rear wall lower portion 188, a rear wall lower transition 186, and a rear wall toe portion 189. Every portion 180, 182, 184, 186, 188, 189 of the rear wall 140 further comprises an exterior surface and an interior surface. The rear wall upper portion 180 extends toward the sole 112 from the top rail portion 132 parallel to the loft plane 101 defined by the strike face 116. The rear wall upper transition 182 extends toward the front end 102 and the strike face 116 into the hollow interior cavity 114. The rear wall middle portion 184 extends approximately toward the sole 112 from the rear wall upper transition 182 to the rear wall lower transition 186. The rear wall lower transition 186 extends rearward from the rear wall middle portion 184, away from the strike face 116. The rear wall 140 further comprises a rear wall toe transition 194 between the rear wall middle portion 184 and the rear wall toe portion 189. The rear wall toe transition 194 can connect the rear wall upper transition 182 and the rear wall lower transition 186 at the toe end 108. In many embodiments, as shown in FIG. 14, the rear wall upper transition 182 and the rear wall lower transition 186 can come together at a point near the heel end 106. In other embodiments (not shown), the rear wall 140 can further define a rear wall heel transition connecting the rear wall upper transition 182 and the rear wall lower transition 186 at the heel end 106. The rear wall middle portion 184 can therefore be bounded by the rear wall lower transition 186, the rear wall toe transition 194, and the rear wall upper transition 182.

Due to the hollow-body nature of the club head 100, the top rail and the rear wall 140 can be substantially thin without sacrificing durability. The thin top rail and rear wall 140 allow for maximum flexure within the top rail and rear wall 140 portions to maximize ball speed.

Figure 15:
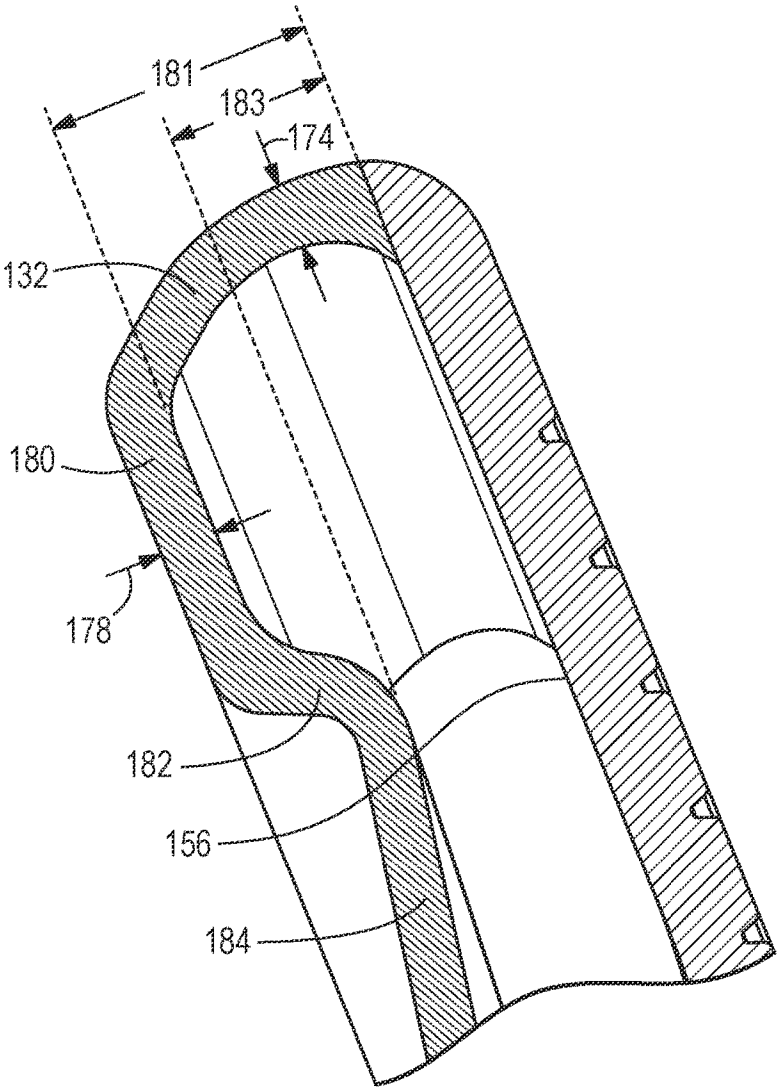
FIG. 15 illustrates a toe-side cross-sectional view of the golf club head of FIG. 12, highlighting the upper interior undercut and the lower interior undercut.

As illustrated in FIG. 15, the top rail thickness 174 can be substantially thin to increase the flexure of top rail portion 132. The thinner the rear body top rail portion 132, the greater the flexibility of the club head 100, leading to higher ball speeds. In many embodiments, the top rail thickness 174 can vary slightly. For example, in some embodiments, the top rail thickness 174 can be greatest near the faceplate 150 and decrease towards the rear wall upper portion 180. In other embodiments, the top rail thickness 174 can be substantially constant from the faceplate 150 to the rear wall upper portion 180.

In many embodiments, the top rail thickness 174 can be less than approximately 0.070 inch, less than approximately 0.065 inch, less than approximately 0.060 inch, less than approximately 0.055 inch, less than approximately 0.050 inch, less than approximately 0.045 inch, less than approximately 0.040 inch, less than approximately 0.035 inch, less than approximately 0.030 inch, or less than approximately 0.025 inch. The top rail thickness 174 can be between 0.025 inch to 0.050 inch, 0.035 inch to 0.050 inch, 0.040 inch to 0.065 inch, or 0.045 inch to 0.070 inch. In one exemplary embodiment, the top rail thickness is approximately 0.045 inch.

A thin top rail portion 132 with the thicknesses described above is only achievable in a hollow-body type iron. In order for the top rail portion 132 to be substantially thin, the club head 100 requires a continuous rear wall 140 to provide structural support to the top rail portion 132. If the thin top rail portion 132 described above was applied to a cavity-back iron or a club head without a continuous rear wall 140, the top rail portion 132 would fail under the force of impact.

Referring to FIG. 15, the rear wall 140 comprises a rear wall thickness 178. The rear wall thickness 178 may be in a range of 0.030 inch to 0.070 inch. The rear wall thickness 178 may vary in this range from the top rail portion 132 to the rear wall lower transition 186. The rear wall upper portion 180, the rear wall upper transition 182, the rear wall middle portion 184, and the rear wall lower transition 186 can each comprise a separate thickness 178. The rear wall lower portion 188 is substantially thicker than the rest of the rear wall 140, as the rear wall lower portion 188 is integral with the weight pad 1000.

In many embodiments the rear wall thickness 178 can be less than approximately 0.070 inch, less than approximately 0.065 inch, less than approximately 0.060 inch, less than approximately 0.055 inch, less than approximately 0.050 inch, less than approximately 0.045 inch, less than approximately 0.040 inch, less than approximately 0.035 inch, less than approximately 0.030 inch, or less than approximately 0.025 inch. The rear wall thickness 178 can be between 0.025 inch to 0.050 inch, 0.035 inch to 0.050 inch, 0.040 inch to 0.065 inch, or 0.045 inch to 0.070 inch. In one exemplary embodiment, the top rail thickness is approximately 0.045 inch. In one exemplary embodiment, the rear wall thickness 178 is approximately 0.045 inch.

In some embodiments, the rear wall thickness 178 at each of the rear wall upper portion 180, the rear wall upper transition 182, the rear wall middle portion 184, and the rear wall lower transition 186 can be substantially the same. In other embodiments, one or more of the rear wall thicknesses 178 at the rear wall upper portion 180, the rear wall upper transition 182, the rear wall middle portion 184, and/or the rear wall lower transition 186 can be different from one another.

The rear wall upper portion 180 defines an upper rear wall angle with the rear wall upper transition 182. The upper rear wall angle is greater than 90 degrees. The rear wall middle portion 184 defines a lower real wall angle with the rear wall lower transition 186. The rear wall lower angle is greater than 90 degrees. The rear wall middle portion 184 exterior surface is essentially planar.

As illustrated in FIG. 14, a rear wall middle portion plane 143 intersects the loft plane 101 outside the golf club head 100 and above the top rail portion 132. The rear wall middle portion plane 143 defines a loft plane intersection angle 141 where it intersects the loft plane 101 that is in a range of 5 degrees to 25 degrees. In many embodiments, the loft plane intersection angle 141 may be 5 degrees, 6 degrees, 7 degrees, 8 degrees, 9 degrees, 10 degrees, 11 degrees, 12 degrees, 13 degrees, 14 degrees, 15 degrees, 16 degrees, 17 degrees, 18 degrees, 19 degrees, 20 degrees, 21 degrees, 22 degrees, 23 degrees, 24 degrees, or 25 degrees.

In many embodiments, the rear wall upper portion 180 extends parallel to the strike face portion of the L-shaped faceplate 150. As illustrated by FIG. 15, the rear wall upper portion 180 is offset from the strike face portion 152 by a rear wall upper portion offset distance 181. The rear wall upper portion offset distance 181 may be in a range of 0.100 inch to 0.300 inch, depending on the loft angle of the particular club head 100. Because the rear wall upper portion 180 is parallel to the strike face portion 152, the rear wall upper portion offset distance 181 is constant and does not vary in a given golf club head 100.

The rear wall upper portion offset 181 protects the rear wall upper portion 180 from damage during welding. As discussed above, the rear body 130 further comprises an opening proximate the front end 102 of the club head 100, the opening being formed between the top rail 110, the heel end 106, the toe end 108, and the sole 112 of the rear body 130. The welding surfaces 146 extends around the perimeter of the rear body opening 144, the welding surfaces 146 being formed by forwardmost edges of the rear body top rail portion 132, heel portion 134, toe portion 136, and sole portion 138. The smaller the rear wall upper portion offset distance 181, the greater the flexure of the top rail portion 132 and rear wall upper portion 180. However, the rear wall upper portion offset 181 must provide enough distance between the welding surfaces 146 and the rear wall upper portion 180 to prevent the welding process from melting or distorting the rear wall upper portion 180. The club head 100 comprises a rear wall upper portion offset distance 181 that provides a maximum amount of rear wall 140 flexure without the rear wall upper portion 180 being damaged during welding. In one exemplary embodiment, the rear wall upper portion offset distance 181 is approximately 0.188 inch.

Further, the rear wall middle portion 184 defines a rear wall middle portion offset distance 183. The rear wall middle portion offset distance 183 can be measured between an interior surface of the rear wall upper transition 182 and the strike face back surface 156. The rear wall middle portion offset distance 183 is as small as possible to encourage bending of the rear wall 140 without interfering with the bending of the faceplate 150.

In many embodiments, the rear wall middle portion offset distance 183 can be greater than approximately 0.025 inch greater than approximately 0.05 inch, greater than approximately 0.075 inch, greater than approximately 0.100 inch, greater than approximately 0.125 inch, greater than approximately 0.150 inch, greater than approximately 0.175 inch, or greater than approximately 0.200 inch. In some embodiments, the rear wall middle portion offset distance 183 can be between 0.025 inch to 0.095 inch, 0.070 inch to 0.100 inch, 0.080 inch to 0.125 inch, 0.120 inch to 0.175 inch, 0.150 inch to 0.200 inch, or 0.175 inch to 0.300 inch. In one exemplary embodiment, the rear wall middle portion offset distance 183 is approximately 0.09 inch.

As discussed above, the rear body 130 can comprise a weight pad 1000 formed in the interior cavity 114 that overhangs a portion of the sole 112 and/or a portion of the sole return 154. Referring to FIG. 15, the rear wall lower transition 186 interior surface extends rearward, further away from the strike face back surface 156. The rear wall middle portion plane 143 intersects the top wall 1020 of the weight pad 1000. The portion of the rear wall lower transition 186 interior surface rearward of the rear wall middle portion plane 143, a radiused transition between rear wall lower transition 186 interior surface and the weight pad top wall 1020, and the weight pad top wall 1020 rearward of the rear wall middle portion plane 143 together define an upper interior undercut 195. The upper interior undercut 195 comprises an upper interior undercut height 196 measured between the rear wall lower transition 186 interior surface and the weight pad top wall 1020. The upper interior undercut height 196 can vary in a range of approximately 0.010 inch to approximately 0.200 inch. The upper interior undercut 195 comprises an upper interior undercut depth 197 measured from the most rearward point of the upper interior undercut 195 to the rear wall middle portion plane 143.

The upper interior undercut depth 197 can vary in a range of approximately 0.010 inch to approximately 0.300 inch. For example, the upper interior undercut depth 197 can range from 0.010 inch to 0.030 inch, 0.030 inch to 0.050 inch, 0.050 inch to 0.070 inch, 0.070 inch to 0.090 inch, 0.090 inch to 0.110 inch, 0.110 inch to 0.130 inch, 0.130 inch to 0.150 inch, 0.150 inch to 0.170 inch, 0.170 inch to 0.190 inch, 0.190 inch to 0.210 inch, 0.210 inch to 0.230 inch, 0.230 inch to 0.250 inch, 0.250 inch to 0.270 inch, 0.270 inch to 0.290 inch, or 0.290 inch to 0.300 inch. The upper interior undercut depth 197 can be greater than approximately 0.010 inch, greater than approximately 0.015 inch, greater than approximately 0.020 inch, greater than approximately 0.025 inch greater than approximately 0.05 inch, greater than approximately 0.075 inch, greater than approximately 0.100 inch, greater than approximately 0.125 inch, greater than approximately 0.150 inch, greater than approximately 0.175 inch, or greater than approximately 0.200 inch.

The rear wall lower transition 186 exterior surface is essentially planar and extends essentially parallel to the ground plane when the golf club head 100 is in the address position. The rear wall toe transition 194 exterior surface is essentially planar. The rear wall upper transition 182 exterior surface, the rear wall lower transition 186 exterior surface, the rear wall toe transition 194 exterior surface, and the rear wall middle portion 184 exterior surface cooperate to define a rear exterior cavity 198. The rear wall middle portion 184 is recessed from the rear wall exterior surface and by the rear wall lower transition 186, the rear wall toe transition 194, and the rear wall upper transition 182. The rear exterior cavity 198 further comprises a fillet or curved transition between the planar rear cavity exterior surface and the surrounding surfaces. The rear wall 130 geometry forming the rear exterior cavity 198 can be combined with any of the various L-shaped faceplate 150 geometries described above including a sole return 154, a toe extension 168, a top rail extension 170, or any combination thereof. The rear wall 130 geometry forming the rear exterior cavity 198 can also be combined with any other suitable rear body 130 geometry or feature described either above or below, including a sole ledge 156, an angled weight pad 1000, a weight pad 2000 comprising an extension 2050, a heel mass 147 and/or toe mass 149, a lower interior undercut 190, an upper interior undercut 195, an external flexure hinge 3000, an internal bending notch 3100, an internal welding rib 179, or any combination thereof.

Figure 16:
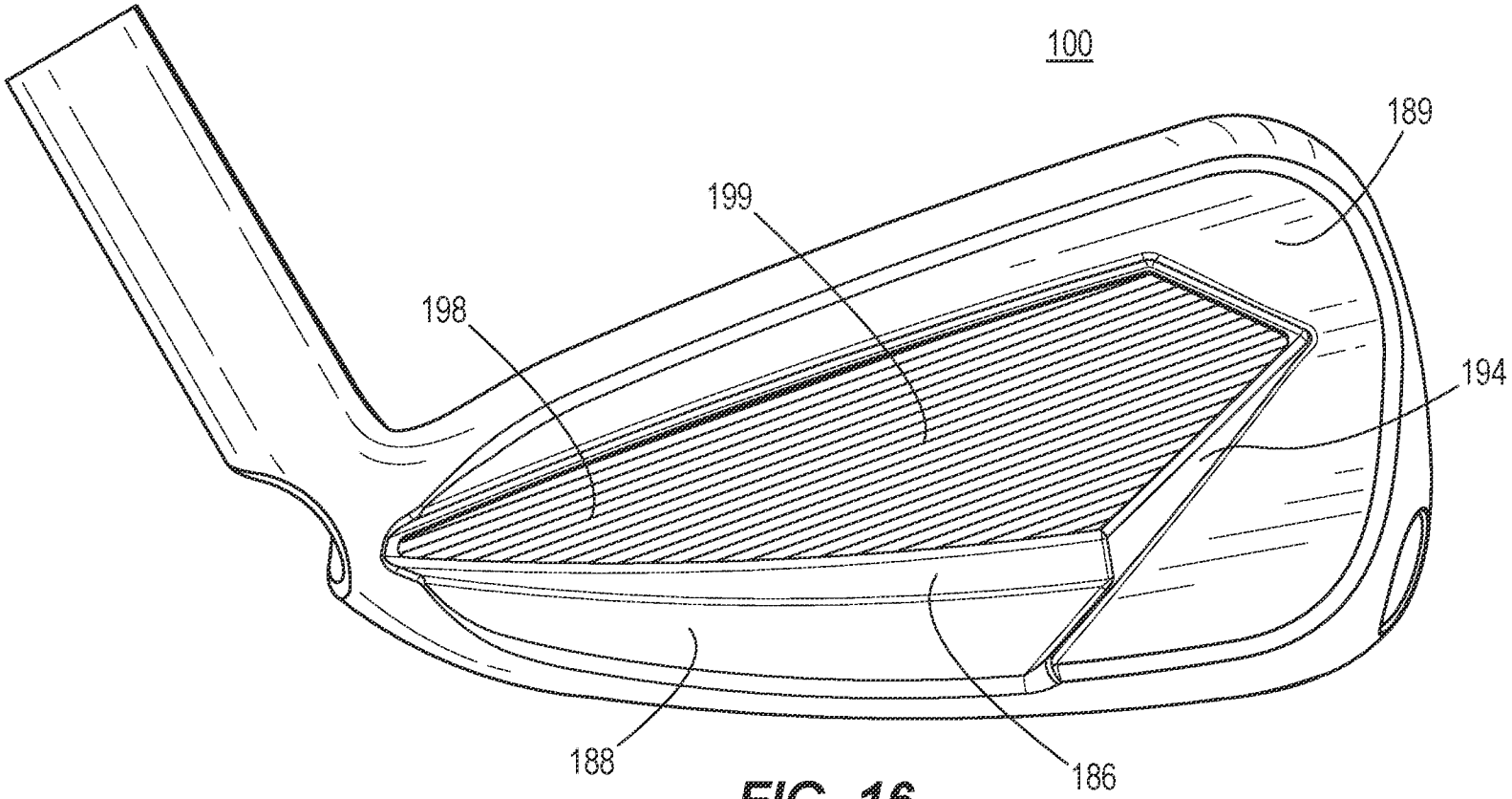
FIG. 16 illustrates a rear perspective view of a golf club head comprising a rear exterior cavity.

In some embodiments, as illustrated in FIG. 16, a badge 199 may be applied to the exterior surface of the golf club head rear wall 140. The badge 199 may be applied on the rear wall middle portion 184 exterior surface. In some embodiments (not shown), the badge 199 comprises an inner adhesive badge layer and an outer, metallic badge layer permanently affixed to the inner adhesive badge layer. As discussed above, the rear wall middle portion 184 is planar. Further, the rear wall middle portion 184 is within the rear exterior cavity 198. As a result, the badge 199 is applied and contained entirely within the rear exterior cavity 198. Further, the badge 199 may also be planar. Further the badge 199 can comprise a thickness (not shown). The thickness of the badge 199 may be constant. The thickness of the badge 199 may vary within the badge 199. In many embodiments, it is desirable to produce a badge 199 having a constant badge thickness, because a planar, constant thickness badge is considerably less expensive than a non-planar, varied thickness badge. The badge thickness may vary in range between 0.010 inch and 0.500 inch. The badge 199 is formed such that it does not protrude rearwardly past the rear wall upper portion 180 or rear wall lower portion 188 exterior surfaces.

Referring to FIG. 16, the badge 199 covers a substantial portion of the rear wall 140. The badge 199 comprises a surface area exposed on the rear end 104 of the club head 100. The surface area of the badge 199 can be between 1.00 $in^2$ to 2.00 $in^2$. In some embodiments, the surface area of the badge 199 can be between 1.00 $in^2$ to 1.25 $in^2$, between 1.10 $in^2$ to 1.45 $in^2$, between 1.30 $in^2$ to 1.55 $in^2$, between 1.50 $in^2$ to 1.75 $in^2$, or between 1.70 $in^2$ to 2.00 $in^2$. In some embodiments, the badge 199 covers a substantial portion of the rear wall 140. In some embodiments, the badge 199 covers between 10% to 30%, between 25% to 40%, between 30% to 50%, between 45% to 60%, between 50% to 75%, between 60% to 75%, or between 70% to 80% of the surface area of the rear wall 140. The badge 199 can cover a substantial portion of the rear wall 140 to provide vibrational damping and/or acoustic benefits to the club head 100.

In some embodiments, as illustrated in FIG. 5, the rear wall 140 can form an internal welding rib 179. The internal welding rib 179 comprises an area of increased thickness along the rear wall 140 that protects the rear wall 140 during the welding process. The internal welding rib 179 is located on the rear wall 140 proximate the heel end 106 and extends substantially vertically. The internal welding rib 179 can extend at least partially between the top rail portion 132 and the rear body sole portion 138. In many embodiments, the internal welding rib 179 can extend toward the sole 112 from near the top rail portion 132 and terminate just above the weight pad top wall 1020 and/or a top surface of the heel mass 147. As a function of its increased thickness, the internal welding rib 179 protrudes into the hollow interior cavity 114 from the interior surface of the rear wall 140. In some embodiments, the internal welding rib 179 can protrude from the interior surface(s) of the rear wall upper portion 180, the rear wall upper transition 182, the rear wall middle portion 184, the rear wall lower transition 186, and/or the rear wall lower portion 188.

From a front view, as illustrated by FIG. 5, the internal welding rib 179 can be located near the heel end 106 of the club head 100. The internal welding rib 179 can be located on the rear body 130 directly behind the location of the heel side perimeter edge 162 of the faceplate 150. Because the heel side perimeter edge 162 is welded in a direction perpendicular to the rear wall 140, the area of the rear wall 140 behind the weld line can be reinforced by the internal welding rib 179 to protect the rear wall 140 from damage or discoloration that may occur during the welding process. In many embodiments, the thickness of the internal welding rib 179 can be between 0.060 inch to 0.140 inch. The thickness of the internal welding rib 179 can be between 0.060 inch to 0.080 inch, 0.075 inch to 0.100 inch, 0.090 inch to 0.120 inch, or 0.110 inch to 0.140 inch. The thickness of the internal welding rib 179 can be greater than approximately 0.060 inch, greater than approximately 0.065 inch, greater than approximately 0.070 inch, greater than approximately 0.075 inch, greater than approximately 0.080 inch, greater than approximately 0.085 inch, greater than approximately 0.090 inch, greater than approximately 0.095 inch, greater than approximately 0.100 inch, greater than approximately 0.105 inch, greater than approximately 0.110 inch, greater than approximately 0.115 inch, greater than approximately 0.120 inch, greater than approximately 0.125 inch, greater than approximately 0.130 inch, greater than approximately 0.135 inch, or greater than approximately 0.140 inch. In many embodiments, the thickness of the internal welding rib 179 can be approximately double the rear wall thickness 178.

The internal welding rib 179 can be combined with any of the various L-shaped faceplate 150 geometries described above including a sole return 154, a toe extension 168, a top rail extension 170, or any combination thereof. The internal welding rib 179 can also be combined with rear body 130 geometry or feature described either above or below, including a sole ledge 156, an angled weight pad 1000, a weight pad 2000 comprising an extension 2050, a heel mass 147 and/or toes mass 149, a lower interior undercut 190, an upper interior undercut 195, a rear exterior cavity 198, an external flexure hinge 3000, an internal bending notch 3100, an internal welding rib 179, or any combination thereof.

IV. Dynamic Lofting Features

Figure 17:
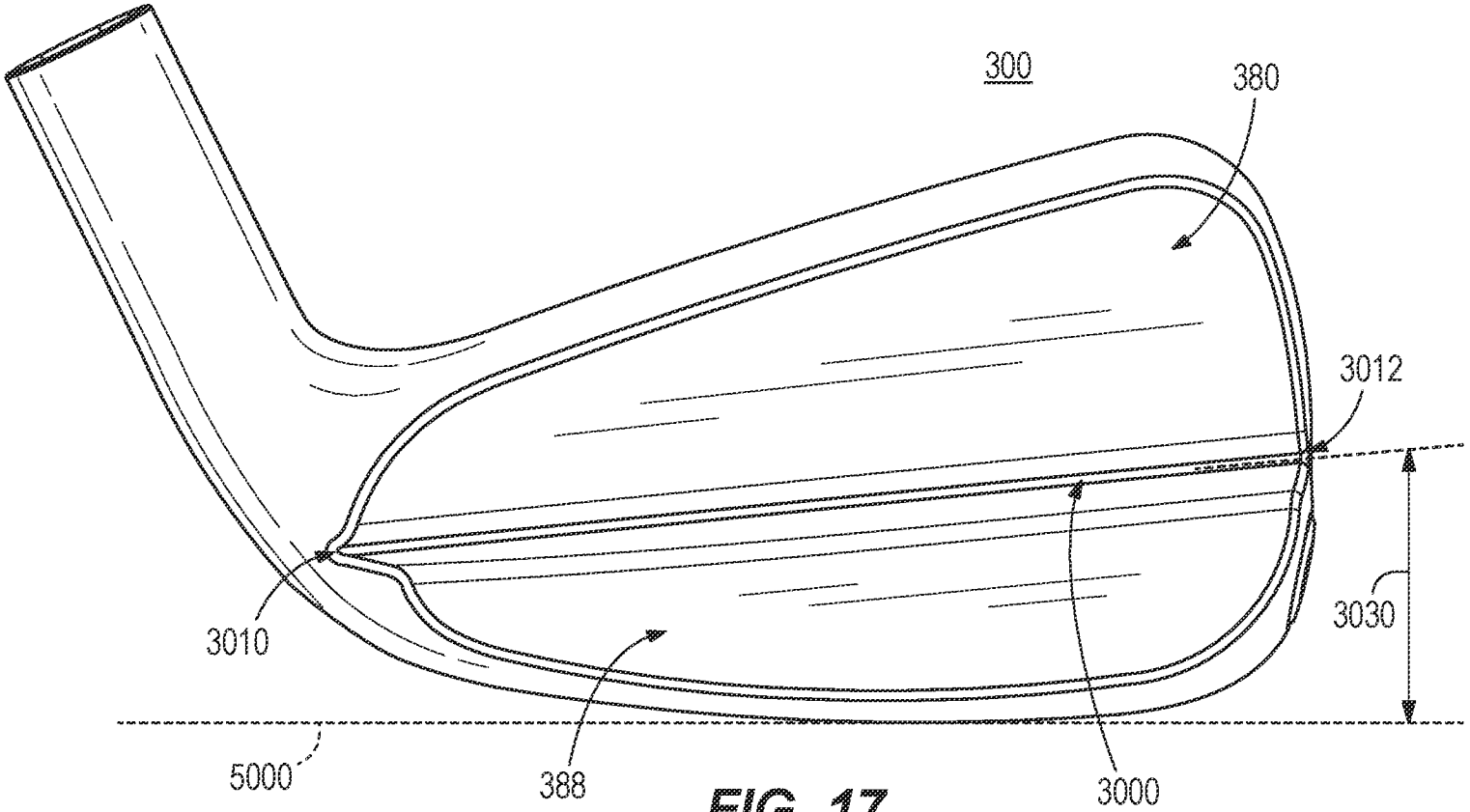
FIG. 17 illustrates a rear view of a golf club head comprising dynamic lofting features.
Figure 18B:
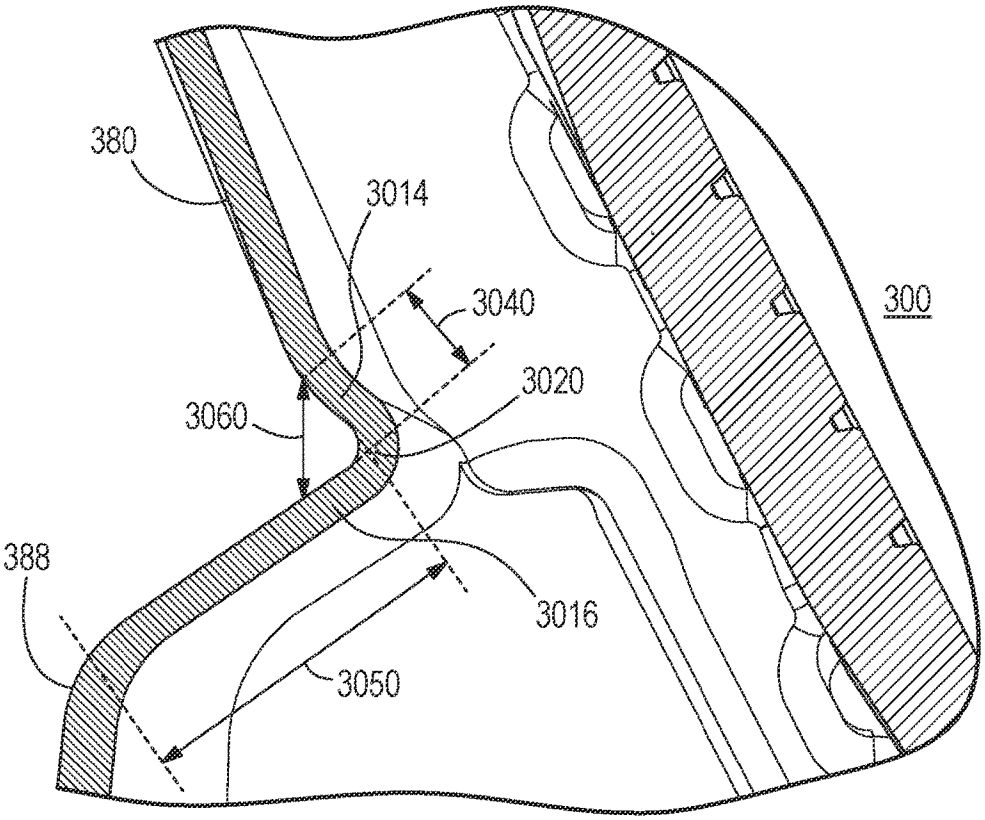
FIG. 18B illustrates a zoomed in toe-side cross-sectional perspective view of the golf club head of FIG. 17, focusing on the flexure hinge.
Figure 18A:
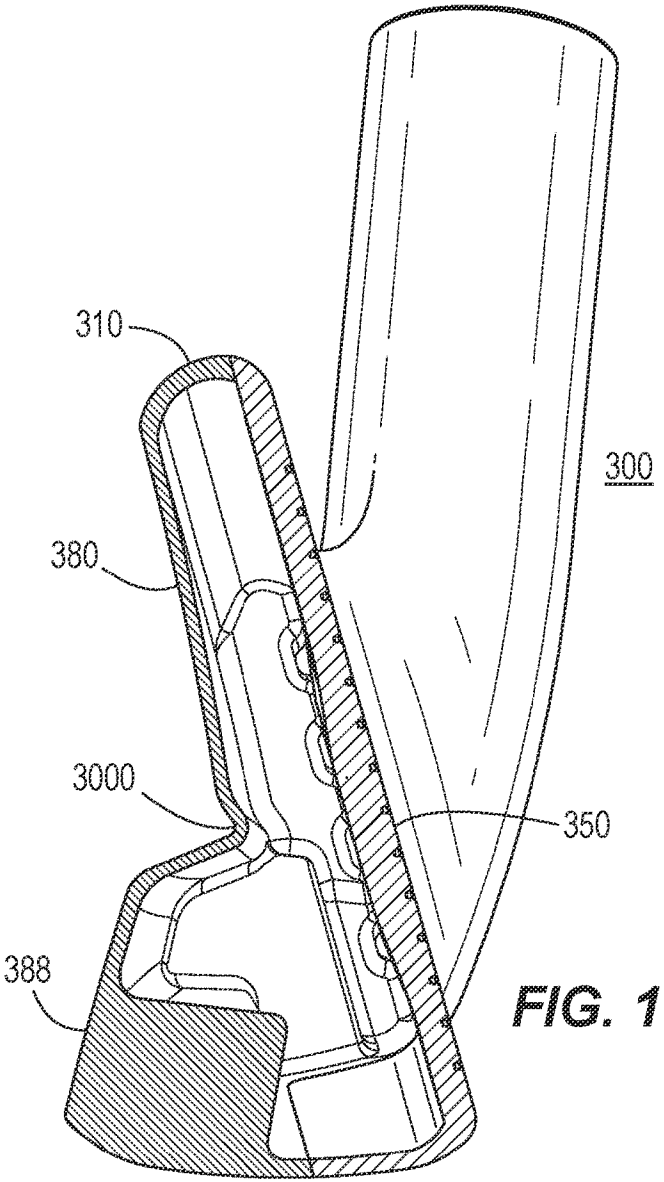
FIG. 18A illustrates a toe-side cross-sectional view of the golf club head of FIG. 17.
Figure 19:
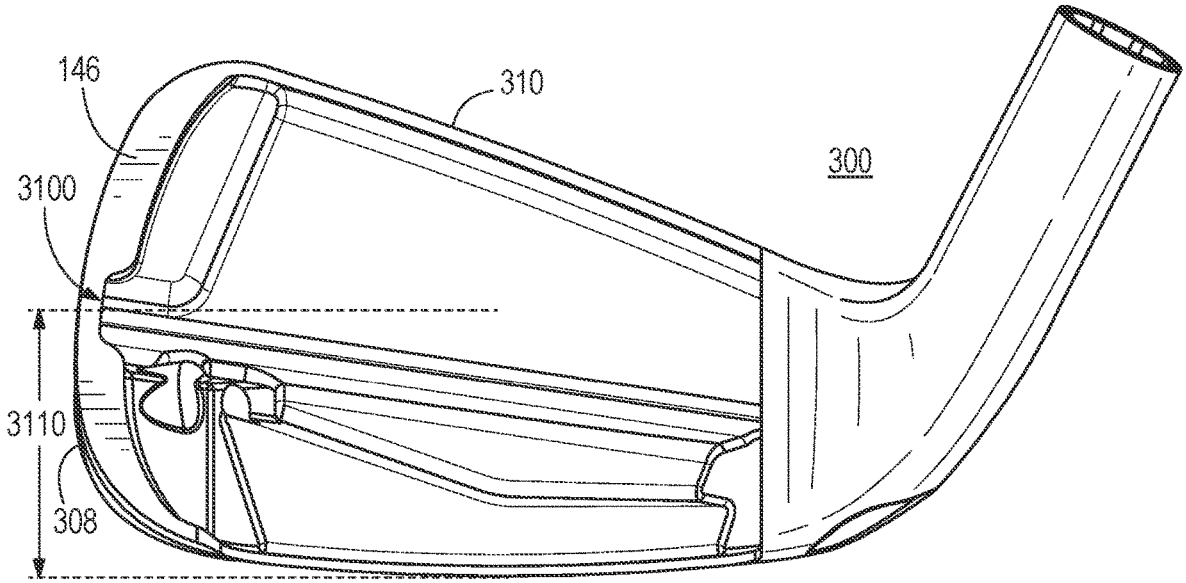
FIG. 19 illustrates a front-cross sectional view of the golf club head of FIG. 17, highlighting the bending notch.

Referring now to FIGS. 17-19 in many embodiments, the rear body 330 of a golf club head 300 can comprise one or more dynamic lofting features. The one or more dynamic lofting features provide increased flexure of the rear body 330, particularly increasing the bending of the rear wall 340. The dynamic lofting features further serve to increase the dynamic loft of the club head 300 at impact. Dynamic loft refers to the increase or decrease in loft angle at impact due to the collision between the club head 300 and the golf ball. An increase in dynamic loft provides a higher launch without sacrificing ball speed. The dynamic loft of the club head 300 is influenced by the manner in which the rear wall 340 flexes in response to impact. In particular, the greater the rear wall 340 is able to rotate rearward with respect to the sole, the greater the dynamic loft increase. The dynamic lofting features serve to increase the club head dynamic loft by enabling an upper portion of the rear wall 340 to bend rearward at impact. In many embodiments, the one or more dynamic lofting features can comprise a flexure hinge and/or an internal bending notch. The third embodiment of the club head 300 is substantially similar to club head 100, but for the inclusion of the dynamic lofting features. Club head 300 can comprise similar features to club head 100, labeled with a 300 numbering scheme (i.e., club head 300 comprises a rear body 330, a faceplate 350, etc.).

A. Flexure Hinge

As illustrated in FIGS. 17, 18A, and 18B, the club head 300 comprises a flexure hinge 3000 extending in a heel-to-toe direction along the rear wall 340. The club head 300 comprising the flexure hinge 3000 can encourage rotational bending of the rear wall 340 about the sole to increase the dynamic loft of the golf club head 300.

Referencing FIGS. 17, 18A, and 18B of the drawings, the rear wall 340 can be bifurcated in a lengthwise direction by the flexure hinge 3000. The flexure hinge 3000, therefore, defines a rear wall upper portion 380 and a rear wall lower portion 388. The rear wall upper portion 380 can be defined between the top rail 310 and the flexure hinge 3000, and the rear wall lower portion 388 can be defined between the sole and the flexure hinge 3000.

As discussed above, the flexure hinge 3000 extends in a heel-to-toe direction along the rear wall 340. The flexure hinge 3000 comprises a hinge heel end 3010 and a hinge toe end 3012 opposite the hinge heel end 3010. In some embodiments, as illustrated in FIG. 19, the flexure hinge 3000 can extend the entire heel-to-toe length of the rear wall 340 such that the hinge heel end 3010 is located proximate the heel side periphery 322, and the hinge toe end 3012 is located proximate the toe side periphery 324. In other embodiments, the flexure hinge 3000 may not extend the entire heel-to-toe length of the rear wall 340, such that at least one of the hinge heel end 3010 and the hinge toe end 3012 terminate in the middle of the rear wall 340, and are spaced away from the club head peripheries.

FIG. 18B illustrates a zoomed in cross sectional view of a golf club head 300 comprising the above flexure hinge 3000. As illustrated, the flexure hinge 3000 can comprise a top surface 3014, a bottom surface 3016, and a nadir 3020 forming a transition between the hinge top surface 3014 and the hinge bottom surface 3016. The hinge top surface 3014 and the hinge bottom surface 3016 can each be angled toward the front end 302 of the club head 300. In this orientation, the flexure hinge 3000 protrudes into the interior cavity 314 and the nadir 3020 defines the portion of the flexure hinge 3000 closest to the front end 302 of the club head 300. The flexure hinge 3000 strategically weakens a portion of the rear wall 340 by creating a groove in the rear wall 340 to promote bending in the area of the rear wall 340 that comprises the flexure hinge 3000. The flexure hinge 3000 allows the rear wall 340 to bend over the entire heel to toe length of the club head 300. In other words, the flexure hinge 3000 allows the rear wall upper portion 380 to bend rearward, about the sole, at impact. The flexure hinge 3000 increases the dynamic loft of the club head 300 and creates a club head 300 that stores a greater amount of spring energy to be transferred to the golf ball, increasing ball speed.

As discussed above, the flexure hinge 3000 protrudes into the interior cavity 314 relative to the adjacent surfaces of the rear wall 340. From a rear view, as illustrated in FIG. 19, the flexure hinge 3000 creates a groove recessed within the rear wall 340. In some embodiments (not shown), the groove can comprise a variable width such that the groove is wider closer to the heel end 306 than the toe end or wider closer to the toe end than the heel end 306. In many embodiments, such as the embodiment illustrated in FIG. 17, the groove can comprise a width that is substantially constant. The width of the groove can be determined by a flexure hinge height 3030, as described in further detail below.

In some embodiments, such as the embodiment of FIGS. 18A and 18B, the flexure hinge 3000 can comprise a generally semi-elliptical shape when viewed in cross-section. The semi-elliptical flexure hinge 3000 can comprise a top surface 3014, a bottom surface 3016, and a semi-elliptical nadir 3020. The semi-elliptical nadir 3020 can have a radius defining the curve of the hinge. In some embodiments the nadir 3020 can have a radius of curvature between 0.050 inch and 0.70 inch. For example, the nadir 3020 can have a radius of curvature of 0.050 inch, 0.055 inch, 0.060 inch, 0.065 inch, or 0.070 inch. In other embodiments, the flexure hinge 3000 can comprise a generally semi-circular shape, a triangular shape, a rectangular shape, an ovular shape, or any other suitable shape for allowing the rear wall 340 to flex and increase dynamic loft.

Referring to FIG. 18B, the flexure hinge 3000 can comprise a hinge width 3060 measured as the distance between the top surface 3014 and the bottom surface 3016, in a vertical direction. The hinge width 3060 can range from 0.050 inch to 0.150 inch. For example, the hinge width 3060 can be 0.050 inch, 0.060 inch, 0.070 inch, 0.080 inch, 0.090 inch, 0.100 inch, 0.110 inch, 0.120 inch, 0.130 inch, 0.140 inch, or 0.150 inch. In some embodiments, the hinge width 3060 can be between 0.050 inch and 0.060 inch, 0.060 inch and 0.070 inch, 0.070 inch and 0.080 inch, 0.080 inch and 0.090 inch, 0.090 inch and 0.100 inch, 0.100 inch and 0.110 inch, 0.110 inch and 0.120 inch, 0.120 inch and 0.130 inch, 0.130 inch and 0.140 inch, or 0.140 inch and 0.150 inch. As the flexure hinge width 3060 increases, the potential for bending increases.

The top surface 3014 and bottom surface 3016 of the flexure hinge 3000 can comprise a top surface depth 3040 and a bottom surface depth 3050. The top surface depth 3040 can be measured as the linear distance between a bottom edge of the upper portion 380 and the nadir 3020. The bottom surface depth 3050 can be measured as the linear distance between a top edge of the lower portion 388 and the nadir 3020. In some embodiments the top surface depth 3040 ranges from approximately 0.080 inch to approximately 0.150 inch. For example, the top surface depth 3040 can be 0.080 inch, 0.085 inch, 0.090 inch, 0.095 inch, 0.100 inch, 0.105 inch, 0.110 inch, 0.115 inch, 0.120 inch, 0.125 inch, 0.130 inch, 0.135 inch, 0.140 inch, 0.145 inch, or 0.150 inch. Likewise, in some embodiments, the bottom surface depth 3050 can range from approximately 0.120 inch to approximately 0.260 inch. For example, the bottom surface depth 3050 can be 0.120 inch, 0.130 inch, 0.140 inch, 0.150 inch, 0.160 inch, 0.170 inch, 0.180 inch, 0.190 inch, 0.200 inch, 0.210 inch, 0.220 inch, 0.230 inch, 0.240 inch, 0.250 inch, or 0.260 inch. In some embodiments, the top surface depth 3040 and the bottom surface depth 3050 vary from the hinge heel end 3010 to the hinge toe end 3012. For example, the bottom surface depth 3050 can increase from the hinge heel end 3010 to the hinge toe end 3012. In other embodiments, the top surface depth 3040 and bottom surface depth 3050 can be constant from the hinge heel end 3010 to the hinge toe end 3012.

As shown in FIG. 18, the flexure hinge 3000 can further comprise a hinge height 3030 measured as the vertical distance of the nadir 3020 from a ground plane 5000. The hinge height 3030 can be measured at any point along the heel-to-toe length of the flexure hinge 3000. In some embodiments, the flexure hinge 3000 comprises a hinge height 3030 that is constant across the heel to toe length of the flexure hinge 3000. In other embodiments the hinge height 3030 varies across the heel-to-toe length of the flexure hinge 3000. In some embodiments, the flexure hinge 3000 is located in a substantially low position of the club head 300.

Providing the flexure hinge 3000 substantially low on the rear wall 340 increases the amount the rear wall upper portion 380 bends rearward at impact. The rearward bending of the rear wall upper portion 380 is created by a torque applied about the flexure hinge 3000 by the force of impact. The lowering of the flexure hinge 3000 on the rear wall 340 provides a longer moment arm between the impact force and the flexure hinge 3000, increases the torque, and creates a greater rearward bend of the rear wall upper portion 380.

The embodiment of FIG. 19 illustrates a club head 300 with a varying hinge height 3030. Specifically, the hinge height 3030 increases linearly from the hinge heel end 3010 to the hinge toe end 3012. In many embodiments, the hinge height 3030 at the hinge toe end 3012 can range from 0.78 inch to 0.96 inch. For example, the hinge height 3030 at the hinge toe end 3012 can be 0.78 inch, 0.79 inch, 0.80 inch, 0.81 inch, 0.82 inch, 0.83 inch, 0.84 inch, 0.85 inch, 0.86 inch, 0.87 inch, 0.88 inch, 0.89 inch, 0.90 inch, 0.91 inch, 0.92 inch, 0.93 inch, 0.94 inch, 0.95 inch, or 0.96 inch. In some embodiments the hinge height 3030 at the hinge toe end 3012 can be between 0.78 inch and 0.80 inch, 0.80 inch and 0.82 inch, 0.82 inch and 0.84 inch, 0.84 inch and 0.86 inch, 0.86 inch and 0.88 inch, 0.88 inch and 0.90 inch, 0.90 inch and 0.92 inch, 0.92 inch and 0.94 inch, or 0.94 inch and 0.96 inch. In some embodiments, the hinge height 3030 at the hinge heel end 3010 can range from 0.15 inch to 0.28 inch. The hinge height 3030 at the hinge heel end 3010 can be 0.15 inch, 0.16 inch, 0.17 inch, 0.18 inch, 0.19 inch, 0.20 inch, 0.21 inch, 0.22 inch, 0.23 inch, 0.24 inch, 0.25 inch, 0.26 inch, 0.27 inch or 0.28 inch. In some embodiments, the hinge height 3030 at the hinge heel end 3010 can be between 0.15 inch and 0.17 inch, 0.17 inch and 0.19 inch, 0.19 inch and 0.21 inch, 0.21 inch and 0.23 inch, 0.23 inch and 0.25 inch, 0.25 inch and 0.27 inch, or 0.27 inch and 0.28 inch. The hinge height 3030 can increase linearly from the hinge heel end 3010 to the hinge toe end 3012. In other embodiments, the hinge height 3030 may vary non-linearly.

B. Bending Notch

As discussed briefly above, the club head 300 of the present disclosure can further comprise an internal bending notch 3100 that further increases the dynamic loft of the club head 300 at impact. The internal bending notch 3100 influences rotational bending of the rear wall upper portion 380 about the sole 312. FIG. 19 illustrates a front view of the interior cavity 314 of a club head 300 comprising a bending notch 3100 located in the toe end 308 of the golf club head 300. The internal bending notch 3100 can remove a region of material from the toe portion of the rear body 330. In many embodiments, such as the embodiment of FIG. 19, the internal bending notch 3100 is located approximately midway between the top rail 310 and sole to increase bending and energy storage potential of the golf club head 300.

Like the flexure hinge 3000, the bending notch 3100 creates a region of the club head 300 that is structurally weakened to promote bending of the rear wall 340 to increase the club head dynamic loft. The internal bending notch 3100 allows the rear wall upper portion 380 to bend rearward at impact to increase dynamic loft and elastic energy storage, providing higher ball speeds and an increased launch angle.

In many embodiments, the location of the bending notch 3100 can correspond to the location of the flexure hinge 3000. For example, in embodiments wherein the internal bending notch 3100 is located within the rear body toe portion 336, the internal bending notch 3100 can align with the location of the hinge toe end 3012. The bending notch 3100 and the flexure hinge 3000 can be located at corresponding locations such that the hinge toe end 3012 forms the exterior of the rear wall 340 at substantially the same location that the internal bending notch 3100 is positioned within the hollow interior cavity 314. Internal bending notch 3100 and the flexure hinge 3000 at corresponding locations allows the effects of each on the club head dynamic loft to be compounded.

Referring to FIG. 19, the bending notch 3100 can comprise a bending notch height 3110 measured as a percentage a height of the club head 300 measured from the sole 312 to the top rail 310. In the illustrated embodiment, the bending notch height 3110 is between approximately 8% to approximately 15% of the height of the club head 300 measured in a top rail-to-sole direction. For example, the bending notch height 3110 can be 8%, 9%, 10%, 11%, 12%, 13%, 14%, or 15% the club head height. In some embodiments, the bending notch height 3110 can range from 0.78 inch to 0.96 inch. For example, the bending notch height 3110 can be approximately 0.78 inch, 0.79 inch, 0.80 inch, 0.81 inch, 0.82 inch, 0.83 inch, 0.84 inch, 0.85 inch, 0.86 inch, 0.87 inch, 0.88 inch, 0.89 inch, 0.90 inch, 0.91 inch, 0.92 inch, 0.93 inch, 0.94 inch, 0.95 inch, or 0.96 inch. In some embodiments, the bending notch height 3110 can range from 0.78 inch to 0.80 inch, 0.80 inch to 0.82 inch, 0.82 inch to 0.84 inch, 0.84 inch to 0.86 inch, 0.86 inch to 0.88 inch, 0.88 inch to 0.90 inch, 0.90 inch to 0.92 inch, 0.92 inch to 0.94 inch, or 0.94 inch to 0.96 inch.

Together, the flexure hinge 3000 and bending notch 3100 provide the club head 300 with both an internal and external structure that are configured for an increase in dynamic loft and elastic energy storage. Specifically, the flexure hinge 3000 allows the club head 300 to bend over the entire length of the club head 300 in the heel to toe direction regardless of the impact location. Further, the internal bending notch 3100 increases flexure in the toe portion 336, where a significant amount of the club head mass is located.

Club head 300 comprising both the flexure hinge 3000 and the bending notch 3100 can increase the dynamic loft of the club head 300 at impact by at least 0.5 degrees in comparison to a similar club head devoid of a flexure hinge and internal bending notch. In some embodiments, the dynamic lofting features can increase the dynamic loft of the club head 300 at impact by more than 0.25 degrees, more than 0.30 degrees, more than 0.35 degrees, more than 0.40 degrees, more than 0.45 degrees, more than 0.50 degrees, more than 0.55 degrees, more than 0.60 degrees, more than 0.65 degrees, more than 0.70 degrees, more than 0.75 degrees, more than 0.80 degrees, more than 0.85 degrees, more than 0.90 degrees, more than 0.95 degrees, or more than 1.00 degree. Such an increase in dynamic loft provides increased launch angle without sacrificing ball speed. In some embodiments, the dynamic lofting features can increase the dynamic loft of the club head 300 at impact between 0.25 degrees and 0.30 degrees, 0.30 degrees and 0.35 degrees, 0.35 degrees and 0.40 degrees, 0.40 degrees and 0.45 degrees, 0.45 degrees and 0.50 degrees, 0.50 degrees and 0.55 degrees, 0.55 degrees and 0.60 degrees, 0.60 degrees and 0.65 degrees, 0.65 degrees and 0.70 degrees, 0.70 degrees and 0.75 degrees, 0.75 degrees and 0.80 degrees, 0.80 degrees and 0.85 degrees, 0.85 degrees and 0.90 degrees, 0.90 degrees and 0.90 degrees, or 0.95 degrees and 1.00 degrees. The increase in dynamic loft increases the amount of spring energy stored in the club head 3000.

The flexure hinge 3000 and/or bending notch 3100 can be combined with any of the various L-shaped faceplate 150 geometries described above including a sole return 154, a toe extension 168, a top rail extension 170, or any combination thereof. The flexure hinge 3000 and/or bending notch 3100 can also be combined with rear body 130 geometry or feature described either above or below, including a sole ledge 156, an angled weight pad 1000, a weight pad 2000 comprising an extension 2050, a heel mass 147 and/or toes mass 149, a lower interior undercut 190, an upper interior undercut 195, a rear exterior cavity 198, an external flexure hinge 3000, an internal bending notch 3100, an internal welding rib 179, or any combination thereof.

V. Other Features

A. Filled Interior Cavity

Figure 20:
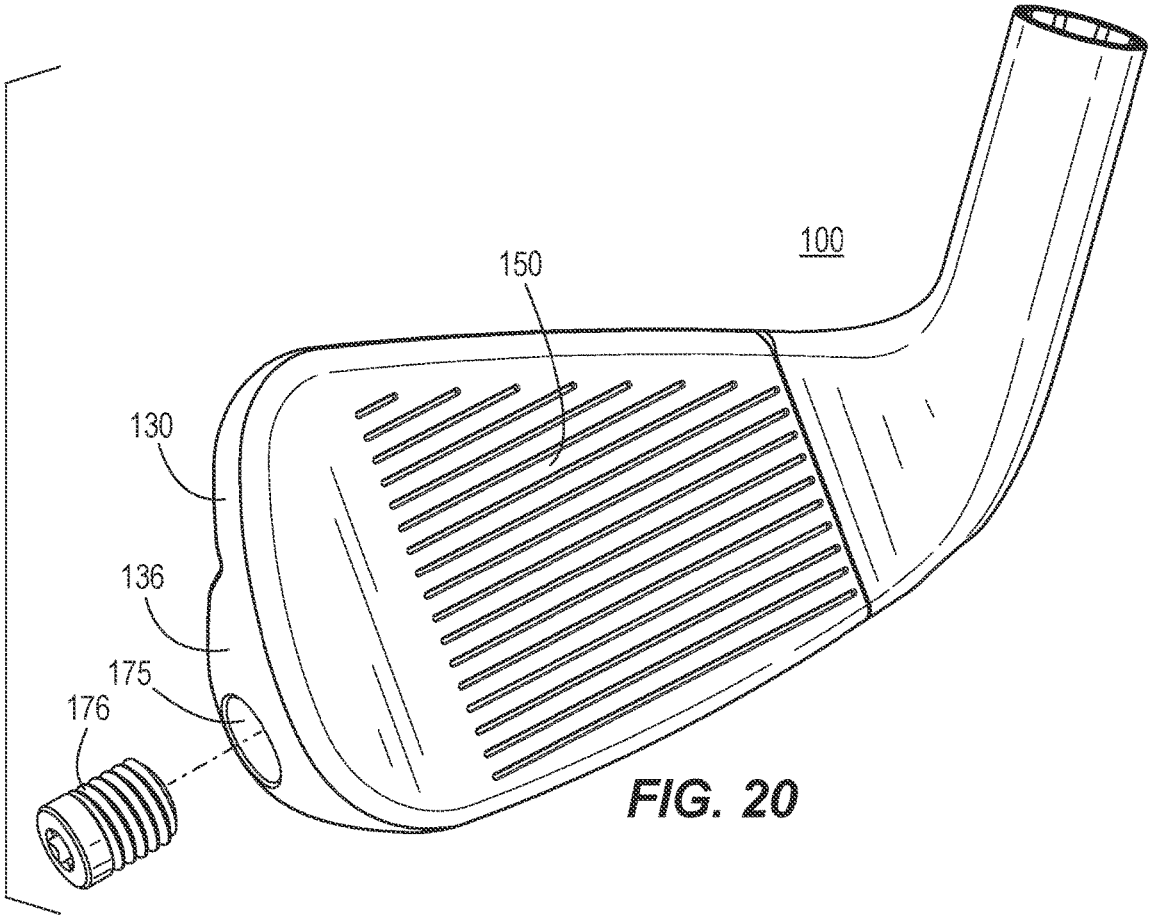
FIG. 20 illustrates a toe-side perspective view of a golf club head comprising a toe port.
Figure 21:
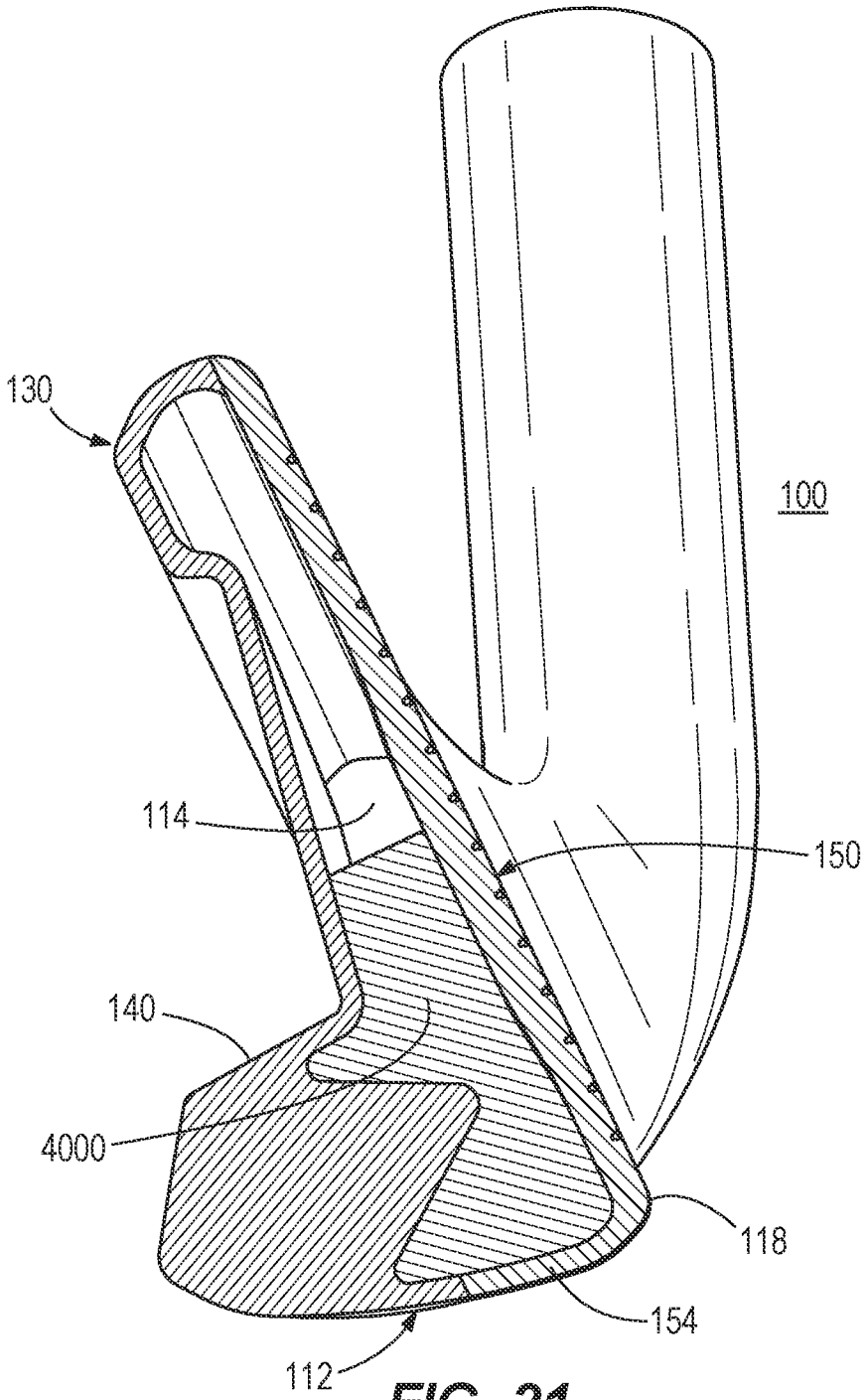
FIG. 21 illustrates a toe-side cross-sectional view of a golf club head comprising a filled interior cavity.

In many embodiments, the hollow interior cavity 114 of the club head 100 according to the above embodiments comprising an L-shaped faceplate 150, dynamic lofting features, a rear wall 140 with a rear exterior cavity 198, or any combination thereof can further comprise a filler material 4000 to damp vibrations occurring at impact and improve the sound and feel characteristics of the club head 100. Referring to FIG. 21, the filler material 4000 can be disposed or applied to the interior cavity 114 of the club head 100. In some embodiments, the filler material 4000 can be applied as a paint to the entire interior surface or selected locations of the interior surface. In other embodiments, the filler material 4000 can be injected into the interior cavity 114, for example, but not limited to, through a weight port 175 or an opening that allows access to the interior surface of the club head 100 to fill a volume percentage of the interior cavity 114, as illustrated in FIG. 20. In some embodiments, the filler material 4000 can fill substantially the entire interior cavity 114

The filler material 4000 can be disposed within the interior cavity 114. In some embodiments, the interior cavity 114 can be fully filled with the filler material 4000. In other embodiments, the interior cavity 114 can be partially filled with the filler material 4000. The filler material 4000 can be disposed on any interior surface of the club head 100 that defines or resides within the interior 114. The filler material 4000 can be disposed on the strike face back surface 156, the sole return interior surface 161, the interior surface of the top rail 110, the interior surface of the heel portion, the interior surface of the rear wall 140, one or more surfaces of the weight pad 1000, the interior surface of the sole return 154, or any combination thereof.

The filler material 4000 can fill part of the interior cavity 114. In some embodiments, the filler material 4000 fills substantially the entire volume of the interior cavity 114. In some embodiments the filler material 4000 can fill greater than 5%, greater than 10%, greater than 20%, greater than 30%, greater than 40%, greater than 50%, greater than 60%, greater than 70%, greater than 80%, or greater than 90% of the volume of the interior cavity 114. In other embodiments, the filler material 4000 can fill less than 90%, less than 80%, less than 70%, less than 60%, less than 50%, less than 40%, less than 30%, less than 20%, less than 10%, or less than 5% of the volume of the interior cavity 114. In other embodiments the filler material can fill between 5% and 10%, 10% and 20%, 20% and 30%, 30% and 40%, 40% and 50%, 50% and 60%, 60% and 70%, 70% and 80%, 80% and 90%, 90% and 100%, 5% and 20%, 10% and 30%, 20% and 40%, 30% and 50%, 40% and 60%, 50% and 70%, 60% and 80%, 70% and 90%, or 90% and 100%. The amount of filler material 4000 can be selected to provide acoustic and/or performance benefits to the club head 100.

In some embodiments, the filler material 4000 can be disposed on the strike face back surface 156. In some embodiments, the filler material 4000 can be disposed on the entire strike face back surface 156. In other embodiments, the filler material 4000 can be disposed on only a portion of the strike face back surface 156, such as a top region located near the top rail 110, a bottom region located near the sole 112, a toe region located near the toe end 108, a heel region located near the heel end 106, a center region located near the center of the strike face 116, or any combination thereof. In some embodiments, the filler material 4000 can cover the entire strike face back surface 156. In other embodiments, the filler material 4000 can cover greater than 5%, greater than 10%, greater than 20%, greater than 30%, greater than 40%, greater than 50%, greater than 60%, greater than 70%, greater than 80%, or greater than 90% of the strike face back surface 156. In other embodiments, the filler material 4000 can cover less than 90%, less than 80%, less than 70%, less than 60%, less than 50%, less than 40%, less than 30%, less than 20%, less than 10%, or less than 5% of the strike face back surface 156. In other embodiments the filler material can cover between 5% and 10%, 10% and 20%, 20% and 30%, 30% and 40%, 40% and 50%, 50% and 60%, 60% and 70%, 70% and 80%, 80% and 90%, 90% and 100%, 5% and 20%, 10% and 30%, 20% and 40%, 30% and 50%, 40% and 60%, 50% and 70%, 60% and 80%, 70% and 90%, or 90% and 100%. The amount of filler material 4000 coverage on the strike face back surface 156 can be selected to provide acoustic and/or performance benefits to the club head 100.

As described above, the filler material 4000 can be injected into the interior cavity 114 via a weight port 175. In many embodiments, as illustrated by FIG. 21, the club head 100 comprises a weight port 175 located on the toe portion of the rear body 130 (i.e., on the periphery of the club head 100). The weight port 175 can form an opening the provides access to the interior cavity 114. After welding of the rear body 130 and the faceplate 150, the filler material 4000 can be injected through the opening formed by the weight port 175. The interior cavity 114 can then be sealed off by coupling a weight member 176 within the weight port 175 and closing off the opening. In many embodiments, the weight member 176 and the weight port 175 are correspondingly threaded to allow for convenient and secure coupling of the weight member 176 within the weight port 175.

In many embodiments, the filler material 4000 is a polymer. The polymer can comprise a thermoplastic, a thermoplastic elastomer, polyurethane, ethylene, vinyl acetate, ethylene vinyl acetate (EVA), polyolefin copolymer, styrene, styrene-butadiene, any other suitable polymer material, or any combination thereof. In other embodiments, the filler material 4000 can comprise an elastomer, a polyurethane elastomer, a silicone, a silicone elastomer, a rubber, or a vulcanized natural rubber latex. In other embodiments still, the filler material 4000 can be an epoxy, a resin, an adhesive, a polyurethane adhesive, a glue, or any other suitable adhesive. For example, the filler material 4000 can be a polyurethane adhesive such as Gorilla Glue (Gorilla Glue Company, Cincinnati Ohio). In another example, the filler material 4000 can be a polyurethane elastomer such as Freeman 1040 (Freeman Manufacturing & Supply Company, Avon Ohio), or a polyurethane based thermoplastic elastomer such as Freeman 3040 (Freeman Manufacturing & Supply Company, Avon Ohio).

The filler material 4000 can be useful in attenuating vibrations that occur in the club head 100 at impact with a golf ball. The inclusion of the filler material 4000 can damp (i.e., reduce the amplitude of) dominant vibrations that contribute to undesirable sound or feel. In some embodiments, the filler material 4000 can be located at targeted locations corresponding to the location of dominant vibrations in order to efficiently damp such vibrations. The damping of vibrations in the club head 100 by inclusion of the filler material 4000 creates a quieter, shorter sound at impact that is more pleasing to the human ear, as well as a soft feel that is comfortable for the player swinging the golf club.

In some embodiments, in addition to providing vibration damping benefits, the filler material 4000 can also contribute to increased performance. For example, in some embodiments, the filler material 4000 can comprise desirable rebounding properties that create a spring effect on the strike face back surface 156 at impact. The spring effect created by the filler material 4000 can lead to increased energy transfer between the strike face 116 and the golf ball, leading to higher ball speeds and greater shot distances.

In some embodiments, the filler material 4000 can provide reinforcement to the back of the strike face 116 or any other portion of the club head 100. The filler material 4000 can allow the strike face 116 or other portions of the club head 100 to be thinned without sacrificing structural integrity. Combining a thinner strike face 116 with the rebounding properties of the filler material 4000 allows for increased flexure in the faceplate 150 with greater "bounce back" at impact, leading to a maximization of energy transfer and ball speed.

In many embodiments, it is desirable for the filler material 4000 to be lightweight (i.e., comprise a low density and low mass in relation to the overall mass of the club head 100). The lightweight filler material 4000 can provide vibration damping benefits to the club head 100 to improve sound and feel, while affecting the mass properties of the club head 100 that influence performance (i.e., MOI and CG position) a negligible amount. The mass of the filler material 4000 can be less than 20 grams so as to not negatively impact the mass properties of the club head 100. In some embodiments, the filler material 4000 comprises a mass less than 18 grams, less than 16 grams, less than 14 grams, less than 12 grams, less than 10 grams, less than 8 grams, less than 6 grams, less than 4 grams, less than 2 grams, or less than 1 gram. In some embodiments, the filler material 4000 comprises a mass between 1 gram and 5 grams, between 5 grams and 10 grams, between 10 grams and 15 grams, or between 15 grams and 20 grams. In some embodiments, the mass of the filler material 4000 can be 1, 2, 3, 4, 5, 5.5, 6, 6.5, 7, 7.5, 8, 8.5, 9, 9.5, 10, 10.5, 11, 11.5, 12, 12.5, 13, 14, 15, 16, 17, 18, 19, or 20 grams. The mass of the filler material 4000 can be selected to provide a low density and low mass filler material 4000 that provides acoustic and/or performance benefits to the club head 100.

As discussed above, the combination of any of the L-shaped faceplate geometries described above including a sole return, a toe extension, a top rail extension, or any combination with any of the various rear body features or geometries described herein including a sole ledge, an angled weight pad, a weight pad comprising an extension, a heel mass and/or toes mass, a lower interior undercut, an upper interior undercut, a rear exterior cavity, an external flexure hinge, an internal bending notch, an internal welding rib, filler material or any combination thereof result in a high performance club head. The combination of the various features listed above produces a club head with high amounts of flexure and increased internal energy at impact, resulting in increased ball speeds.

METHOD

The various embodiments of the golf club head described herein can be manufactured by various methods. As discussed above, the golf club head comprises at least a rear body and an L-shaped faceplate. Different embodiments of each feature can be combined to form numerous variations of the golf club head. The method of manufacture can vary for different variations of the golf club head. Described below are example methods of manufacturing the golf club head.

The method of manufacturing a golf club head comprising an L-shaped faceplate can comprise (1) providing a rear body, (2) providing a faceplate, and (3) coupling the faceplate to the rear body, or any step combination provided above.

Providing the rear body can comprise forming a top rail portion, a sole portion, a toe portion, and a heel portion that define a rear body opening for receiving the faceplate. The rear body can further comprise a plurality of welding surfaces that extend around a perimeter of the rear body opening and provide an interface for the faceplate and the rear body to be coupled together. The rear body can further comprise a sole ledge for receiving the sole return. In some embodiments, the rear body can further comprise a weight pad that projects forward from the sole portion. In some embodiments, the rear body can further comprise one or more dynamic lofting features. In providing the rear body, the portions of the rear body can be integrally cast.

Providing the face plate can comprise forming a strike face portion and a sole return that wraps around the leading edge to form a portion of the sole. The faceplate can comprise a toe extension and a top rail extension. In providing that faceplate, the faceplate can be formed by a machining and forming process.

Coupling the faceplate to the rear body can comprise connecting the faceplate to the rear body at the welding surfaces. The sole ledge can receive the sole return, and the weight pad can overhang a portion of the sole return. The faceplate can be welded to the rear body at the welding surfaces. Forming the rear body and the faceplate separately can allow the rear body and the faceplate to be formed from different materials. Further, forming the rear body and the faceplate separately can allow the rear body and the faceplate to be formed using different methods. For example, the rear body can be cast, and the faceplate can be forged.

EXAMPLES

I. Example 1: Comparison of Faceplate Performance Results

Further described herein is a comparison of performance results between multiple crossover-type club heads that had different faceplate constructions. The results compared the effects that the faceplate size and shaping had on performance and durability. The leading edge composition, the location of the faceplate weld line, and the faceplate surface area were varied throughout the exemplary club heads. As discussed above, the leading edge of the club head is a high-stress region that is typically formed from a rigid material. The results demonstrated the effects of forming the leading edge from a high-strength material rather than the rear body material. Further, the weld line limits the ability of the faceplate to flex. The results further demonstrated the effects of moving the weld line closer to the club head periphery, in comparison to a traditional club head. The faceplate surface area correlates to the spring-like effect of the faceplate. The results further demonstrated the effects of increasing the faceplate surface area. The faceplate constructions of the club heads are described in further detail below.

A. First Exemplary Club Head

The first exemplary club head comprised an L-shaped faceplate (hereafter referred to as "the first example faceplate") that formed the entire striking surface. The first example faceplate comprised a sole return, a toe extension, and a top rail extension, similar to club head 100 shown in FIG. 1. The first example faceplate extended to the periphery of the club head and formed a portion of the sole. Therefore, the leading edge was formed from the first example faceplate material. The weld line was located near the periphery of the club head. The first example faceplate was laser welded to the rear body. The first exemplary club head comprised a negligible amount of filler material. The first control club head comprised a faceplate that had both a different geometry and a different weld type.

The first control club head comprised a faceplate (hereafter referred to as "the first control faceplate") that did not form the entire striking surface, nor a portion of the sole. The first control faceplate was devoid of a sole return, a toe extension, and a top rail extension (not shown). The first control faceplate did not extend to the club head periphery and did not form a portion of the sole. Instead, the first control club head included a stepped-transition region at the leading edge of the club head. Therefore, the leading edge was formed from the rear body material. The weld line was located around the perimeter of the strike face. The first control faceplate was plasma welded to the rear body. The first control faceplate represented a traditional faceplate insert, where the faceplate does not form a portion of the sole.

The first control faceplate differed in geometry from the first example faceplate, in which the faceplate included a sole return. The first example faceplate had a larger surface area than the first control faceplate. The first exemplary club head had a leading edge formed from the first example faceplate material, and the first control club head had a faceplate formed from the main body material. The first example faceplate exemplified performance and durability benefits over the first control faceplate, as discussed in further detail below.

1. Performance Testing

The performance tests measured the ball speeds, launch angles, spin rates, and carry distance of each faceplate. An automated performance test used a golf swing apparatus to capture performance data of the club head under regular conditions. The results indicated the performance of each faceplate near a low-center region, located just below the center of the faceplate.

The first exemplary club head demonstrated improved performance benefits over the first control club head. The comparison between these two club heads exemplified the impact of increasing the faceplate surface area as forming the leading edge from the faceplate material. The first exemplary club head had a faceplate including a sole return and a larger faceplate surface area, in comparison to the first control club head. Table 1 below indicates the performance improvements of the first exemplary club head over the first control club head. Ball speed was measured in miles per hour, the carry distance was modeled in yards.

TABLE 1

| | First Control Club Head | First Exemplary Club Head | Difference |
|---|---|---|---|
| Construction | Faceplate insert, no sole return, no toe extension, no top rail extension | Faceplate included a toe extension, a top rail extension, and a sole return | — |
| Surface Area ($in^2$) | 2.74 | 5.23 | +2.49 $in^2$ |
| Ball Speed (mph) | 133.7 | 136.4 | +2.7 mph |
| Carry Distance (yds) | 216.7 | 218.4 | +1.7 yds |

Referring to Table 1 above, the first exemplary club head demonstrated improvements over the first control club head on low-center hits. The first control club head demonstrated ball speeds off low-center hits of 133.7 mph, while the first exemplary club head demonstrated ball speeds off low-center hits of 136.4 mph. The first exemplary club head increased ball speed on low-center hits by 2.7 mph, compared to the first control club head. The increase in ball speed translated to an additional 1.7 yards of carry distance. The results from the automated performance test were reinforced by the results from a player performance test, which captured data from shots by actual players. The results of the player performance test are indicated in Table 2 below.

TABLE 2

| | Control Club Head | First Exemplary Club Head | Difference |
|---|---|---|---|
| Ball Speed Hits (mph) | 137.3 | 139.3 | +2 |

Referring to Table 2 above, the results from the player performance test further demonstrate the improvement of the first exemplary club head over the first control club head. The first exemplary club head increased ball speed by 2 mph, compared to the first control club head.

The performance improvements of the first exemplary club head, as indicated above, were attributed to the faceplate geometry. The sole return was formed from the first example faceplate material, which allowed the leading edge (or low-center region) to be thinner and more flexible. The sole return allows increased flexing near the leading edge of the faceplate. The faceplate also had a larger surface area than the control faceplate as it extended to the top rail and toe side periphery. The first example faceplate was 2.49 $in^2$ lager than the first control faceplate. The increased faceplate surface are required the weld line to be moved further toward the rear body. The weld line can inhibit flexing, so moving the weld line closer to the rear body further increased faceplate flexure.

The first example faceplate material comprised a higher strength than the rear body material. The increased flexing exaggerated the spring-like effect of the first example faceplate, thereby transferring more energy from the faceplate to the golf ball. Therefore, the combination of the sole return and the extended perimeter allowed the first example faceplate to flex more, which produced faster ball speeds. The first example faceplate material was also stronger than the rear body material. As a result, the first example faceplate construction also improved the durability of the first exemplary club head, as discussed in further detail in the durability testing section below.

2. Durability Testing

The durability test measured the number of hits that the club heads could withstand before failure. In the durability test, the club heads were subject to high velocity golf ball impacts by using an air cannon apparatus. Table 3 below indicates the results of the durability test. Three samples of each club head type were tested. The data from the three samples of the "first exemplary club heads" and the three samples of the "first control club heads" was then averaged. The "Hits Until Failure" row indicates the average number of golf ball impacts that each club head experienced before failure. The "Minimum Hits Until Failure" row indicates the worst-performing sample of each club head type which experienced the minimum number of impacts before failure. All values in Table 3 are in number of golf balls.

TABLE 3

| | First Control Club Head | First Exemplary Club Head | Difference | Percent Change |
|---|---|---|---|---|
| Average Hits Until Failure | 1584.2 | 2564 | +979.8 | 61.8% |
| Minimum Hits Until Failure | 1000 | 2292 | +1292 | 129.2% |

Referring to Table 3 above, the first exemplary club head demonstrated a significant increase in durability. The first control club head was able to withstand an average of 1584.2 hits, while the first exemplary club head was able to withstand an average of 2564 hits. On average, the first exemplary club head withstood 61.8% more hits than the first control club head. The first control club head experienced a minimum of 1000 hits before failure, while the first exemplary club head experienced a minimum of 2292 hits before failure. The worst performing sample of the first exemplary club head experienced 129.2% more hits than the worst performing sample of the first control club head. Golf club head failure is commonly observed near the club head leading edge. The durability improvements demonstrated by the first exemplary club head were attributed to the sole return, which placed a high-strength material near the leading edge.

B. Second Exemplary Club Head

The second exemplary club head comprised an L-shaped faceplate (hereafter referred to as "the second example faceplate") that did not form the entire striking surface. The second example faceplate comprised a sole return but was devoid of a toe extension, and a top rail extension, similar to the club head shown in FIG. 8. Therefore, the second example faceplate formed a portion of the sole (the leading edge was formed from the faceplate material), but the faceplate did not extend all the way to the club head periphery on the toe end and/or the top rail. The weld line was located around the perimeter of the strike face. The second example faceplate was plasma welded to the rear body. The second exemplary club head comprised a negligible amount of filler material. The second example faceplate was similar to the first example faceplate from Example 1, but for the difference in surface area and the type of weld that was used to secure the second example faceplate to the rear body.

The second control club head was similar to the first control club head from Example 1. The second control club head comprised a faceplate (hereafter referred to as "the second control faceplate") that did not form the entire striking surface, nor a portion of the sole. The second control club head represented a club head that comprised a traditional faceplate insert.

The second control faceplate differed in geometry from the second example faceplate, in which the faceplate included a sole return. Further, the second example faceplate had a larger surface area than the second control faceplate. The second exemplary club head had a leading edge formed from the second example faceplate material, and the second control club head had a faceplate formed from the main body material. The second example faceplate exemplified performance and durability benefits over the second control faceplate, as discussed in further detail below.

3. Performance Testing

The performance test was conducted similarly to the performance test of Example 1. The second exemplary club head demonstrated improved performance benefits over the second control club head. Similar to Example 1, the comparison between the second exemplary club head and the second control club head exemplified the impact of increasing the surface area of the faceplate as well as forming the leading edge from the faceplate material. Table 4 below indicates the performance improvements of the second exemplary club head over the second control club head. Ball speed was measured in miles per hour, the carry distance was modeled in yards.

TABLE 4

| | Second Control Club Head | Second Exemplary Club Head | Difference |
|---|---|---|---|
| Construction | Faceplate insert, no sole return, no toe extension, no top rail extension | Faceplate included a sole return, no toe extension, no top rail extension | — |
| Surface Area ($in^2$) | 2.74 | 3.99 | +1.25 |
| Ball Speed (mph) | 131.1 | 132.1 | +1.0 mph |
| Carry Distance (yds) | 213.9 | 215.6 | +1.7 yds |

Referring to Table 4 above, the second exemplary club head demonstrated improvements over the second control club head on low-center hits. The second control club head demonstrated ball speeds on low center hits of 131.1 mph, while the second exemplary club head demonstrated ball speeds off low center hits of 132.1 mph. The second exemplary club head increased ball speed on low-center hits by 1 mph, compared to the second control club head. The increase in ball speed translated to an additional 1.7 yards of carry distance.

The performance improvements of the second exemplary club head, as indicated above, are attributed to the faceplate geometry. Similar to the first exemplary club head from Example 1, the sole return of the second exemplary club head was formed from the second example faceplate material which allowed the leading edge (or low-center region) to be thinner and more flexible. The surface area of second example faceplate was 1.25 $in^2$ larger than the second control faceplate. The combination of the sole return and the larger strike face increased flexure in the faceplate, thereby increasing ball speed and carry distance. The second example faceplate material was also stronger than the rear body material. As a result, the second example faceplate construction also improved the durability of the second exemplary club head, as discussed in further detail in the durability testing section below.

4. Durability Testing

Table 5 below indicates the results of the durability test. Similar to Example 1, three samples of each club head type were tested. The data from the three samples of the "second exemplary club heads" and the three samples of the "first control club heads" was then averaged. The "Hits Until Failure" row indicates the average number of golf ball impacts that each club head experienced before failure. The "Minimum Hits Until Failure" row indicates the worst-performing sample of each club head type which experienced the minimum number of impacts before failure. All values in Table 5 are in number of golf balls.

TABLE 5

| | Second Control Club Head | Second Exemplary Club Head | Difference | Percent Change |
|---|---|---|---|---|
| Average Hits Until Failure | 1584.2 | 2307.7 | +723.5 | 45.6% |
| Minimum Hits Until Failure | 1000 | 2000 | +1000 | 100% |

Referring to Table 5 above, the second exemplary club head demonstrated a significant increase in durability. The second control club head was able to withstand an average of 1584.2 hits, while the second exemplary club head was able to withstand an average of 2307.7 hits. On average, the second exemplary club head withstood 45.6% more hits than the second control club head. The second control club head experienced a minimum of 1000 hits before failure, while the second exemplary club head experienced a minimum of 2000 hits before failure. The worst performing sample of the second exemplary club head experienced 129.2% more hits than the worst performing sample of the second control club head. Golf club head failure is commonly observed near the club head leading edge. The durability improvements demonstrated by the second exemplary club head were attributed to the sole return, which placed a high-strength material near the leading edge.

The first and second exemplary club heads increased ball speed and carry distance over their respective control club heads. Further, the first exemplary club head increased ball speed and carry distance over the second exemplary club head. The exemplary club heads also demonstrated a similar improvement to durability over their respective control club heads. Notwithstanding test conditions and the type of weld used to secure the faceplate, the exemplary club heads demonstrated improved performance and durability. Therefore, it is apparent that the faceplate having the sole return and larger surface area improves performance in comparison to a similar club head devoid of a sole return.

II. Example 2: Finite Element Analysis (FEA)

Further described herein is a comparison of a finite element analysis performed on two crossover-type club heads having different sole ledge geometries. The finite element analysis (FEA) simulated the ball speeds of each club head given their different constructions. As discussed above, the sole ledge is located immediately forward of the weight pad and forms a portion of the sole. The sole ledge provides a surface for the faceplate to easily be attached to the rear body. The purpose of the FEA comparison was to demonstrate the similar performance of a golf club head comprising a sole ledge over a golf club head devoid of a sole ledge. Further, the discussion below illustrates the ease of manufacturing provided by a club head that includes a sole ledge.

The sample club heads included similar faceplates, similar to the L-shaped faceplate illustrated in FIG. 6. The faceplates included a sole return, a toe extension, and top rail extension. Further, the sole return depth was the same in each sample club head. The sample club heads also included a similar center of gravity (CG) location. To achieve a similar CG location in the control club head, mass was added near the top rail on the toe end of the club head. The faceplate construction and CG location were kept constant to isolate the difference in performance caused by the different sole ledge constructions.

The control club head comprised a rear body having an overhanging weight pad similar to the weight pad illustrated in FIG. 12. The weight pad included a projection that extended toward the faceplate and overhung the sole return. The control club head was devoid of a sole ledge. Instead, the sole return extended into the weight pad such that the weight pad overlapped the rearmost portion of the sole return. The faceplate sole perimeter edge and a portion of the faceplate interior surface contacted the weight pad. The weight pad formed an upper and rear boundary of the sole return.

The exemplary club head comprised a rear body having an overhanging weight pad similar to the weight pad illustrated in FIG. 10. The overhanging weight pad was angled with respect to the sole and overhung the sole return. The rear body further comprised a sole ledge similar to the sole ledge illustrated in FIG. 13, where the sole ledge front surface received the faceplate sole perimeter edge. Further, the weight pad did not contact the sole return and did not form an upper boundary of the sole return. The sole ledge comprised a similar thickness to the sole return.

The control and exemplary club heads included different weight pad and sole ledge constructions. The control club head included a weight pad with a projection, and the exemplary club head included an angled weight pad. The control club head did not include a sole ledge, and the weight pad contacted the sole return of the faceplate. In contrast, the exemplary club head included a sole ledge that prevented the weight pad from contacting the sole return of the faceplate. In comparison to the exemplary club head, the effective depth of the sole return of the control club head was decreased by the depth of the weight pad that overlapped the sole return. The results discussed below compare the effects that the sole ledge geometry had on performance.

The FEA analysis simulated the internal energy of the sample club heads (measured in pound-force inch). The internal energy was the amount of elastic energy stored and released in the club head by a golf ball impacting and bending the strike face. The difference in ball speed (measured in miles per hour) was derived from the difference in internal energy. The sample club heads were tested at a swing speed of 85 mph to simulate real-world swing conditions. The results indicated the performance of each faceplate near a center of the faceplate.

TABLE 6

| | Control Club Head | Exemplary Club Head |
|---|---|---|
| Internal Energy (lbf-in) | 55.82 | 56.21 |

Referring to Table 6 above, the control club head demonstrated an internal energy of 55.82 lbf-in, and the exemplary club head demonstrated an internal energy of 56.21 lbf-in. The exemplary club head increased internal energy by 0.39 lbf-in over the control club head, which translated to a 0.05 mph increase in ball speed. The control and exemplary club heads performed similarly.

Although the control and exemplary club heads performed similarly, the exemplary club head provided manufacturing advantages over the control club head. The exemplary club head did not lose performance over the control club head, and the exemplar club head is cheaper and easier to manufacture than the control club head. As discussed above, the exemplary club head included a sole ledge that received the sole perimeter edge of the faceplate. The control club head did not include a sole ledge, and instead, the weight pad received the faceplate near the sole. The exemplary club head required only a single surface of the sole return (the sole perimeter edge) to be attached to the sole ledge. In contrast, the control club required two surfaces of the sole return be attached to the rear body (the sole perimeter edge and a portion of the interior surface). Therefore, the rear body of the control club head required that two surfaces were prepared to receive the sole return versus the exemplary club head, which only required one surface to be prepared. The preparation of additional surfaces added steps to the manufacturing process, which increased the cost of manufacturing the control club head.

Further, the control club head included a more complex receiving geometry than the exemplary club head. Each club head has a margin of error at the interface of the sole return and the rear body. The sole ledge allowed for a larger margin of error when aligning the sole return with the rear body because only one surface of the sole return must align with the rear body. In contrast, the control club head required two surfaces of the sole return to align with the rear body. Therefore, the control club head required a more precise fit between the sole return and the rear body, which decreased the allowable margin of error at the interface. Due to the decrease in the margin of error, the control club head required that the sole return was formed within extremely tight tolerances. Therefore, the control club head was more difficult to manufacture than the exemplary club head.

As discussed above, the thicknesses of the sole return and sole ledge were similar. These similar thicknesses allowed an even weld bead to be formed on either side of the faceplate it is welded to the rear body. In contrast, the weight pad of the control club head was positioned above the sole return and did not allow an even weld bead to be formed. Therefore, the samples performed similarly, but the exemplary club head was cheaper and easier to manufacture than the control club head.

III. Example 3: L-cup Depth

Further described herein is comparison of a finite element analysis performed on two crossover-type club heads having different sole return geometries. The finite element analysis (FEA) simulated the ball speeds of each club head given their different constructions. As discussed above, maximizing the sole return depth increases the flexure of the faceplate. Therefore, the purpose of the FEA comparison was to demonstrate the performance improvements that resulted from maximizing the sole return depth.

The control club head comprised a control L-shaped faceplate similar to the faceplate illustrated in FIGS. 8 and 9. The control faceplate included a control sole return that wrapped over the leading edge and formed a portion of the sole. The control sole return depth was 0.30 inch. The control club head further comprised a control rear body having a control sole ledge that received the control sole return.

The exemplary club head comprised an exemplary L-shaped faceplate similar to the control faceplate. However, the exemplary sole return depth was 0.40 inch. The exemplary sole return depth was maximized to the manufacturing limit. The exemplary sole return depth was 33% longer than the control return depth. The exemplary club head further comprised an exemplary rear body having an exemplary sole ledge that received the exemplary sole return.

The control and exemplary club heads comprised rear body constructions similar to the club head illustrated in FIG. 9. However, the control sole ledge was longer than the exemplary sole ledge to accommodate the shortened control sole return. The remaining portions of the control and exemplary rear bodies were kept similar to isolate the difference in performance caused by lengthening the exemplary sole return.

The FEA analysis simulated the internal energy of the sample club heads (measured in pound-force inch). The internal energy was the amount of elastic energy stored and released in the club head by a golf ball impacting and bending the strike face. The difference in ball speed (measured in miles per hour) was derived from the difference in internal energy. The sample club heads were tested at a swing speed of 85 mph to simulate real-world swing conditions. The results indicated the performance of each faceplate near a center of the faceplate, and a low-center region, located just below the center of the faceplate.

TABLE 7

| | Control Club Head | Exemplary Club Head |
|---|---|---|
| Center Hits Internal Energy (lbf-in) | 58.52 | 59.91 |
| Low-Center Hits Internal Energy (lbf-in) | 46.25 | 47.82 |

Referring to Table 7 above, the exemplary club head demonstrated a higher internal energy on both center hits and low-center hits. On center hits, the control club head demonstrated an internal energy of 58.52 lbf-in, and the exemplary club head demonstrated an internal energy of 59.91 lbf-in. The exemplary club head increased internal energy by 1.39 lbf-in over the control club head, which translated to a 0.18 mph increase in ball speed on center hits.

On low-center hits, the control club head demonstrated an internal energy of 46.25 lbf-in, and the exemplary club head demonstrated an internal energy of 47.82 lbf-in. The exemplary club head increased internal energy by 1.57 lbf-in over the control club head, which translated to a 0.20 mph increase in ball speed on center hits.

The results of Table 7 illustrate the difference that the sole return depth had on increasing ball speed. As discussed in detail above, increasing the sole return depth increases the amount of rear body material replaced by faceplate material. The replacement of rear body material by faceplate material leads to an increase in the flexibility of the sole. The lengthening of the sole return directly led to a substantial increase in ball speed. For increased performance, it is therefore desirable to maximize the depth of the sole return within manufacturability limits.

Clauses

Clause 1. An iron-type golf club head comprising: a faceplate and a rear body forming a club head body and enclosing a hollow interior cavity; a top rail, a sole, a heel end, and a toe end, wherein: the club head body forms a front end, a rear end, a top rail periphery, a toe periphery, a heel periphery, and a sole periphery; the faceplate is disposed at the front end; the faceplate comprises a strike face, a back surface opposite the strike face, a leading edge proximate the sole, a sole return extending rearward from the back surface and forming at least a portion of the sole, and a faceplate perimeter, wherein: the faceplate perimeter comprises a top perimeter edge, a heel-side perimeter edge, a toe-side perimeter edge and a sole perimeter edge; the rear body forms at least a portion of the top rail, at least a portion of the sole, at least a portion of the toe end; the rear body comprises a rear wall extending from the sole to the top rail at the rear end, a sole ledge, and a hosel structure located on the heel end; the sole ledge projects from the rear body toward the faceplate and forms a portion of the sole; the top perimeter edge of the faceplate is located on the top rail periphery of the club head body, the toe-side perimeter edge of the faceplate is located on the toe periphery of the club head body, and the sole perimeter edge of the faceplate contacts the sole ledge; the faceplate is welded to the rear body along the faceplate perimeter; the rear body further comprises a weight pad proximate the sole and the rear wall, wherein: the weight pad overhangs the sole return, and the weight pad does not contact the sole return.

Clause 2. The iron-type golf club head of clause 1, wherein the weight pad is separated from the sole return by the sole ledge.

Clause 3. The iron-type golf club head of clause 1, further comprising a faceplate surface area measured across the faceplate between the top perimeter edge, the toe-side perimeter edge, the heel-side perimeter edge, and the leading edge; wherein the faceplate surface area is between 5.00 $in^2$ and 6.00 $in^2$.

Clause 4. The iron-type golf club head of clause 1, wherein the faceplate comprises a first material and the rear body comprises a second material different than the first material.

Clause 5. The iron-type golf club head of clause 4, wherein the first material comprises a first yield strength and the second material comprises a second yield strength; and wherein the first yield strength is greater than the second yield strength.

Clause 6. The iron-type golf club head of clause 5, wherein the first yield strength of the first material is between 220 ksi and 300 ksi.

Clause 7. The iron-type golf club head of clause 1, wherein the sole ledge comprises a sole ledge depth between 0.01 inch and 0.20 inch.

Clause 8. The iron-type golf club head of clause 1, wherein the sole return defines a sole return thickness, and the sole ledge defines a sole ledge thickness; and wherein the sole return thickness at the sole perimeter edge is the same as the sole ledge thickness.

Clause 9. The iron-type golf club head of clause 1, wherein the sole return comprises a sole return depth measured in a front-to-rear direction from the leading edge to the sole perimeter edge; wherein the sole return depth is between 0.2 inches and 0.4 inches.

Clause 10. The iron-type golf club head of clause 1, wherein the sole perimeter edge is the only portion of the sole return that contacts the rear body.

Clause 11. The iron-type golf club head of clause 1, wherein the top rail comprises a thickness less than 0.060 inches.

Clause 12. An iron-type golf club head comprising: a faceplate and a rear body forming a club head body and enclosing a hollow interior cavity; a top rail, a sole, a heel end, and a toe end, wherein: the club head body forms a front end, a rear end, a top rail periphery, a toe periphery, a heel periphery, and a sole periphery; the faceplate is disposed at the front end; the faceplate comprises a strike face, a back surface opposite the strike face, a leading edge proximate the sole, a sole return extending rearward from the back surface and forming at least a portion of the sole, and a faceplate perimeter, wherein: the faceplate perimeter comprises a top perimeter edge, a heel-side perimeter edge, a toe-side perimeter edge and a sole perimeter edge; the rear body forms at least a portion of the top rail, at least a portion of the sole, at least a portion of the toe end; the rear body comprises a rear wall extending from the sole to the top rail at the rear end, a sole ledge, and a hosel structure located on the heel end; the sole ledge projects from the rear body toward the faceplate and forms a portion of the sole; the top perimeter edge of the faceplate is located on the top rail periphery of the club head body, the toe-side perimeter edge of the faceplate is located on the toe periphery of the club head body, and the sole perimeter edge of the faceplate contacts the sole ledge; the faceplate is welded to the rear body along the faceplate perimeter; the rear body further comprises a weight pad proximate the sole and the rear wall, wherein: the weight pad overhangs the sole return, and the weight pad does not contact the sole return; the weight pad comprises a front wall facing the front end, a top wall facing the top rail, and a transition region between the front wall and the top wall; and the front wall is angled with respect to the sole.

Clause 13. The iron-type golf club head of clause 12, wherein the weight pad is separated from the sole return by the sole ledge.

Clause 14. The iron-type golf club head of clause 12, wherein the sole ledge comprises a sole ledge depth between 0.01 inch and 0.20 inch.

Clause 15. The iron-type golf club head of clause 12, further comprising an acute angle measured between the front wall of the weight pad and an interior surface of the sole return; wherein the acute angle is between 30 and 80 degrees.

Clause 16. The iron-type golf club head of clause 12, further comprising a lower interior undercut formed between the front wall of the weight pad and the sole; wherein the lower interior undercut defines a lower interior undercut depth measured in a front-to-rear direction between the transition region and a juncture between the front wall and the sole ledge; and wherein the lower interior undercut depth is greater than 0.100 inch.

Clause 17. An iron-type golf club head comprising: a faceplate and a rear body forming a club head body and enclosing a hollow interior cavity; a top rail, a sole, a heel end, and a toe end, wherein: the club head body forms a front end, a rear end, a top rail periphery, a toe periphery, a heel periphery, and a sole periphery; the faceplate is disposed at the front end; the faceplate comprises a strike face, a back surface opposite the strike face, a leading edge proximate the sole, a sole return extending rearward from the back surface and forming at least a portion of the sole, and a faceplate perimeter, wherein: the faceplate perimeter comprises a top perimeter edge, a heel-side perimeter edge, a toe-side perimeter edge and a sole perimeter edge; the rear body forms at least a portion of the top rail, at least a portion of the sole, at least a portion of the toe end; the rear body comprises a rear wall extending from the sole to the top rail at the rear end, a sole ledge, and a hosel structure located on the heel end; the sole ledge projects from the rear body toward the faceplate and forms a portion of the sole; the top perimeter edge of the faceplate is located on the top rail periphery of the club head body, the toe-side perimeter edge of the faceplate is located on the toe periphery of the club head body, and the sole perimeter edge of the faceplate contacts the sole ledge; the faceplate is welded to the rear body along the faceplate perimeter; the rear body further comprises a weight pad proximate the sole and the rear wall, wherein: the weight pad overhangs the sole return, and the weight pad does not contact the sole return; the weight pad comprises a weight pad extension protruding forward from a front wall of the weight pad toward the faceplate and overhanging the sole return.

Clause 18. The iron-type golf club head of clause 17, wherein the weight pad is separated from the sole return by the sole ledge.

Clause 19. The iron-type golf club head of clause 17, wherein the weight pad extension comprises a forward edge and a lower surface disposed toward the sole; wherein a lower interior undercut is formed between the lower surface and an interior surface of the sole.

Clause 20. The iron-type golf club head of clause 19, wherein the lower interior undercut comprises a lower interior undercut depth measured from the forward edge of the weight pad extension to the front wall of the weight pad; wherein the lower interior undercut depth is greater than 0.100 inch.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. An iron-type golf club head comprising:

a faceplate and a rear body forming a club head body and enclosing a hollow interior cavity;

a top rail, a sole, a heel end, and a toe end, wherein:

the club head body forms a front end, a rear end, a top rail periphery, a toe periphery, a heel periphery, and a sole periphery;

the faceplate is disposed at the front end;

the faceplate comprises a strike face, a back surface opposite the strike face, a leading edge proximate the sole, a sole return extending rearward from the back surface and forming at least a portion of the sole, and a faceplate perimeter, wherein:

the faceplate perimeter comprises a top perimeter edge, a heel-side perimeter edge, a toe-side perimeter edge and a sole perimeter edge;

the rear body forms at least a portion of the top rail, at least a portion of the sole, at least a portion of the toe end;

the rear body comprises a rear wall extending from the sole to the top rail at the rear end, a sole ledge, and a hosel structure located on the heel end;

the sole ledge projects from the rear body toward the faceplate and forms a portion of the sole;

the top perimeter edge of the faceplate is located on the top rail periphery of the club head body, the toe-side perimeter edge of the faceplate is located on the toe periphery of the club head body, and the sole perimeter edge of the faceplate contacts the sole ledge;

the faceplate is welded to the rear body along the faceplate perimeter;

the rear body further comprises a weight pad proximate the sole and the rear wall, wherein:

the weight pad overhangs the sole return, and the weight pad does not contact the sole return;

wherein the sole perimeter edge comprises a heel-side sole perimeter edge, a toe-side sole perimeter edge, and a rear sole perimeter edge;

wherein the heel-side sole perimeter edge and the toe-side sole perimeter edge each extend rearwardly from the leading edge at an angle;

wherein the rear sole perimeter edge extends between the heel-side sole perimeter edge and the toe-side sole perimeter edge;

a heel-side taper angle measured as the exterior angle between the heel-side sole perimeter edge and the leading edge and a toe-side taper angle measured as the exterior angle between the toe-side sole perimeter edge and the leading edge;

wherein the heel-side taper angle and the toe-side taper angle are each between 100 and 160 degrees;

wherein the sole return defines a sole return width measured in a heel-to-toe direction;

wherein the sole return width decreases rearward from the strike face;

wherein the rear body further comprises a heel mass and a toe mass;

wherein the heel mass located in a low heel area of the interior cavity and is integrally formed with the heel end, the sole, and the rear wall; and wherein the toe mass is located in a low toe area of the interior cavity and is integrally formed with the toe end, the sole, and the rear wall.

2. The iron-type golf club head of claim 1, wherein the weight pad is separated from the sole return by the sole ledge.

3. The iron-type golf club head of claim 1, further comprising a strike face surface area measured as the area of the faceplate bounded by the top perimeter edge, the toe-side perimeter edge, the heel-side perimeter edge, and the leading edge; wherein the strike face surface area is between 5.00 $in^2$ and 6.00 $in^2$.

4. The iron-type golf club head of claim 1, wherein the faceplate comprises a first material and the rear body comprises a second material different than the first material.

5. The iron-type golf club head of claim 4, wherein the first material comprises a first yield strength and the second material comprises a second yield strength; and wherein the first yield strength is greater than the second yield strength.

6. The iron-type golf club head of claim 5, wherein the first yield strength of the first material is between 220 ksi and 300 ksi.

7. The iron-type golf club head of claim 1, wherein the sole ledge comprises a sole ledge depth measured from a front wall of the weight pad to the sole perimeter edge; and wherein the sole ledge depth is between 0.01 inch and 0.20 inch.

8. The iron-type golf club head of claim 1, wherein the sole return defines a sole return thickness measured between an interior sole return surface disposed toward the hollow interior cavity and an exterior sole return surface disposed toward an exterior of the iron-type club head, and the sole ledge defines a sole ledge thickness measured between an interior sole ledge surface disposed toward the hollow interior cavity and an exterior sole ledge surface disposed toward the exterior of the iron-type club head; and wherein the sole return thickness at the sole perimeter edge is the same as the sole ledge thickness.

9. The iron-type golf club head of claim 1, wherein the sole return comprises a sole return depth measured in a front-to-rear direction from the leading edge to the sole perimeter edge; wherein the sole return depth is between 0.2 inches and 0.4 inches.

10. The iron-type golf club head of claim 1, wherein the sole perimeter edge is the only portion of the sole return that contacts the rear body.

11. The iron-type golf club head of claim 1, wherein the top rail comprises a thickness less than 0.060 inches; wherein the thickness of the top rail is measured between an interior top rail surface disposed toward the hollow interior cavity and an exterior sole return surface disposed toward an exterior of the iron-type club head.

12. An iron-type golf club head comprising:

a faceplate and a rear body forming a club head body and enclosing a hollow interior cavity;

a top rail, a sole, a heel end, and a toe end, wherein:

the club head body forms a front end, a rear end, a top rail periphery, a toe periphery, a heel periphery, and a sole periphery;

the faceplate is disposed at the front end;

the faceplate comprises a strike face, a back surface opposite the strike face, a leading edge proximate the sole, a sole return extending rearward from the back surface and forming at least a portion of the sole, and a faceplate perimeter, wherein:

the faceplate perimeter comprises a top perimeter edge, a heel-side perimeter edge, a toe-side perimeter edge and a sole perimeter edge;

the rear body forms at least a portion of the top rail, at least a portion of the sole, at least a portion of the toe end;

the rear body comprises a rear wall extending from the sole to the top rail at the rear end, a sole ledge, and a hosel structure located on the heel end;

the sole ledge projects from the rear body toward the faceplate and forms a portion of the sole;

the top perimeter edge of the faceplate is located on the top rail periphery of the club head body, the toe-side perimeter edge of the faceplate is located on the toe periphery of the club head body, and the sole perimeter edge of the faceplate contacts the sole ledge;

the faceplate is welded to the rear body along the faceplate perimeter;

the rear body further comprises a weight pad proximate the sole and the rear wall, wherein:

the weight pad overhangs the sole return, and the weight pad does not contact the sole return;

the weight pad comprises a front wall facing the front end, a top wall facing the top rail, and a transition region between the front wall and the top wall; and the front wall is angled with respect to the sole;

wherein the sole perimeter edge comprises a heel-side sole perimeter edge, a toe-side sole perimeter edge, and a rear sole perimeter edge;

wherein the heel-side sole perimeter edge and the toe-side sole perimeter edge each extend rearwardly from the leading edge at an angle;

wherein the rear sole perimeter edge extends between the heel-side sole perimeter edge and the toe-side sole perimeter edge;

a heel-side taper angle measured as the exterior angle between the heel-side sole perimeter edge and the leading edge and a toe-side taper angle measured as the exterior angle between the toe-side sole perimeter edge and the leading edge;

wherein the heel-side taper angle and the toe-side taper angle are each between 100 and 160 degrees;

wherein the sole return defines a sole return width measured in a heel-to-toe direction;

wherein the sole return width decreases rearward from the strike face;

wherein the rear body further comprises a heel mass and a toe mass;

wherein the heel mass located in a low heel area of the interior cavity and is integrally formed with the heel end, the sole, and the rear wall; and wherein the toe mass is located in a low toe area of the interior cavity and is integrally formed with the toe end, the sole, and the rear wall.

13. The iron-type golf club head of claim 12, wherein the weight pad is separated from the sole return by the sole ledge.

14. The iron-type golf club head of claim 12, wherein the sole ledge comprises a sole ledge depth measured from the front wall of the weight pad to the sole perimeter edge; and wherein the sole ledge depth is between 0.01 inch and 0.20 inch.

15. The iron-type golf club head of claim 12, further comprising an acute angle measured between the front wall of the weight pad and an interior surface of the sole return; wherein the acute angle is between 30 and 80 degrees.

16. The iron-type golf club head of claim 12, further comprising a lower interior undercut formed between the front wall of the weight pad and the sole;

wherein the lower interior undercut defines a lower interior undercut depth measured in a front-to-rear direction between a forward-most point of the transition region and a juncture between the front wall and the sole ledge; and wherein the lower interior undercut depth is greater than 0.100 inch.

17. An iron-type golf club head comprising:

a faceplate and a rear body forming a club head body and enclosing a hollow interior cavity;

a top rail, a sole, a heel end, and a toe end, wherein:

the club head body forms a front end, a rear end, a top rail periphery, a toe periphery, a heel periphery, and a sole periphery;

the faceplate is disposed at the front end;

the faceplate comprises a strike face, a back surface opposite the strike face, a leading edge proximate the sole, a sole return extending rearward from the back surface and forming at least a portion of the sole, and a faceplate perimeter, wherein:

the faceplate perimeter comprises a top perimeter edge, a heel-side perimeter edge, a toe-side perimeter edge and a sole perimeter edge;

the rear body forms at least a portion of the top rail, at least a portion of the sole, at least a portion of the toe end;

the rear body comprises a rear wall extending from the sole to the top rail at the rear end, a sole ledge, and a hosel structure located on the heel end;

the sole ledge projects from the rear body toward the faceplate and forms a portion of the sole;

the top perimeter edge of the faceplate is located on the top rail periphery of the club head body, the toe-side perimeter edge of the faceplate is located on the toe periphery of the club head body, and the sole perimeter edge of the faceplate contacts the sole ledge;

the faceplate is welded to the rear body along the faceplate perimeter;

the rear body further comprises a weight pad proximate the sole and the rear wall, wherein:

the weight pad overhangs the sole return, and the weight pad does not contact the sole return;

the weight pad comprises a weight pad extension protruding forward from a front wall of the weight pad toward the faceplate and overhanging the sole return;

wherein the sole perimeter edge comprises a heel-side sole perimeter edge, a toe-side sole perimeter edge, and a rear sole perimeter edge;

wherein the heel-side sole perimeter edge and the toe-side sole perimeter edge each extend rearwardly from the leading edge at an angle;

wherein the rear sole perimeter edge extends between the heel-side sole perimeter edge and the toe-side sole perimeter edge;

a heel-side taper angle measured as the exterior angle between the heel-side sole perimeter edge and the leading edge and a toe-side taper angle measured as the exterior angle between the toe-side sole perimeter edge and the leading edge;

wherein the heel-side taper angle and the toe-side taper angle are each between 100 and 160 degrees;

wherein the sole return defines a sole return width measured in a heel-to-toe direction;

wherein the sole return width decreases rearward from the strike face;

wherein the rear body further comprises a heel mass and a toe mass;

wherein the heel mass located in a low heel area of the interior cavity and is integrally formed with the heel end, the sole, and the rear wall; and wherein the toe mass is located in a low toe area of the interior cavity and is integrally formed with the toe end, the sole, and the rear wall.

18. The iron-type golf club head of claim 17, wherein the weight pad is separated from the sole return by the sole ledge.

19. The iron-type golf club head of claim 17, wherein the weight pad extension comprises a forward edge and a lower surface disposed toward the sole; wherein a lower interior undercut is formed between the lower surface and an interior surface of the sole.

20. The iron-type golf club head of claim 19, wherein the lower interior undercut comprises a lower interior undercut depth measured from a forwardmost point of the forward edge of the weight pad extension to the front wall of the weight pad; wherein the lower interior undercut depth is greater than 0.100 inch.

* * * * *